US006699828B1

(12) United States Patent
de Buzzaccarini et al.

(10) Patent No.: US 6,699,828 B1
(45) Date of Patent: Mar. 2, 2004

(54) AQUEOUS LIQUID DETERGENT COMPOSITIONS COMPRISING AN EFFERVESCENT SYSTEM

(75) Inventors: Francesco de Buzzaccarini, Breendonk (DE); Karel Jozef Maria Depoot, Waregem (BE); Michel Bouvier, Hamilton, OH (US); LeeAnn Luipold, Cincinnati, OH (US); Johanna Elizabeth Kahn, Cincinnati, OH (US)

(73) Assignee: The Procter & Gamble Company, Cincinnati, OH (US)

( * ) Notice: Subject to any disclaimer, the term of this patent is extended or adjusted under 35 U.S.C. 154(b) by 0 days.

(21) Appl. No.: 09/980,328

(22) PCT Filed: Jun. 27, 2000

(86) PCT No.: PCT/US00/17741

§ 371 (c)(1),
(2), (4) Date: Nov. 30, 2001

(87) PCT Pub. No.: WO01/00765

PCT Pub. Date: Jan. 4, 2001

Related U.S. Application Data

(60) Provisional application No. 60/141,340, filed on Jun. 28, 1999.

(51) Int. Cl.[7] ..... C11D 3/395
(52) U.S. Cl. ..... 510/372; 510/310
(58) Field of Search ..... 510/276, 302, 510/303, 308, 310, 375, 370, 372

(56) References Cited

U.S. PATENT DOCUMENTS

| | | | | |
|---|---|---|---|---|
| 1,535,529 A | | 4/1925 | Hopkins | |
| 3,341,418 A | | 9/1967 | Moses et al. | |
| 3,488,287 A | | 1/1970 | Seglin et al. | |
| 3,708,431 A | | 1/1973 | Prussin | |
| 5,480,575 A | * | 1/1996 | Altieri et al. | 252/94 |
| 5,804,546 A | | 9/1998 | Hall | |

FOREIGN PATENT DOCUMENTS

| | | | |
|---|---|---|---|
| EP | 0745665 | * | 12/1996 |
| EP | 0752466 | * | 1/1997 |
| GB | 2 293 157 A | | 3/1996 |
| JP | 58191800 | * | 11/1983 |
| JP | 59066499 A | | 4/1984 |
| WO | WO 98/46715 | | 10/1998 |

* cited by examiner

*Primary Examiner*—Yogendra N. Gupta
*Assistant Examiner*—John M Petruncio
(74) *Attorney, Agent, or Firm*—Armina E. Matthews; Laura Grunzinger; C. Brant Cook

(57) ABSTRACT

Aqueous liquid detergent compositions containing a peracid and an effervesent system, wherein the effervescent system includes a first effervescent agent-containing component and a second acid agent-containing component, and the effervescent agent-containing component and the acid agent-containing component are chemically and/or physically separated from one another until effervescence is desired. Methods of laundering fabrics with such compositions.

21 Claims, No Drawings

AQUEOUS LIQUID DETERGENT COMPOSITIONS COMPRISING AN EFFERVESCENT SYSTEM

This application is a 371 of PCT/US00/17741, filed Jun. 27, 2000, which claims benefit of Ser. No. 60/141,340, filed Jun. 28, 1999.

FIELD OF THE INVENTION

The present invention relates to aqueous liquid detergent compositions and methods of using such compositions to launder fabrics. More specifically, the present invention relates to aqueous liquid detergent compositions comprising an effervescent system.

BACKGROUND OF THE INVENTION

Effervescent systems have been employed in specific types of cleaning and personal care compositions in the past. For example, effervescent agents have been incorporated into non-aqueous liquid detergent compositions.

Further, effervescent systems, or parts thereof, have been used in non-detergent (i.e., non-surfactant) carpet cleaning compositions Further yet, effervescent systems have been employed in contact lens cleaning compositions and other detergent compositions in the form of tablets.

Still further yet, effervescent systems have been employed in toothpastes, mouthwash (mouth rinse), dentifrice and cosmetics in various physical forms.

However, the use of effervescent systems in aqueous liquid detergent compositions is not known, nor has it been suggested in the prior art.

Accordingly, there is a need for an aqueous liquid detergent composition comprising an effervescent system, and a method for laundering fabrics using such a composition.

SUMMARY OF THE INVENTION

The present invention meets and fulfills the needs identified above by providing an aqueous liquid detergent composition comprising an effervescent system.

Many aqueous liquid detergent compositions comprise water-insoluble or partially water-insoluble solid particulates, such as bleaching agents. It has been surprisingly found that the use of an effervescent system in such aqueous liquid detergent compositions increases the dissolution rate of such solid particulates, thus allowing the actives in the solid particulates to perform more rapidly compared to simply allowing dissolution of the solid particulates in the absence of an effervescent system.

In one aspect of the present invention, an aqueous liquid detergent composition comprising an effervescent system is provided.

In another aspect of the present invention, an aqueous liquid detergent composition comprising a surfactant and an effervescent system is provided.

In yet another aspect of the present invention, an aqueous liquid detergent composition comprising an effervescent system comprising an effervescent agent-containing component, preferably a base, and an acid agent-containing component, preferably an inorganic acid, more preferably citric acid, is provided.

In still yet another aspect of the present invention, an aqueous liquid detergent composition comprising an effervescent agent-containing component and an acid agent-containing component wherein the effervescent agent-containing component is contained within a first compartment of a dual compartment container and the acid agent-containing component is contained within the other compartment of the dual compartment container such that the effervescent agent-containing component and acid agent-containing component only effervescent after being mixed together.

In still yet another aspect of the present invention, a method for laundering fabrics in need of laundering comprising contacting the fabrics with the aqueous liquid detergent composition of the present invention is provided.

In yet another aspect of the present invention, an aqueous liquid detergent composition comprising an effervescent system comprising an effervescent agent-containing component, preferably a peroxide reducing enzyme, such as peroxidase, laccase, dioxygenase and/or catalase, and a source of peroxide component, preferably hydrogen peroxide, is provided.

In still yet another aspect of the present invention, an aqueous liquid detergent composition comprising an effervescent agent-containing component and a source of peroxide component wherein the effervescent agent-containing component is contained within a first compartment of a dual compartment container and the source of peroxide component is contained within the other compartment of the dual compartment container such that the effervescent agent-containing component and the source of peroxide component only effervesce after being mixed together.

Accordingly, the present invention provides an aqueous liquid detergent composition comprising an effervescent system and a method for laundering fabrics in need of laundering comprising contacting the fabrics with the aqueous liquid detergent composition of the present invention.

These and other aspects, objects, features and advantages will be clear from the following detailed description, examples and appended claims.

All percentages, ratios and proportions herein are on a weight basis unless otherwise indicated. All documents cited herein are hereby incorporated by reference.

DETAILED DESCRIPTION

Aqueous Liquid Detergent Compositions

"Aqueous liquid detergent compositions" as used herein means heavy duty liquid laundry detergent compositions, light duty liquid detergent compositions (liquid dishwashing compositions), liquid fabric softeners, liquid fabric conditioners, liquid hard surface cleaning compositions. However, toothpastes, mouth wash compositions, mouth rinse compositions, carpet cleaning compositions and cosmetic compositions are not within the scope of the present invention.

Effervescent System

The effervescent system of the present invention can be any suitable effervescent system known to those skilled in the art. For example, the effervescent system may comprise two components: 1) a source of peroxide component such as hydrogen peroxide and 2) an effervescent agent-containing component such as catalase enzyme and/or the effervescent system may comprise two components: 1) an effervescent agent-containing component, such as bicarbonate and 2) an acid agent-containing component, such as citric acid.

"Effervescence" as used herein includes, but is not limited to, the formation of gas, gas bubbles, foam, mousse, etc. from the effervescent system as described herein.

Preferably, the effervescent system of the present invention comprises the following two components: 1) an effervescent agent-containing component and 2) an acid agent-containing component and/or a source of peroxide component.

It is desirable that the effervescent agent-containing component and the acid agent-containing component and/or the source of peroxide component are chemically separated from one another until effervescence is desired, at which time the two components are mixed together. Examples of chemical separation are encapsulation of one or both of the components in the same matrix.

Alternatively, it is desirable that the effervescent agent-containing component and the acid agent-containing component and/or the source of peroxide component are physically separated from one another until effervescence is desired, at which time the two components are mixed together. Examples of physical separation are a dual compartment container, such as a bottle like that described in U.S. Pat. No. 4,678,103 to Dirksing, wherein one component is in one compartment and the other component is in the other compartment. The two components preferably do not mix until effervescence is desired, such as when the aqueous liquid detergent composition is being poured into a dosing device and/or washing machine.

Another example of a package form which keeps the effervescent agent-containing component and the acid agent-containing component and/or the source of peroxide component physically separated until such time that they are mixed, is a single-use pouch or microsphere containing one or the other, but not both, of the effervescent agent-containing component or the acid agent-containing component and/or the source of peroxide component. For example, the single-use pouch or microspheres (i.e., Expancel® commercially available from Expancel of Sweden (an Akzo Nobel company)) may contain the acid agent-containing component or the source of peroxide component, wherein the single-use pouch or microsphere is added to the effervescent agent-containing component.

Chemical and physical separation of the effervescent agent-containing component and the acid agent-containing component and/or the source of peroxide component is another embodiment of the effervescent system.

Preferably, at least one of the effervescent agent-containing component and the acid agent-containing component and/or the source of peroxide component is in liquid form. For example, the effervescent agent-containing component can be in liquid form and the acid agent-containing component and/or the source of peroxide component can be in solid form, such as a tablet or granule. More preferably, both the effervescent agent-containing component and the acid agent-containing component and/or the source of peroxide component are in liquid form.

The effervescent agent-containing component and the acid agent-containing component and/or the source of peroxide component can be present in said compositions of the present invention at any suitable level such that effervescence is achieved after coming into contact with one another.

When the effervescent system comprises the effervescent agent-containing component and the acid agent-containing component, the effervescent agent-containing component and the acid agent-containing component are preferably present in said compositions of the present invention at a weight ratio of from about 20:1 to about 0.2:1, more preferably from about 10:1 to about 0.4:1; most preferably from about 4:1 to about 1:1.

When the effervescent system comprises the effervescent agent-containing component and the source of peroxide component, the effervescent agent-containing component and the source of peroxide component are preferably present in said compositions of the present invention at a weight ratio of from about 1:30 to about 30:1, more preferably from about 1:20 to about 10:1; most preferably from about1:3.5 to about 2:1.

Effervescent Agent-Containing Component

Any suitable effervescent agent-containing component known to those skilled in the art can be used in the present invention so long as the effervescent agent-containing component's pH, when physically separated from the acid agent-containing component and/or the source of peroxide component, is about 7 or more, preferably from about 7 to about 11, more preferably from about 8 to about 9.

In one preferred embodiment, the effervescent agent-containing component preferably comprises a base, preferably present at a level of from about 1% to about 10%, more preferably from about 2% to about 5% by weight of the compositions of the present invention.

Suitable bases for use in the effervescent agent-containing component include, but are not limited to, carbonates, bicarbonates, sesquicarbonates and mixtures thereof. Preferably, the base is selected from the group consisting of sodium carbonate, potassium carbonate, lithium carbonate, magnesium carbonate, calcium carbonate, ammonium carbonate, mono-, di-, tri- or tetra-alkyl or aryl, substituted or unsubstituted, ammonium carbonate, sodium bicarbonate, potassium bicarbonate, lithium bicarbonate, magnesium bicarbonate, calcium bicarbonate, ammonium bicarbonate, mono-, di-, tri- or tetra-alkyl or aryl, substituted or unsubstituted, ammonium bicarbonate and mixtures thereof.

The most preferred bases are selected from the group consisting of sodium bicarbonate, monoethanolammonium bicarbonate and mixtures thereof.

The effervescent agent-containing component, in addition to the base, preferably further comprises a surfactant selected from the group consisting of anionic, nonionic, cationic, amphoteric, zwitterionic surfactants and mixtures thereof.

In another preferred embodiment, the effervescent agent-containing component preferably comprises a peroxide reducing enzyme, such as peroxidase, laccase, dioxygenase and/or catalase enzyme, preferably catalase enzyme, preferably present at a level of from about 0.001% to about 10%, more preferably, from about 0.01% to about 5%, even more preferably from about 0.1% to about 1%, most preferably from about 0.1% to about 0.3% by weight of the compositions of the present invention. Catalase enzyme is commercially available from Biozyme Laboratories under the trade name Cat-1A, which is a biovine liver derived catalase enzyme; from Genencor International under the trade name Oxy-Gone 400, which is a bacterial derived catalase enzyme; and from Novo Nordisk under the trade name Terminox Ultra 50L.

Acid Agent-Containing Component

Any suitable acid agent-containing component known to those skilled in the art can be used in the present invention so long as the acid agent-containing component's pH, when physically separated from the effervescent agent-containing component, is about 7 or less, preferably from about 0 to about 6, more preferably from about 3 to about 4.

Preferably, the acid agent-containing component comprises an acid, preferably present at a level of from about 1% to about 20%, more preferably from about 3% to about 10% by weight of the compositions of the present invention.

Suitable acids for use in the effervescent agent-containing component include acids that have a pKa of 7 or less, preferably from about 3 to about 7.

Nonlimiting examples of suitable acids for use in the present invention include inorganic acids, organic acids and mixtures thereof. Preferably, the inorganic acids are selected from the group consisting of sulfuric acid, hydrochloric acid, phosphoric acid, nitric acid and mixtures thereof. Preferably, the organic acids are selected from the group consisting of formic acid, acetic acid, $C_{12}$–$C_{18}$ fatty acids, malic acid, maleic acid, malonic acid, succinic acid, tartaric acid, lactic acid, glutaric acid, fumaric acid, benzoic acid, phthalic acid, citric acid and mixtures thereof. Organic acids are preferred, most preferred are citric acid and/or succinic acid.

The acid agent-containing component, when physically separated from the effervescent agent-containing component, preferably has a pH of about 7 or more, more preferably of from about 7 to about 11, most preferably of from about 8 to about 9.

The acid agent-containing component, in addition to the acid, preferably further comprises one or more adjunct ingredients selected from the group consisting of peroxide bleaches, hydrogen peroxide, polycarboxylic acid polymers, chelants, builders, electrolytes and mixtures thereof. Preferably, the acid agent-containing component comprises a pre-formed peroxy carboxylic acid (a "peracid"). More preferably, the acid agent-containing component comprises phthaloylamino peroxycaproic acid.

Source of Peroxide Component

The source of peroxide, preferably hydrogen peroxide, may be any suitable source of peroxide and present at any level, such as fully described in U.S. Pat. No. 5,576,282, preferably present at levels of from about 0.001% to about 15%, more preferably present at levels of from about 0.01% to about 10%, most preferably present at levels of from about 0.1% to about 6% by weight of the composition. For example, the hydrogen peroxide source may be selected from the group consisting of perborate compounds, percarbonate compounds, perphosphate compounds and mixtures thereof.

Hydrogen peroxide sources are described in detail in the herein incorporated Kirk Othmer's Encyclopedia of Chemical Technology, 4th Ed (1992, John Wiley & Sons), Vol. 4, pp. 271–300 "Bleaching Agents (Survey)", and include the various forms of sodium perborate and sodium percarbonate, including various coated and modified forms.

The preferred source of hydrogen peroxide used herein can be any convenient source, including hydrogen peroxide itself. For example, perborate, e.g., sodium perborate (any hydrate but preferably the mono- or tetra-hydrate), sodium carbonate peroxyhydrate or equivalent percarbonate salts, sodium pyrophosphate peroxyhydrate, urea peroxyhydrate, or sodium peroxide can be used herein. Also useful are sources of available oxygen such as persulfate bleach (e.g., OXONE, manufactured by DuPont). Sodium perborate monohydrate and sodium percarbonate are particularly preferred. Mixtures of any convenient hydrogen peroxide sources can also be used.

Aqueous Liquid Detergent Compositions

The present invention comprises aqueous based liquid detergent compositions. The aqueous liquid detergent compositions preferably comprise in addition to the effervescent system described hereinabove, about 10% to about 98%, preferably from about 30% to about 95%, by weight of an aqueous liquid carrier which is preferably water. The aqueous liquid detergent compositions of the present invention also preferably comprise one or more cleaning adjunct materials. The term "cleaning adjunct materials", as used herein, means any liquid, solid or gaseous material selected for aqueous liquid detergent compositions, preferably compatible with the other ingredients present in the aqueous liquid detergent compositions of the present invention.

The specific selection of cleaning adjunct materials are readily made by considering the surface, item or fabric to be cleaned. Examples of suitable cleaning adjunct materials include, but are not limited to, surfactants, builders, bleaches, bleach activators, bleach catalysts, enzymes, enzyme stabilizing systems, chelants, optical brighteners, soil release polymers, dye transfer agents, dispersants, suds suppressors, dyes, perfumes, colorants, filler salts, hydrotropes, photoactivators, fluorescers, fabric conditioners, fabric softening agents, hydrolyzable surfactants, preservatives, anti-oxidants, anti-shrinkage agents, anti-wrinkle agents, germicides, fungicides, color speckles, silvercare, anti-tarnish and/or anti-corrosion agents, alkalinity sources, solubilizing agents, carriers, processing aids, pigments and pH control agents as described in U.S. Pat. Nos. 5,705,464, 5,710,115, 5,698,504, 5,695,679, 5,686,014 and 5,646,101. Specific cleaning adjunct materials are exemplified in detail hereinafter.

One or more cleaning adjunct materials may be present in the effervescent agent-containing component or the acid agent-containing component, especially when the two components are physically separated from one another.

If the cleaning adjunct materials are not compatible with the other ingredients present in the aqueous liquid detergent compositions of the present invention, then suitable methods of keeping the incompatible cleaning adjunct materials and the other ingredients separate (not in contact with each other) until combination of the two components is appropriate can be used. Suitable methods can be any method known in the art, such as gelcaps, encapsulation, tablets, physical separation, etc.

The aqueous liquid detergent compositions of the present invention comprise:

(a) an effervescent system, preferably comprising:
  i) an effervescent agent-containing component; and
  ii) an acid agent-containing component and/or a source of peroxide component; and
(b) optionally, but preferably, a surfactant; and
(c) optionally, but preferably, one or more cleaning adjunct materials.

The aqueous liquid detergent compositions may include from about 1% to about 99.9% by weight of the composition of the cleaning adjunct materials.

As used herein, "fabric laundry compositions" include band and machine laundry detergent compositions including laundry additive compositions and compositions suitable for use in the soaling and/or pretreatment of stained fabrics.

When the aqueous liquid detergent compositions of the present invention are formulated as compositions suitable for use in a laundry machine washing method, the compositions of the present invention preferably contain both a surfactant and a builder compound and additionally one or more cleaning adjunct materials preferably selected from organic polymeric compounds, bleaching agents, additional enzymes, suds suppressors, dispersants, lime-soap dispersants, soil suspension and anti-redeposition agents and corrosion inhibitors. Laundry compositions can also contain softening agents, as additional cleaning adjunct materials.

The aqueous liquid detergent compositions of the present invention can also be used as detergent additive products in liquid form. Such additive products are intended to supplement or boost the performance of conventional detergent compositions and can be added at any stage of the laundry process.

If needed the density of the laundry detergent compositions herein ranges from 400 to 1200 g/liter, preferably 500 to 1100 g/liter of composition measured at 20° C.

The aqueous liquid detergent compositions according to the present invention can be in a "concentrated form", in such case, the aqueous liquid detergent compositions according to the present invention will contain a lower amount of water, compared to conventional liquid detergents. Typically the water content of the concentrated aqueous liquid detergent composition is preferably less than 40%, more preferably less than 30%, most preferably less than 20% by weight of the composition.

Further, the aqueous liquid detergent compositions according to the present invention may be isotropic liquids, aqueous gels and colored liquid compositions.

Preferred Cleaning Adjunct Materials

Surfactants

The aqueous liquid detergent compositions of the present invention preferably comprise a surfactant system which preferably contains one or more detersive co-surfactants. The co-surfactants can be selected from nonionic detersive surfactant, anionic detersive surfactant, zwitterionic detersive surfactant, amine oxide detersive surfactant, biodegradably branched surfactants and mixtures thereof. The surfactant system typically comprises from about 5% to about 70%, preferably from about 15% to about 30%, by weight of the detergent composition.

i. Anionic Surfactant

Anionic surfactants include $C_{11}$–$C_{18}$ alkyl benzene sulfonates (LAS) and primary, branched-chain and random $C_{10}$–$C_{20}$ alkyl sulfates (AS), the $C_{10}$–$C_{18}$ secondary (2,3) alkyl sulfates of the formula $CH_3(CH_2)_x(CHOSO_3^-M^+)CH_3$ and $CH_3(CH_2)_y(CHOSO_3^-M^+)\ CH_2CH_3$ where x and (y+1) are integers of at least about 7, preferably at least about 9, and M is a water-solubilizing cation, especially sodium, unsaturated sulfates such as oleyl sulfate, the $C_{10}$–$C_{18}$ alkyl alkoxy sulfates ("$AE_xS$"; especially EO 1–7 ethoxy sulfates), $C_{10}$–$C_{18}$ alkyl alkoxy carboxylates (especially the EO 1–5 ethoxycarboxylates), the $C_{10}$–$C_{18}$ glycerol ethers, the $C_{10}$–$C_{18}$ alkyl polyglycosides and their corresponding sulfated polyglycosides, and $C_{12}$–$C_{18}$ alpha-sulfonated fatty acid esters.

Generally speaking, anionic surfactants useful herein are disclosed in U.S. Pat. No. 4,285,841, Barrat et al, issued Aug. 25, 1981, and in U.S. Pat. No. 3,919,678, Laughlin et al, issued Dec. 30, 1975.

Useful anionic surfactants include the water-soluble salts, particularly the alkali metal, ammonium and alkylolammonium (e.g., monoethanolammonium or triethanolammonium) salts, of organic sulfuric reaction products having in their molecular structure an alkyl group containing from about 10 to about 20 carbon atoms and a sulfonic acid or sulfuric acid ester group. (Included in the term "alkyl" is the alkyl portion of aryl groups.) Examples of this group of synthetic surfactants are the alkyl sulfates, especially those obtained by sulfating the higher alcohols ($C_8$–$C_{18}$ carbon atoms) such as those produced by reducing the glycerides of tallow or coconut oil.

Other anionic surfactants herein are the water-soluble salts of alkyl phenol ethylene oxide ether sulfates containing from about 1 to about 4 units of ethylene oxide per molecule and from about 8 to about 12 carbon atoms in the alkyl group.

Other useful anionic surfactants herein include the water-soluble salts of esters of a-sulfonated fatty acids containing from about 6 to 20 carbon atoms in the fatty acid group and from about 1 to 10 carbon atoms in the ester group; water-soluble salts of 2-acyloxy-alkane-1-sulfonic acids containing from about 2 to 9 carbon atoms in the acyl group and from about 9 to about 23 carbon atoms in the alkane moiety; water-soluble salts of olefin sulfonates containing from about 12 to 24 carbon atoms; and b-alkyloxy alkane sulfonates containing from about 1 to 3 carbon atoms in the alkyl group and from about 8 to 20 carbon atoms in the alkane moiety.

Particularly preferred anionic surfactants herein are the alkyl sulfates, in particular, the alkyl polyethoxylate sulfates of the formula:

$$RO(C_2H_4O)_xSO_3^-M^+$$

wherein R is an alkyl chain having from about 10 to about 22 carbon atoms, saturated or unsaturated, M is a cation which makes the compound water-soluble, especially an alkali metal, ammonium or substituted ammonium cation, and x averages from about 1 to about 15, and the non-ethoxylated $C_{12-15}$ primary and secondary alkyl sulfates. Under cold water washing conditions, i.e., less than abut 65° F. (18.3° C.), it is preferred that there be a mixture of such ethoxylated and non-ethoxylated alkyl sulfates.

The fatty acids useful in the present invention as anionic surfactants include saturated and/or unsaturated fatty acids obtained from natural sources or synthetically prepared. Examples of suitable fatty acids include, but are not limited to, capric, lauric, myristic, palmitic, stearic, arachidic, and behenic acid. Other fatty acids include palmitoleic, oleic, linoleic, linolenic, and ricinoleic acid.

Examples of suitable anionic surfactants are also given in "Surface Active Agents and Detergents" (Vol. I and II by Schwartz, Perry and Berch). A variety of such surfactants are also generally disclosed in U.S. Pat. No. 3,929,678, issued Dec. 30, 1975 to Laughlin, et al. at Column 23, line 58 through Column 29, line 23.

ii. Nonionic Surfactant

Suitable nonionic detergent surfactants are generally disclosed in U.S. Pat. No. 3,929,678, Laughlin et al., issued Dec. 30, 1975, and U.S. Pat. No. 4,285,841, Barrat et al, issued Aug. 25, 1981. Exemplary, non-limiting classes of useful nonionic surfactants include: $C_8$–$C_{18}$ alkyl ethoxylates ("AE"), with EO about 1–22, including the so-called narrow peaked alkyl ethoxylates and $C_6$–$C_{12}$ alkyl phenol alkoxylates (especially ethoxylates and mixed ethoxy/propoxy), alkyl dialkyl amine oxide, alkanoyl glucose amide, and mixtures thereof.

If nonionic surfactants are used, the compositions of the present invention will preferably contain up to about 10%, preferably from 0% to about 5%, more preferably from 0% to about 3%, by weight of an nonionic surfactant. Preferred are the ethoxylated alcohols and ethoxylated alkyl phenols of the formula $R(OC_2H_4)_nOH$, wherein R is selected from the group consisting of aliphatic hydrocarbon radicals containing from about 8 to about 15 carbon atoms and alkyl phenyl radicals in which the alkyl groups contain from about 8 to about 12 carbon atoms, and the average value of n is from about 5 to about 15. These surfactants are more fully described in U.S. Pat. No. 4,284,532, Leikhim et al, issued Aug. 18, 1981. Particularly preferred are ethoxylated alcohols having an average of from about 10 to abut 15 carbon atoms in the alcohol and an average degree of ethoxylation of from about 6 to about 12 moles of ethylene oxide per mole of alcohol.

Other nonionic surfactants for use herein include, but are not limited to:

The polyethylene, polypropylene, and polybutylene oxide condensates of alkyl phenols. In general, the polyethylene oxide condensates are preferred. These compounds include the condensation products of alkyl phenols having an alkyl group containing from about 6 to about 12 carbon atoms in either a straight chain or branched chain configuration with the alkylene oxide. In a preferred embodiment, the ethylene oxide is present in an amount equal to from about 5 to about 25 moles of ethylene oxide per mole of alkyl phenol. Commercially available nonionic surfactants of this type include Igepal® CO-630, marketed by the GAF Corporation; and Triton® X45, X-114, X-100, and X-102, all marketed by the Rohm & Haas Company. These compounds are commonly referred to as alkyl phenol alkoxylates, (e.g., alkyl phenol ethoxylates).

The condensation products of aliphatic alcohols with from about 1 to about 25 moles of ethylene oxide. The alkyl chain of the aliphatic alcohol can either be straight or branched, primary or secondary, and generally contains from about 8 to about 22 carbon atoms. Particularly preferred are the condensation products of alcohols having an alkyl group containing from about 10 to about 20 carbon atoms with from about 2 to about 18 moles of ethylene oxide per mole of alcohol. Examples of commercially available nonionic surfactants of this type include Tergitol® 15-S-9 (the condensation product of $C_{11}$–$C_{15}$ linear secondary alcohol with 9 moles ethylene oxide), Tergitol® 24-L-6 NMW (the condensation product of $C_{12}$–$C_{14}$ primary alcohol with 6 moles ethylene oxide with a narrow molecular weight distribution), both marketed by Union Carbide Corporation; Neodol® 45-9 (the condensation product of $C_{14}$–$C_{15}$ linear alcohol with 9 moles of ethylene oxide), Neodol® 23-6.5 (the condensation product of $C_{12}$–$C_{13}$ linear alcohol with 6.5 moles of ethylene oxide), Neodol® 45-7 (the condensation product of $C_{14}$–$C_{15}$ linear alcohol with 7 moles of ethylene oxide), Neodol® 45-4 (the condensation product of $C_{14}$–$C_{15}$ linear alcohol with 4 moles of ethylene oxide), marketed by Shell Chemical Company, and Kyro® EOB (the condensation product of $C_{13}$–$C_{15}$ alcohol with 9 moles ethylene oxide), marketed by The Procter & Gamble Company. Other commercially available nonionic surfactants include Dobanol 91-8® marketed by Shell Chemical Co. and Genapol UD-080® marketed by Hoechst. This category of nonionic surfactant is referred to generally as "alkyl ethoxylates."

The condensation products of ethylene oxide with a hydrophobic base formed by the condensation of propylene oxide with propylene glycol. The hydrophobic portion of these compounds preferably has a molecular weight of from about 1500 to about 1800 and exhibits water insolubility. The addition of polyoxyethylene moieties to this hydrophobic portion tends to increase the water solubility of the molecule as a whole, and the liquid character of the product is retained up to the point where the polyoxyethylene content is about 50% of the total weight of the condensation product, which corresponds to condensation with up to about 40 moles of ethylene oxide. Examples of compounds of this type include certain of the commercially-available Pluronic® surfactants, marketed by BASF.

The condensation products of ethylene oxide with the product resulting from the reaction of propylene oxide and ethylenediamine. The hydrophobic moiety of these products consists of the reaction product of ethylenediamine and excess propylene oxide, and generally has a molecular weight of from about 2500 to about 3000. This hydrophobic moiety is condensed with ethylene oxide to the extent that the condensation product contains from about 40% to about 80% by weight of polyoxyethylene and has a molecular weight of from about 5,000 to about 11,000. Examples of this type of nonionic surfactant include certain of the commercially available Tetronic® compounds, marketed by BASF.

Semi-polar nonionic surfactants are a special category of nonionic surfactants which include water-soluble amine oxides containing one alkyl moiety of from about 10 to about 18 carbon atoms and 2 moieties selected from the group consisting of alkyl groups and hydroxyalkyl groups containing from about 1 to about 3 carbon atoms; water-soluble phosphine oxides containing one alkyl moiety of from about 10 to about 18 carbon atoms and 2 moieties selected from the group consisting of alkyl groups and hydroxyalkyl groups containing from about 1 to about 3 carbon atoms; and water-soluble sulfoxides containing one alkyl moiety of from about 10 to about 18 carbon atoms and a moiety selected from the group consisting of alkyl and hydroxyalkyl moieties of from about 1 to about 3 carbon atoms.

Semi-polar nonionic detergent surfactants include the amine oxide surfactants having the formula $$R^3(OR^4)_xN(R^5)_2 \rightarrow O$$

wherein $R^3$ is an alkyl, hydroxyalkyl, or alkyl phenyl group or mixtures thereof containing from about 8 to about 22 carbon atoms; $R^4$ is an alkylene or hydroxyalkylene group containing from about 2 to about 3 carbon atoms or mixtures thereof, x is from 0 to about 3; and each $R^5$ is an alkyl or hydroxyalkyl group containing from about 1 to about 3 carbon atoms or a polyethylene oxide group containing from about 1 to about 3 ethylene oxide groups. The $R^5$ groups can be attached to each other, e.g., through an oxygen or nitrogen atom, to form a ring structure.

These amine oxide surfactants in particular include $C_{10}$–$C_{18}$ alkyl dimethyl amine oxides and $C_8$–$C_{12}$ alkoxy ethyl dihydroxy ethyl amine oxides.

Alkylpolysaccharides disclosed in U.S. Pat. No. 4,565,647, Llenado, issued Jan. 21, 1986, having a hydrophobic group containing from about 6 to about 30 carbon atoms, preferably from about 10 to about 16 carbon atoms and a polysaccharide, e.g., a polyglycoside, hydrophilic group containing from about 1.3 to about 10, preferably from about 1.3 to about 3, most preferably from about 1.3 to about 2.7 saccharide units. Any reducing saccharide containing 5 or 6 carbon atoms can be used, e.g., glucose, galactose and galactosyl moieties can be substituted for the glucosyl moieties. (Optionally the hydrophobic group is attached at the 2-, 3-, 4-, etc. positions thus giving a glucose or galactose as opposed to a glucoside or galactoside.) The intersaccharide bonds can be, e.g., between the one position of the additional saccharide units and the 2-, 3-, 4-, and/or 6-positions on the preceding saccharide units.

Optionally, and less desirably, there can be a polyalkylene-oxide chain joining the hydrophobic moiety and the polysaccharide moiety. The preferred alkyleneoxide is ethylene oxide. Typical hydrophobic groups include alkyl groups, either saturated or unsaturated, branched or unbranched containing from about 8 to about 18, preferably from about 10 to about 16, carbon atoms. Preferably, the alkyl group is a straight chain saturated alkyl group. The alkyl group can contain up to about 3hydroxy groups and/or the polyalkyleneoxide chain can contain up to about 10, preferably less than 5, alkyleneoxide moieties. Suitable alkyl polysaccharides are octyl, nonyl, decyl, undecyldodecyl, tridecyl, tetradecyl, pentadecyl, hexadecyl, heptadecyl, and octadecyl, di-, tri-, tetra-, penta-, and hexaglucosides, galactosides, lactosides, glucoses, fructosides, fructoses and/or galactoses. Suitable mixtures include coconut alkyl, di-, tri-, tetra-, and pentaglucosides and tallow alkyl tetra-, penta-, and hexa-glucosides.

The preferred alkylpolyglycosides have the formula $$R^2O(C_nH_{2n}O)_t(\text{glycosyl})_x$$

wherein $R^2$ is selected from the group consisting of alkyl, alkyl-phenyl, hydroxyalkyl, hydroxyalkylphenyl, and mixtures thereof in which the alkyl groups contain from about 10 to about 18, preferably from about 12 to about 14, carbon atoms; n is 2 or 3, preferably 2; t is from 0 to about 10, preferably 0; and x is from about 1.3 to about 10, preferably from about 1.3 to about 3, most preferably from about 1.3 to about 2.7. The glycosyl is preferably derived from glucose. To prepare these compounds, the alcohol or alkylpolyethoxy alcohol is formed first and then reacted with glucose, or a source of glucose, to form the glucoside (attachment at the 1-position). The additional glycosyl units can then be attached between their 1-position and the preceding glycosyl units 2-, 3-, 4- and/or 6-position, preferably predominantly the 2-position.

Fatty acid amide surfactants having the formula:

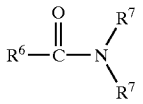

wherein $R^6$ is an alkyl group containing from about 7 to about 21 (preferably from about 9 to about 17) carbon atoms and each $R^7$ is selected from the group consisting of hydrogen, $C_1$–$C_4$ alkyl, $C_1$–$C_4$ hydroxyalkyl, and —$(C^2H_4O)_xH$ where x varies from about 1 to about 3.

Preferred amides are $C_8$–$C_{20}$ ammonia amides, monoethanolamides, dietha-nolamides, and isopropanolamides. Conventional nonionic and amphoteric surfactants include $C_{12}$–$C_{18}$ alkyl ethoxylates (AE) including the so-called narrow peaked alkyl ethoxylates and $C_6$–$C_{12}$ alkyl phenol alkoxylates (especially ethoxylates and mixed ethoxy/propoxy). The $C_{10}$–$C_{18}$ N-alkyl polyhydroxy fatty acid amides can also be used. Typical examples include the $C_{12}$–$C_{18}$ N-methylglucamides. See WO 9,206,154. Other sugar-derived surfactants include the N-alkoxy polyhydroxy fatty acid amides, such as $C_{10}$–$C_{18}$ N-(3-methoxypropyl) glucamide. The N-propyl through N-hexyl $C_{12}$–$C_{18}$ glucamides can be used for low sudsing. $C_{10}$–$C_{20}$ conventional soaps may also be used. If high sudsing is desired, the branched-chain $C_{10}$–$C_{16}$ soaps may be used. Examples of nonionic surfactants are described in U.S. Pat. No. 4,285,841, Barrat et al, issued Aug. 25, 1981.

Preferred examples of these surfactants include ethoxylated alcohols and ethoxylated alkyl phenols of the formula $R(OC_2H_4)_nOH$, wherein R is selected from the group consisting of aliphatic hydrocarbon radicals containing from about 8 to about 15 carbon atoms and alkyl phenyl radicals in which the alkyl groups contain from about 8 to about 12 carbon atoms, and the average value of n is from about 5 to about 15. These surfactants are more fully described in U.S. Pat. No. 4,284,532, Leikhim et al, issued Aug. 18, 1981. Particularly preferred are ethoxylated alcohols having an average of from about 10 to abut 15 carbon atoms in the alcohol and an average degree of ethoxylation of from about 6 to about 12 moles of ethylene oxide per mole of alcohol. Mixtures of anionic and nonionic surfactants are especially useful.

Other conventional useful surfactants are listed in standard texts, including $C_{12}$–$C_{18}$ betaines and sulfobetaines (sultaines).

iii. Amine Oxide Surfactants

The compositions herein also contain amine oxide surfactants of the formula:

$$R^1(EO)_x(PO)_y(BO)_zN(O)(CH_2R')_2.qH_2O \quad (I)$$

In general, it can be seen that the structure (I) provides one long-chain moiety $R^1(EO)_x(PO)_y(BO)_z$ and two short chain moieties, $CH_2R'$. R' is preferably selected from hydrogen, methyl and —$CH_2OH$. In general $R^1$ is a primary or branched hydrocarbyl moiety which can be saturated or unsaturated, preferably, $R^1$ is a primary alkyl moiety. When x+y+z=0, $R^1$ is a hydrocarbyl moiety having chain length of from about 8 to about 18. When x+y+z is different from 0, $R^1$ may be somewhat longer, having a chain length in the range $C_{12}$–$C_{24}$. The general formula also encompasses amine oxides wherein x+y+z=0, $R^1=C_{8-C18}$, R' is H and q is 0–2, preferably 2. These amine oxides are illustrated by $C_{12-14}$ alkyldimethyl amine oxide, hexadecyl dimethylamine oxide, octadecylamine oxide and their hydrates, especially the dihydrates as disclosed in U.S. Pat. Nos. 5,075,501 and 5,071,594, incorporated herein by reference.

The invention also encompasses amine oxides wherein x+y+z is different from zero, specifically x+y+z is from about 1 to about 10, $R^1$ is a primary alkyl group containing 8 to about 24 carbons, preferably from about 12 to about 16 carbon atoms; in these embodiments y+z is preferably 0 and x is preferably from about 1 to about 6, more preferably from about 2 to about 4; EO represents ethyleneoxy; PO represents propyleneoxy; and BO represents butyleneoxy. Such amine oxides can be prepared by conventional synthetic methods, e.g., by the reaction of alkylethoxysulfates with dimethylamine followed by oxidation of the ethoxylated amine with hydrogen peroxide.

Highly preferred amine oxides herein are solids at ambient temperature, more preferably they have melting-points in the range 30° C. to 90° C. Amine oxides suitable for use herein are made commercially by a number of suppliers, including Akzo Chemie, Ethyl Corp., and Procter & Gamble. See McCutcheon's compilation and Kirk-Othmer review article for alternate amine oxide manufacturers. Preferred commercially available amine oxides are the solid, dihydrate ADMOX 16 and ADMOX 18, ADMOX 12 and especially ADMOX 14 from Ethyl Corp.

Preferred embodiments include dodecyldimethylamine oxide dihydrate, hexadecyldimethylamine oxide dihydrate, octadecyldimethylamine oxide dihydrate, hexadecyltris (ethyleneoxy)dimethyl-amine oxide, tetradecyldimethylamine oxide dihydrate, and mixtures thereof.

Whereas in certain of the preferred embodiments R' is H, there is some latitude with respect to having R' slightly larger than H. Specifically, the invention further encompasses embodiments wherein R' is $CH_2OH$, such as hexadecylbis(2-hydroxyethyl)amine oxide, tallowbis(2-hydroxyethyl)amine oxide, stearylbis(2-hydroxyethyl) amine oxide and oleylbis(2-hydroxyethyl)amine oxide.

iv. Biodegradably Branched Surfactants

The compositions of the present invention may also include biodegradably branched and/or crystallinity disrupted and/or mid-chain branched surfactants or surfactant mixtures. These surfactants are more fully disclosed in WO98/23712 A published Jun. 4, 1998; WO97/38957 A published Oct. 23, 1997; WO97/38956 A published Oct. 23, 1997; WO97/39091 A published Oct. 23, 1997; WO97/39089 A published Oct. 23, 1997; WO97/39088 A published Oct. 23, 1997; WO97/39087 A1 published Oct. 23, 1997; WO97/38972 A published Oct. 23, 1997; WO 98/23566 A Shell, published Jun. 4, 1998; technical bulletins of Sasol;

and the following pending patent applications assigned to Procter & Gamble: U.S. patent application Ser. Nos. 09/170,711 and 09/170,694.

v. Ampholytic Surfactant

Ampholytic surfactants can be incorporated into the compositions hereof. These surfactants can be broadly described as aliphatic derivatives of secondary or tertiary amines, or aliphatic derivatives of heterocyclic secondary and tertiary amines in which the aliphatic radical can be straight chain or branched. One of the aliphatic substituents contains at least about 8 carbon atoms, typically from about 8 to about 18 carbon atoms, and at least one contains an anionic water-solubilizing group, e.g., carboxy, sulfonate, sulfate. See U.S. Pat. No. 3,929,678 to Laughlin et al., issued Dec. 30, 1975 at column 19, lines 18–35 for examples of ampholytic surfactants. Preferred amphoteric include $C_{12}$–$C_{18}$ alkyl ethoxylates ("AE") including the so-called narrow peaked alkyl ethoxylates and $C_6$–$C_{12}$ alkyl phenol alkoxylates (especially ethoxylates and mixed ethoxy/propoxy), $C_{12}$–$C_{18}$ betaines and sulfobetaines ("sultaines"), $C_{10}$–$C_{18}$ amine oxides, and mixtures thereof.

vi. Polyhydroxy Fatty Acid Amide Surfactant

The compositions hereof may also contain polyhydroxy fatty acid amide surfactant. The polyhydroxy fatty acid amide surfactant component comprises compounds of the structural formula:

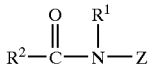

wherein:

$R^1$ is H, $C_1$–$C_4$ hydrocarbyl, 2-hydroxy ethyl, 2-hydroxy propyl, or a mixture thereof, preferably $C_1$–$C_4$ alkyl, more preferably $C_1$ or $C_2$ alkyl, most preferably $C_1$ alkyl (i.e., methyl);

and $R^2$ is a $C_5$–$C_{31}$ hydrocarbyl, preferably straight chain $C_7$–$C_{19}$ alkyl or alkenyl, more preferably straight chain $C_9$–$C_{17}$ alkyl or alkenyl, most preferably straight chain $C_{11}$–$C_{15}$ alkyl or alkenyl, or mixtures thereof, and Z is a polyhydroxyhydrocarbyl having a linear hydrocarbyl chain with at least 3 hydroxyls directly connected to the chain, or an alkoxylated derivative (preferably ethoxylated or propoxylated) thereof. Z preferably will be derived from a reducing sugar in a reductive amination reaction; more preferably Z will be a glycityl. Suitable reducing sugars include glucose, fructose, maltose, lactose, galactose, mannose, and xylose. As raw materials, high dextrose corn syrup, high fructose corn syrup, and high maltose corn syrup can be utilized as well as the individual sugars listed above. These corn syrups may yield a mix of sugar components for Z. It should be understood that it is by no means intended to exclude other suitable raw materials. Z preferably will be selected from the group consisting of —$CH_2$—$(CHOH)_n$—$CH_2OH$, —$CH(CH_2OH)$—$(CHOH)_{n-1}$—$CH_2OH$, —$CH_2$—$(CHOH)_2(CHOR')(CHOH)$—$CH_2OH$, and alkoxylated derivatives thereof, where n is an integer from 3 to 5, inclusive, and R' is H or a cyclic or aliphatic monosaccharide. Most preferred are glycityls wherein n is 4, particularly —$CH_2$—$(CHOH)_4$—$CH_2OH$.

R' can be, for example, N-methyl, N-ethyl, N-propyl, N-isopropyl, N-butyl, N-2-hydroxy ethyl, or N-2-hydroxy propyl.

$R^2$—CO—N< can be, for example, cocamide, stearamide, oleamide, lauramide, myristamide, capricamide, palmitamide, tallowamide, etc.

Z can be 1-deoxyglucityl, 2deoxyfructityl, 1-deoxymaltityl, 1-deoxylactityl, 1-deoxygalactityl, 1-deoxymannityl, 1-deoxymaltotriotityl, etc.

Methods for making polyhydroxy fatty acid amides are known in the art. In general, they can be made by reacting an alkyl amine with a reducing sugar in a reductive amination reaction to form a corresponding N-alkyl polyhydroxyamine, and then reacting the N-alkyl polyhydroxyamine with a fatty aliphatic ester or triglyceride in a condensation/amidation step to form the N-alkyl, N-polyhydroxy fatty acid amide product. Processes for malking compositions containing polyhydroxy fatty acid amides are disclosed, for example, in G.B. Patent Specification 809,060, published Feb. 18, 1959, by Thomas Hedley & Co., Ltd., U.S. Pat. No. 2,965,576, issued Dec. 20, 1960 to E. R. Wilson, and U.S. Pat. No. 2,703,798, Anthony M. Schwartz, issued Mar. 8, 1955, and U.S. Pat. No. 1,985,424, issued Dec. 25, 1934 to Piggott, each of which is incorporated herein by reference.

vii. Cationic Surfactant

Cationic detersive surfactants suitable for use in the compositions of the present invention are those having one long-chain hydrocarbyl group. Examples of such cationic surfactants include the ammonium surfactants such as alkyltrimethylammonium halogenides, and those surfactants having the formula: $[R^2(OR^3)_y][R^4(OR^3)_y]_2R^5N+X-$ wherein $R^2$ is an alkyl or alkyl benzyl group having from about 8 to about 18 carbon atoms in the alkyl chain, each $R^3$ is selected from the group consisting of —$CH_2CH_2$—, —$CH_2CH(CH_3)$—, —$CH_2CH(CH_2OH)$—, —$CH_2CH_2CH_2$—, and mixtures thereof; each $R^4$ is selected from the group consisting of $C_1$–$C_4$ alkyl, $C_1$–$C_4$ hydroxyalkyl, benzyl ring structures formed by joining the two $R^4$ groups, —$CH_2CHOH$—$CHOHCOR^6CHOHCH_2OH$ wherein $R^6$ is any hexose or hexose polymer having a molecular weight less than about 1000, and hydrogen when y is not 0; $R^5$ is the same as $R^4$ or is an alkyl chain wherein the total number of carbon atoms of $R^2$ plus $R^5$ is not more than about 18; each y is from 0 to about 10 and the sum of the y values is from 0 to about 15; and X is any compatible anion.

Highly preferred cationic surfactants are the water-soluble quaternary ammonium compounds useful in the present composition having the formula (i): $R_1R_2R_3R_4N^+X^-$ wherein $R^1$ is $C_8$–$C_{16}$ alkyl, each of $R_2$, $R_3$ and $R_4$ is independently $C_1$–$C_4$ alkyl, $C_1$–$C_4$ hydroxy alkyl, benzyl, and —$(C_2H_{40})_xH$ where x has a value from 2 to 5, and X is an anion. Not more than one of $R_2$, $R_3$ or $R_4$ should be benzyl. The preferred alkyl chain length for $R^1$ is $C_{12}$–$C_{15}$ particularly where the alkyl group is a mixture of chain lengths derived from coconut or palm kernel fat or is derived synthetically by olefin build up or OXO alcohols synthesis. Preferred groups for $R_2R_3$ and $R_4$ are methyl and hydroxyethyl groups and the anion X may be selected from halide, methosulfate, acetate and phosphate ions.

Examples of suitable quaternary ammonium compounds of formulae (i) for use herein are include, but are not limited to: coconut trimethyl ammonium chloride or bromide; coconut methyl dihydroxyethyl ammonium chloride or bromide; decyl triethyl ammonium chloride; decyl dimethyl hydroxyethyl ammonium chloride or bromide; $C_{12-15}$ dimethyl hydroxyethyl ammonium chloride or bromide; coconut dimethyl hydroxyethyl ammonium chloride or bromide; myristyl trimethyl ammonium methyl sulphate; lauryl dimethyl benzyl ammonium chloride or bromide; lauryl dimethyl $(ethenoxy)_4$ ammonium chloride or bromide; choline esters (compounds of formula (i) wherein $R_1$ is $CH_2—CH_2—O—C(=O)—C_{12-14}$alkyl and $R_2R_3R_4$ are methyl);

and di-alkyl imidazolines [(i)].

Other cationic surfactants useful herein are also described in U.S. Pat. No. 4,228,044, Cambre, issued Oct. 14, 1980 and in European Patent Application EP 000,224.

When included therein, the compositions of the present invention typically comprise from about 0.2%, preferably from about 1% to about 25%, preferably to about 8% by weight of such cationic surfactants.

viii. Zwitterionic Surfactant

Zwitterionic surfactants, examples of which are described in U.S. Pat. No. 3,929,678, are also suitable for use in the compositions of the present invention.

When included therein, the compositions of the present invention typically comprise from about 0.2%, preferably from about 1% to about 15%, preferably to about 10% by weight of such zwitterionic surfactants.

ix. Diamine Surfactant

A particularly preferred class of surfactants for use in liquid dishwashing compositions of the present invention are diamines.

Preferably, the diamine, when present, is present within the composition at a level such that the ratio of anionic surfactant present to the diamine is from about 40:1 to about 2:1. Diamines provide for increased removal of grease and greasy food material while maintaining suitable levels of suds.

The diamines suitable for use in the compositions of the present invention have the formula:

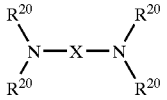

wherein each $R^{20}$ is independently selected from the group consisting of hydrogen, $C_1$–$C_4$ linear or branched alkyl, alkyleneoxy having the formula:

$$—(R^{21}O)_yR^{22}$$

wherein $R^{21}$ is $C_2$–$C_4$ linear or branched alkylene, and mixtures thereof; $R^{22}$ is hydrogen, $C_1$–$C_4$ alkyl, and mixtures thereof; y is from 1 to about 10; X is a unit selected from:

i) $C_3$–$C_{10}$ linear alkylene, $C_3$–$C_{10}$ branched alkylene, $C_3$–$C_{10}$ cyclic alkylene, $C_3$–$C_{10}$ branched cyclic alkylene, an alkyleneoxyalkylene having the formula:

$$—(R^{21}O)_yR^{21}—$$

wherein $R^{21}$ and y are the same as defined herein above;

ii) $C_3$–$C_{10}$ linear, $C_3$–$C_{10}$ branched linear, $C_3$–$C_{10}$ cyclic, $C_3$–$C_{10}$ branched cyclic alkylene, $C_6$–$C_{10}$ arylene, wherein said unit comprises one or more electron donating or electron withdrawing moieties which provide said diamine with a $pK_a$ greater than about 8; and iii) mixtures of (i) and (ii) provided said diamine has a $pK_a$ of at least about 8.

The preferred diamines of the present invention have a $pK_1$ and $pK_2$ which are each in the range of from about 8 to about 11.5, preferably in the range of from about 8.4 to about 11, more preferably from about 8.6 to about 10.75. For the purposes of the present invention the term "$pK_a$" stands equally well for the terms "pK1" and "$pK_2$" either separately or collectively. The term $pK_a$ as used herein throughout the present specification in the same manner as used by those of ordinary skill in the art. $pK_a$ values are readily obtained from standard literature sources, for example, "Critical Stability Constants: Volume 2, Amines" by Smith and Martel, Plenum Press, N.Y. and London, (1975).

As an applied definition herein, the $pK_a$ values of the diamines are specified as being measured in an aqueous solution at 25° C. having an ionic strength of from about 0.1 to about 0.5 M. As used herein, the $pK_a$ is an equilibrium constant dependent upon temperature and ionic strength, therefore, value reported by literature references, not measured in the above described manner, may not be within full agreement with the values and ranges which comprise the present invention. To eliminate ambiguity, the relevant conditions and/or references used for $pK_a$'s of this invention are as defined herein or in "Critical Stability Constants: Volume 2, Amines". One typical method of measurement is the potentiometric titration of the acid with sodium hydroxide and determination of the $pK_a$ by suitable methods as described and referenced in "The Chemist's Ready Reference Handbook" by Shugar and Dean, McGraw Hill, NY, 1990.

Preferred diamines for performance and supply considerations are 1,3-bis(methylamino)cyclohexane, 1,3-diaminopropane ($pK_1$=10.5; $pK_2$=8.8), 1,6-diaminohexane ($pK_1$=11; $pK_2$=10), 1,3-diaminopentane (Dytek EP) ($pK_1$=10.5; $pK_2$=8.9), 2-methyl 1,5-diaminopentane (Dytek A) ($pK_1$=11.2; $pK_2$=10.0). Other preferred materials are the primary/primary diamines having alkylene spacers ranging from $C_4$–$C_8$. In general, primary diamines are preferred over secondary and tertiary diamines.

The following are non-limiting examples of diamines suitable for use in the present invention.

1-N,N-dimethylamino-3-aminopropane having the formula:

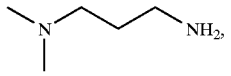

1,6-diaminohexane having the formula:

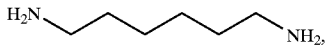

1,3-diaminopropane having the formula:

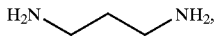

2-methyl-1,5-diaminopentane having the formula:

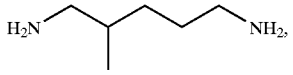

1,3-diaminopentane, available under the tradename Dytek EP, having the formula:

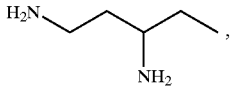

1,3-diaminobutane having the formula:

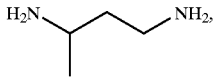

Jeffamine EDR 148, a diamine having an alkyleneoxy backbone, having the formula:

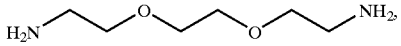

3-methyl-3-aminoethyl-5-dimethyl-1-aminocyclohexane (isophorone diamine) having the formula:

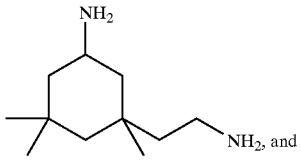

1,3-bis(methylamino)cyclohexane having the formula:

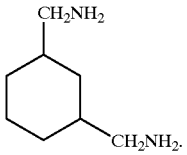

Pre-formed Peroxy Carboxylic Acid

The aqueous liquid detergent compositions of the present invention preferably comprise a pre-formed peroxycarboxylic acid (hereinafter referred to as a "peracid"). Any suitable peracid compound known in the art can be used herein.

The preformed peracid compound as used herein is any convenient compound which is stable and which under consumer use conditions provides an effective amount of peracid anion. The preformed peracid compound preferably is selected from the group consisting of percarboxylic acids and salts, percarbonic acids and salts, perimidic acids and salts, peroxymonosulfuric acids and salts, and mixtures thereof.

One class of suitable organic peroxycarboxylic acids have the general formula:

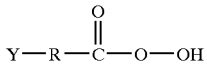

wherein R is an alkylene or substituted alkylene group containing from 1 to about 22 carbon atoms or a phenylene or substituted phenylene group, and Y is hydrogen, halogen, alkyl, aryl, —C(O)OH or —C(O)OOH.

Organic peroxyacids suitable for use in the present invention can contain either one or two peroxy groups and can be either aliphatic or aromatic. When the organic peroxycarboxylic acid is aliphatic, the unsubstituted acid has the general formula:

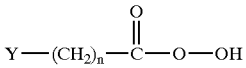

where Y can be, for example, H, $CH_3$, $CH_2Cl$, C(O)OH, or C(O)OOH; and n is an integer from 1 to 20. When the organic peroxycarboxylic acid is aromatic, the unsubstituted acid has the general formula:

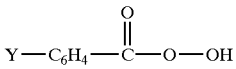

wherein Y can be, for example, hydrogen, alkyl, alkylhalogen, halogen, C(O)OH or C(O)OOH.

Typical monoperoxy acids useful herein include alkyl and aryl peroxyacids such as:

(i) peroxybenzoic acid and ring-substituted peroxybenzoic acid, e.g. peroxy-a-naphthoic acid, monoperoxyphthalic acid (magnesium salt hexahydrate), and O-carboxybenzamidoperoxyhexanoic acid (sodium salt);

(ii) aliphatic, substituted aliphatic and arylalkyl monoperoxy acids, e.g. peroxylauric acid, peroxystearic acid, N-nonanoylaminoperoxycaproic acid (NAPCA), N,N-(3-octylsuccinoyl)aminoperoxycaproic acid (SAPA) and N,N-phthaloylaminoperoxycaproic acid (PAP);

(iii) amidoperoxyacids, e.g. monononylamide of either peroxysuccinic acid (NAPSA) or of peroxyadipic acid (NAPAA).

Typical diperoxyacids useful herein include alkyl diperoxyacids and aryldiperoxyacids, such as:

(iv) 1,12-diperoxydodecanedioic acid;

(v) 1,9-diperoxyazelaic acid;

(vi) diperoxybrassylic acid; diperoxysebacic acid and diperoxyisophthalic acid;

(vii) 2-decyldiperoxybutane-1,4-dioic acid;

(viii) 4,4'-sulfonylbisperoxybenzoic acid.

Such bleaching agents are disclosed in U.S. Pat. No. 4,483,781, Hartman, issued Nov. 20, 1984, U.S. Pat. No. 4,634,551 to Burns et al., European Patent Application 0,133,354, Banks et al. published Feb. 20, 1985, and U.S. Pat. No. 4,412,934, Chung et al. issued Nov. 1, 1983. Sources also include 6-nonylamino-6-oxoperoxycaproic acid as described in U.S. Pat. No. 4,634,551, issued Jan. 6, 1987 to Burns et al. Persulfate compounds such as for example OXONE, manufactured commercially by E. I. DuPont de Nemours of Wilmington, Del. can also be employed as a suitable source of peroxymonosulfuric acid.

Particularly preferred peracid compounds are those having the formula:

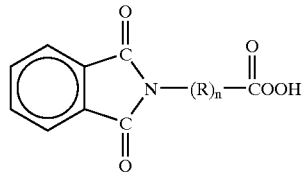

wherein R is $C_{1-4}$ alkyl and n is an integer of from 1 to 5. A particularly preferred peracid has the formula where R is $CH_2$ and n is 5 i.e., phthaloylamino peroxy caproic acid (PAP) as described in U.S. Pat. Nos. 5,487,818, 5,310,934, 5,246,620, 5,279,757 and 5,132,431. PAP is available from Ausimont SpA under the tradename Euroco.

The peracids used herein preferably have a solubility in aqueous liquid compositions measured at 20° C. of from about 10 ppm to about 1500 ppm, more preferably from about 50 ppm to about 1000 ppm, most preferably from about 50 ppm to about 800 ppm solubility is measured at 20° C.

In a particularly preferred embodiment of the present invention the peracid has mean average particle size of less than 100 microns, more preferably less than 80 microns, even more preferably less than 60 microns. Most preferably, when the peracid is PAP, it has a mean average particle size of between about 20 and about 50 microns.

The peracid is preferably present at a level of from about 0.1% to about 25%, more preferably from about 0.1% to about 20%, even more preferably from about 1% to about 10%, most preferably from about 2% to about 4%. Alternatively, the peracid may be present at a much higher level of for example 10% to 40%, more preferably from 15% to 30%, most preferably from 15% to 25%.

Suspending Agents

The composition of the present invention may preferably comprise, especially when the composition contains a solid particulate such as a peracid, a suspending agent. A suspending agent is an ingredient which is specifically added to the composition of the present invention to suspend a solid particulate ingredient of the composition.

Suitable suspending agents are those known in the art. Examples of suspending agents include gum-type polymers (e.g. xanthan gum), polyvinyl alcohol and derivatives thereof, cellulose and derivatives thereof and polycarboxylate polymers including, but not limited to,: tamarind gum (preferably consisting of xyloglucan polymers), guar gum, locust bean gum (preferably consisting of galactomannan polymers), and other industrial gums and polymers, which include, but are not limited to, Tara, Fenugreek, Aloe, Chia, Flaxseed, Psyllium seed, quince seed, xanthan, gellan, welan, rhamsan, dextran, curdlan, pullulan, scleroglucan, schizophyllan, chitin, hydroxyalkyl cellulose, arabinan (preferably from sugar beets), de-branched arabinan (preferably from sugar beets), arabinoxylan (preferably from rye and wheat flour), galactan (preferably from lupin and potatoes), pectic galactan (preferably from potatoes), galactomannan (preferably from carob, and including both low and high viscosities), glucomannan, lichenan (preferably from icelandic moss), mannan (preferably from ivory nuts), pachyman, rhamnogalacturonan, acacia gum, agar, alginates, carrageenan, chitosan, clavan, hyaluronic acid, heparin, inulin, cellodextrins, carboxymethylcellulose (CMC), dextrans, dextrins, ethylhydroxyethylcellulose (EHEC), guar, hydroxyethylcellulose (HEC), hydroxypropylcellulose (HPC), hydroxybutylcellulose. (HBC), karaya, larch, methylcellulose (MC), tamarind, scleroglucan, xanthan, carboxymethylhydroxyethylcellulose (CMHEC), methoxypropyl methyl cellulose (MPMC), hexylcarboxymethyl cellulose, $C_{12}$–$C_{20}$ alkyl carboxymethylcellulose, methylhydroxyethylcellulose (MHEC), methylhydroxypropylcellulose (MHPC), hydroxyethylmethylcellulose (HEMC), hydroxypropylmethylcellulose (HPMC), hydroxybutylmethylcellulose (HBMC) and mixtures thereof In a particularly preferred embodiment of the present invention, the suspending agent is selected from a gum-type polymer or a polycarboxylate polymer.

The gum-type polymer may be selected from the group consisting of polysaccharide hydrocolloids, xanthan gum, guar gum, succinoglucan gum, Cellulose, derivatives of any of the above and mixtures thereof. In a preferred aspect of the present invention the gum-type polymer is a xanthan gum or derivative thereof.

The gum-type polymer, when present, is preferably present at a level of from 0.01% to 10%, most preferably from 0.1% to 3%.

The polycarobxylate polymer can be a homo or copolymer of monomer units selected from acrylic acid, methacrylic acid, maleic acid, malic acid, maleic anhydride. Preferred polycarboxylate polymers are Carbopol from BF Goodrich. Suitable polymers have molecular weight in the range of from 10,000 to 100,000,000 most preferably 1,000,000 to 10,000,000.

The cross-linked polycarboxylate polymer, when present, is preferably present at a level of from 0.01% to 2% more preferably from 0.01% to 1%, most preferably from 0.1% to 0.8%.

In an alternative embodiment the suspending agent comprises a combination of at least two polymers. In this embodiment the first polymer is a gum-type polymer and the second is a cross-linked polycarboxylate polymer. The composition may additionally comprise further polymers.

The ratio of gum-type polymer to cross-linked polycarboxylate polymer is from 100:1 to 1:100, most preferably from 1:10 to 10:1.

Optional Cleaning Adjunct Materials

The aqueous liquid detergent compositions of the present invention as described hereinbefore may optionally include, in addition to the effervescent system and preferably one or more of the preferred cleaning adjunct materials discussed above, one or more optional cleaning adjunct materials described below.

Bleaching System

The aqueous liquid detergent compositions of the present invention may comprise a bleaching system, in addition to the preformed peracid compound described hereinabove. Bleaching systems typically comprise a "bleaching agent" (source of hydrogen peroxide) and an "initiator" or "catalyst". When present, bleaching agents will typically be at levels of from about 1%, preferably from about 5% to about 30%, preferably to about 20% by weight of the composition. If present, the amount of bleach activator will typically be from about 0.1%, preferably from about 0.5% to about 60%, preferably to about 40% by weight, of the bleaching composition comprising the bleaching agent-plus-bleach activator.

Bleaching Agents

Hydrogen peroxide sources are described in detail in the herein incorporated Kirk Othmer's Encyclopedia of Chemical Technology, 4th Ed (1992, John Wiley & Sons), Vol. 4, pp. 271–300 "Bleaching Agents (Survey)", and include the various forms of sodium perborate and sodium percarbonate, including various coated and modified forms.

The preferred source of hydrogen peroxide used herein can be any convenient source, including hydrogen peroxide itself. For example, perborate, e.g., sodium perborate (any hydrate but preferably the mono- or tetra-hydrate), sodium carbonate peroxyhydrate or equivalent percarbonate salts, sodium pyrophosphate peroxyhydrate, urea peroxyhydrate, or sodium peroxide can be used herein. Also useful are sources of available oxygen such as persulfate bleach (e.g., OXONE, manufactured by DuPont). Sodium perborate monohydrate and sodium percarbonate are particularly preferred. Mixtures of any convenient hydrogen peroxide sources can also be used.

A preferred percarbonate bleach comprises dry particles having an average particle size in the range from about 500 micrometers to about 1,000 micrometers, not more than about 10% by weight of said particles being smaller than about 200 micrometers and not more than about 10% by weight of said particles being larger than about 1,250 micrometers. Optionally, the percarbonate can be coated with a silicate, borate or water-soluble surfactants. Percarbonate is available from various commercial sources such as FMC, Solvay and Tokai Denka.

Compositions of the present invention may also comprise as the bleaching agent a chlorine-type bleaching material. Such agents are well known in the art, and include for example sodium dichloroisocyanurate ("NaDCC"). However, chlorine-type bleaches are less preferred for compositions which comprise enzymes.

(a) Bleach Activators

Preferably, the peroxygen bleach component in the composition is formulated with an activator (peracid precursor). The activator is present at levels of from about 0.01%, preferably from about 0.5%, more preferably from about 1% to about 15%, preferably to about 10%, more preferably to about 8%, by weight of the composition. Preferred activators are selected from the group consisting of tetraacetyl ethylene diamine (TAED), benzoylcaprolactam (BzCL), 4-nitrobenzoylcaprolactam, 3-chlorobenzoylcaprolactam, benzoyloxybenzenesulphonate (BOBS), nonanoyloxybenzenesulphonate (NOBS), phenyl benzoate (PhBz), decanoyloxybenzenesulphonate ($C_{10}$-OBS), benzoylvalerolactam (BZVL), octanoyloxybenzenesulphonate ($C_8$-OBS), perhydrolyzable esters and mixtures thereof, most preferably benzoylcaprolactam and benzoylvalerolactam. Particularly preferred bleach activators in the pH range from about 8 to about 9.5 are those selected having an OBS or VL leaving group.

Preferred hydrophobic bleach activators include, but are not limited to, nonanoyloxybenzenesulphonate (NOBS), 4-[N-(nonaoyl)amino hexanoyloxy]-benzene sulfonate sodium salt (NACA-OBS) an example of which is described in U.S. Pat. No. 5,523,434, dodecanoyloxybenzenesulphonate (LOBS or $C_{12}$-OBS), 10-undecenoyloxybenzenesulfonate (UDOBS or $C_{11}$-OBS with unsaturation in the 10 position), and decanoyloxybenzoic acid (DOBA).

Preferred bleach activators are those described in U.S. Pat. No. 5,698,504 Christie et al., issued Dec. 16, 1997; U.S. Pat. No. 5,695,679 Christie et al. issued Dec. 9, 1997; U.S. Pat. No. 5,686,401 Willey et al., issued Nov. 11, 1997; U.S. Pat. No. 5,686,014 Hartshorn et al., issued Nov. 11, 1997; U.S. Pat. No. 5,405,412 Willey et al., issued Apr. 11, 1995; U.S. Pat. No. 5,405,413 Willey et al., issued Apr. 11, 1995; U.S. Pat. No. 5,130,045 Mitchel et al., issued Jul. 14, 1992; and U.S. Pat. No. 4,412,934 Chung et al., issued Nov. 1, 1983, and copending patent applications U.S. Ser. Nos. 08/709,072, 08/064,564, all of which are incorporated herein by reference.

The mole ratio of peroxygen bleaching compound (as AvO) to bleach activator in the present invention generally ranges from at least 1:1, preferably from about 20:1, more preferably from about 10:1 to about 1:1, preferably to about 3:1.

Quaternary substituted bleach activators may also be included. The present laundry compositions preferably comprise a quaternary substituted bleach activator (QSBA) or a quaternary substituted peracid (QSP); more preferably, the former. Preferred QSBA structures are further described in U.S. Pat. No. 5,686,015 Willey et al., issued Nov. 11, 1997; U.S. Pat. No. 5,654,421 Taylor et al., issued Aug. 5, 1997; U.S. Pat. No. 5,460,747 Gosselink et al., issued Oct. 24, 1995; U.S. Pat. No. 5,584,888 Miracle et al., issued Dec. 17, 1996; and U.S. Pat. No. 5,578,136 Taylor et al., issued Nov. 26, 1996; all of which are incorporated herein by reference.

Highly preferred bleach activators useful herein are amide-substituted as described in U.S. Pat. Nos. 5,698,504, 5,695,679, and 5,686,014 each of which are cited herein above. Preferred examples of such bleach activators include: (6-octanamidocaproyl)oxybenzenesulfonate,(6-nonanamidocaproyl)oxybenzenesulfonate, (6-decanamidocaproyl)oxybenzenesulfonate and mixtures thereof.

Other useful activators, disclosed in U.S. Pat. Nos. 5,698,504, 5,695,679, 5,686,014 each of which is cited herein above and U.S. Pat. No. 4,966,723 Hodge et al., issued Oct. 30, 1990, include benzoxazin-type activators, such as a $C_6H_4$ ring to which is fused in the 1,2-positions a moiety —C(O)OC($R^1$)═N—.

Depending on the activator and precise application, good bleaching results can be obtained from bleaching systems having with in-use pH of from about 6 to about 13, preferably from about 9.0 to about 10.5. Typically, for example, activators with electron-withdrawing moieties are used for near-neutral or sub-neutral pH ranges. Alkalis and buffering agents can be used to secure such pH.

Acyl lactam activators, as described in U.S. Pat. Nos. 5,698,504, 5,695,679 and 5,686,014, each of which is cited herein above, are very useful herein, especially the acyl caprolactams (see for example WO 94-28102 A) and acyl valerolactams (see U.S. Pat. No. 5,503,639 Willey et al., issued Apr. 2, 1996 incorporated herein by reference).

(b) Organic Peroxides, especially Diacyl Peroxides

These are extensively illustrated in Kirk Othmer, Encyclopedia of Chemical Technology, Vol. 17, John Wiley and Sons, 1982 at pages 27–90 and especially at pages 63–72, all incorporated herein by reference. If a diacyl peroxide is used, it will preferably be one which exerts minimal adverse impact on spotting/filming.

(c) Metal-containing Bleach Catalysts

The present invention compositions and methods may utilize metal-containing bleach catalysts that are effective for use in bleaching compositions. Preferred are manganese and cobalt-containing bleach catalysts.

One type of metal-containing bleach catalyst is a catalyst system comprising a transition metal cation of defined bleach catalytic activity, such as copper, iron, titanium, ruthenium tungsten, molybdenum, or manganese cations, an auxiliary metal cation having little or no bleach catalytic activity, such as zinc or aluminum cations, and a sequestrate having defined stability constants for the catalytic and auxiliary metal cations, particularly ethylenediamninetetraacetic acid, ethylenediaminetetra (methylenephosphonic acid) and water-soluble salts thereof. Such catalysts are disclosed in U.S. Pat. No. 4,430,243 Bragg, issued Feb. 2, 1982.

Manganese Metal Complexes

If desired, the compositions herein can be catalyzed by means of a manganese compound. Such compounds and levels of use are well known in the art and include, for example, the manganese-based catalysts disclosed in U.S. Pat. Nos. 5,576,282; 5,246,621; 5,244,594; 5,194,416; and 5,114,606; and European Patent App. Pub. Nos. 549,271 A1, 549,272 A1, 544,440 A2, and 544,490 A1; Preferred examples of these catalysts include $Mn^{IV}_2$(u-O)$_3$(1,4,7-trimethyl-1,4,7-triazacyclononane)$_2$($PF_6$)$_2$, $Mn^{III}_2$(u-O)$_1$(u-OAc)$_2$(1,4,7-trimethyl-1,4,7-triazacyclononane)$_2$($ClO_4$)$_2$, $Mn^{IV}_4$(u-O)$_6$(1,4,7-triazacyclononane)$_4$($ClO_4$)$_4$, $Mn^{III}Mn^{IV}_4$(u-O)$_1$(u-OAc)$_{2-}$(1,4,7-trimethyl-1,4,7-triazacyclononane)$_2$($ClO_4$)$_3$, $Mn^{IV}$(1,4,7-trimethyl-1,4,7-triazacyclononane)-($OCH_3$)$_3$($PF_6$), and mixtures thereof. Other metal-based bleach catalysts include those disclosed in U.S. Pat. Nos. 4,430,243 and 5,114,611. The use of manganese with various complex ligands to enhance bleaching is also reported in the following: U.S. Pat. Nos. 4,728,455; 5,284,944; 5,246,612; 5,256,779; 5,280,117; 5,274,147; 5,153,161; and 5,227,084.

Cobalt Metal Complexes

Cobalt bleach catalysts useful herein are known, and are described, for example, in U.S. Pat. Nos. 5,597,936; 5,595,967; and 5,703,030; and M. L. Tobe, "Base Hydrolysis of Transition-Metal Complexes", *Adv. Inorg. Bioinorg. Mech.*, (1983), 2, pages 1–94. The most preferred cobalt catalyst useful herein are cobalt pentaamine acetate salts having the formula $[Co(NH_3)_5OAc]T_y$, wherein "OAc" represents an acetate moiety and "$T_y$" is an anion, and especially cobalt pentaamine acetate chloride, $[Co(NH_3)_5OAc]Cl_2$; as well as $[Co(NH_3)_5OAc](OAC)_2$; $[Co(NH_3)_5OAc](PF_6)_2$; $[Co(NH_3)_5OAc](SO_4)$; $[Co\text{-}(NH_3)_5OAc](BF_4)_2$; and $[Co(NH_3)_5OAc](NO_3)_2$ (herein "PAC").

These cobalt catalysts are readily prepared by known procedures, such as taught for example in U.S. Pat. Nos. 5,597,936; 5,595,967; and 5,703,030; in the Tobe article and the references cited therein; and in U.S. Pat. No. 4,810,410; *J. Chem. Ed.* (1989), 66 (12), 1043–45; The Synthesis and Characterization of Inorganic Compounds, W. L. Jolly (Prentice-Hall; 1970), pp. 461–3; *Inorg. Chem.,* 18, 1497–1502 (1979); *Inorg. Chem.,* 21, 2881–2885 (1982); *Inorg. Chem.,* 18, 2023–2025 (1979); Inorg. Synthesis, 173–176 (1960); and *Journal of Physical Chemistry,* 56, 22–25 (1952).

Transition Metal Complexes of Macropolycyclic Rigid Ligands

Compositions herein may also suitably include as bleach catalyst a transition metal complex of a macropolycyclic rigid ligand. The phrase "macropolycyclic rigid ligand" is sometimes abbreviated as "MRL" in discussion below. The amount used is a catalytically effective amount, suitably about 1 ppb or more, for example up to about 99.9%, more typically about 0.001 ppm or more, preferably from about 0.05 ppm to about 500 ppm (wherein "ppb" denotes parts per billion by weight and "ppm" denotes parts per million by weight).

Suitable transition metals e.g., Mn are illustrated hereinafter. "Macropolycyclic" means a MRL is both a macrocycle and is polycyclic. "Polycyclic" means at least bicyclic. The term "rigid" as used herein includes "having a superstructure" and "cross-bridged". "Rigid" has been defined as the constrained converse of flexibility: see D. H. Busch., *Chemical Reviews*, (1993), 93, 847–860, incorporated by reference. More particularly, "rigid" as used herein means that the MRL must be determinably more rigid than a macrocycle ("parent macrocycle") which is otherwise identical (having the same ring size and type and number of atoms in the main ring) but lacking a superstructure (especially linking moieties or, preferably cross-bridging moieties) found in the MRL's. In determining the comparative rigidity of macrocycles with and without superstructures, the practitioner will use the free form (not the metal-bound form) of the macrocycles. Rigidity is well-known to be useful in comparing macrocycles; suitable tools for determining, measuring or comparing rigidity include computational methods (see, for example, Zimmer, *Chemical Reviews*, (1995), 95(38), 2629–2648 or Hancock et al., *Inorganica Chimica Acta*, (1989), 164, 73–84.

Preferred MRL's herein are a special type of ultra-rigid ligand which is cross-bridged. A "cross-bridge" is nonlimitingly illustrated in 1.11 hereinbelow. In 1.11, the cross-bridge is a —$CH_2CH_2$— moiety. It bridges $N^1$ and $N^8$ in the illustrative structure. By comparison, a "same-side" bridge, for example if one were to be introduced across $N^1$ and $N^{12}$ in 1.11, would not be sufficient to constitute a "cross-bridge" and accordingly would not be preferred.

Suitable metals in the rigid ligand complexes include Mn(II), Mn(III), Mn(IV), Mn(V), Fe(II), Fe(III), Fe(IV), Co(I), Co(II), Co(III), Ni(I), Ni(II), Ni(III), Cu(I), Cu(II), Cu(III), Cr(II), Cr(III), Cr(IV), Cr(V), Cr(VI), V(III), V(IV), V(V), Mo(IV), Mo(V), Mo(VI), W(IV), W(V), W(VI), Pd(II), Ru(II), Ru(III), and Ru(IV). Preferred transition-metals in the instant transition-metal bleach catalyst include manganese, iron and chromium.

More generally, the MRL's (and the corresponding transition-metal catalysts) herein suitably comprise:

(a) at least one macrocycle main ring comprising four or more heteroatoms; and (b) a covalently connected non-metal superstructure capable of increasing the rigidity of the macrocycle, preferably selected from (i) a bridging superstructure, such as a linking moiety;

(ii) a cross-bridging superstructure, such as a cross-bridging linking moiety; and (iii) combinations thereof.

The term "superstructure" is used herein as defined in the literature by Busch et al., see, for example, articles by Busch in "Chemical Reviews".

Preferred superstructures herein not only enhance the rigidity of the parent macrocycle, but also favor folding of the macrocycle so that it co-ordinates to a metal in a cleft. Suitable superstructures can be remarkably simple, for example a linking moiety such as any of those illustrated in FIG. 1 and FIG. 2 below, can be used.

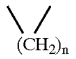

wherein n is an integer, for example from 2 to 8, preferably less than 6, typically 2 to 4, or

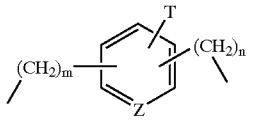

wherein m and n are integers from about 1 to 8, more preferably from 1 to 3; Z is N or CH; and T is a compatible substituent, for example H, alkyl, trialkylammonium, halogen, nitro, sulfonate, or the like. The aromatic ring in 1.10 can be replaced by a saturated ring, in which the atom in Z connecting into the ring can contain N, O, S or C.

Suitable MRL's are further nonlimitingly illustrated by the following compound:

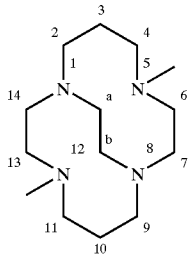

This is a MRL in accordance with the invention which is a highly preferred, cross-bridged, methyl-substituted (all nitrogen atoms tertiary) derivative of cyclam. Formally, this ligand is named 5,12-dimethyl-1,5,8,12-tetraazabicyclo [6.6.2]hexadecane using the extended von Baeyer system. See "A Guide to IUPAC Nomenclature of Organic Compounds: Recommendations 1993", R. Panico, W. H. Powell and J-C Richer (Eds.), Blackwell Scientific Publications, Boston, 1993; see especially section R-2.4.2.1.

Transition-metal bleach catalysts of Macrocyclic Rigid Ligands which are suitable for use in the invention compositions can in general include known compounds where they conform with the definition herein, as well as, more preferably, any of a large number of novel compounds expressly designed for the present laundry or laundry uses, and non-limitingly illustrated by any of the following:

Dichloro-5,12-dimethyl-1,5,8,12-tetraazabicyclo[6.6.2] hexadecane Manganese(II)
Diaquo-5,12-dimethyl-1,5,8,12-tetraazabicyclo[6.6.2] hexadecaneManganese(II) Hexafluorophosphate
Aquo-hydroxy-5,12-dimethyl-1,5,8,12-tetraazabicyclo [6.6.2]hexadecane Manganese(III) Hexafluorophosphate
Diaquo-5,12-dimethyl-1,5,8,12-tetraazabicyclo[6.6.2] hexadecaneManganese(II) Tetrafluoroborate
Dichloro-5,12-dimethyl-1,5,8,12-tetraazabicyclo[6.6.2] hexadecaneManganese(III) Hexafluorophosphate
Dichloro-5,12-di-n-butyl-1,5,8,12-tetraaza bicyclo[6.6.2] hexadecaneManganese(II)
Dichloro-5,12dibenzyl-1,5,8,12-tetraazabicyclo[6.6.2] hexadecaneManganese(II)
Dichloro-5-n-butyl-12-methyl-1,5,8,12-tetraaza-bicyclo [6.6.2]hexadecane Manganese(II)
Dichloro-5-n-octyl-12-methyl-1,5,8,12-tetraaza-bicyclo [6.6.2]hexadecane Manganese(II)
Dichloro-5-n-butyl-12-methyl-1,5,8,12-tetraaza-bicyclo [6.6.2]hexadecane Manganese(II).

As a practical matter, and not by way of limitation, the compositions and laundry processes herein can be adjusted to provide on the order of at least one part per hundred million of the active bleach catalyst species in the aqueous washing medium, and will preferably provide from about 0.01 ppm to about 25 ppm, more preferably from about 0.05 ppm to about 10 ppm, and most preferably from about 0.1 ppm to about 5 ppm, of the bleach catalyst species in the wash liquor. In order to obtain such levels in the wash liquor of an automatic washing process, typical compositions herein will comprise from about 0.0005% to about 0.2%, more preferably from about 0.004% to about 0.08%, of bleach catalyst, especially manganese or cobalt catalysts, by weight of the bleaching compositions.

(d) Other Bleach Catalysts

The compositions herein may comprise one or more other bleach catalysts. Preferred bleach catalysts are zwitterionic bleach catalysts, which are described in U.S. Pat. No. 5,576,282 (especially 3-(3,4-dihydroisoquinolinium) propane sulfonate) and U.S. Pat. No. 5,817,614. Other bleach catalysts include cationic bleach catalysts are described in U.S. Pat. Nos. 5,360,569, 5,442,066, 5,478,357, 5,370,826, 5,482,515, 5,550,256, and WO 95/13351, WO 95/13352, and WO 95/13353.

Enzymes

Detergent compositions of the present invention may further comprise one or more enzymes which provide cleaning performance benefits. Said enzymes include enzymes selected from cellulases, hemicellulases, peroxidases, proteases, gluco-amylases, amylases, lipases, cutinases, pectinases, xylanases, reductases, oxidases, phenoloxidases, lipoxygenases, ligninases, pullulanases, tannases, pentosanases, malanases, β-glucanases, arabinosidases, mannanases, xyloglucanases or mixtures thereof. A preferred combination is a detergent composition having a cocktail of conventional applicable enzymes like protease, amylase, lipase, cutinase, mannanases, xyloglucatiases and/or cellulase. Enzymes when present in the compositions, at from about 0.0001% to about 5% of active enzyme by weight of the detergent composition.

Proteases for use in the detergent compositions herein include (but are not limited to) trypsin, subtilisin, chymotrypsin and elastase-type proteases. Preferred for use herein are subtilisin-type proteolytic enzymes. Particularly preferred is bacterial serine proteolytic enzyme obtained from *Bacillus subtilis* and/or *Bacillus licheniformis*.

Suitable proteolytic enzymes include Novo Industri A/S Alcalase® (preferred), Esperase®, Savinase® (Copenhagen, Denmark), Gist-brocades' Maxatase®, Maxacal® and Maxapem 15® (protein engineered Maxacal®) (Delft, Netherlands), and subtilisin BPN and BPN' (preferred), which are commercially available. Preferred proteolytic enzymes are also modified bacterial serine proteases, such as those made by Genencor International, Inc. (San Francisco, Calif.) which are described in European Patent 251,446B, granted Dec. 28, 1994 (particularly pages 17, 24 and 98) and which are also called herein "Protease B". U.S. Pat. No. 5,030,378, Venegas, issued Jul. 9, 1991, refers to a modified bacterial serine proteolytic enzyme (Genencor International) which is called "Protease A" herein (same as BPN'). In particular see columns 2 and 3 of U.S. Pat. No. 5,030,378 for a complete description, including amino sequence, of Protease A and its variants. Other proteases are sold under the tradenames: Primase, Durazym, Opticlean and Optimase. Preferred proteolytic enzymes, then, are selected from the group consisting of Alcalase® (Novo Industri A/S), BPN', Protease A and Protease B (Genencor), and mixtures thereof. Protease B is most preferred.

Of particular interest for use herein are the proteases described in U.S. Pat. No. 5,470,733.

Also proteases described in our co-pending application U.S. Ser. No. 08/136,797 can be included in the detergent composition of the invention.

Another preferred protease, referred to as "Protease D" is a carbonyl hydrolase variant having an amino acid sequence not found in nature, which is derived from a precursor carbonyl hydrolase by substituting a different amino acid for a plurality of amino acid residues at a position in said carbonyl hydrolase equivalent to position +76, preferably also in combination with one or more amino acid residue positions equivalent to those selected from the group consisting of +99, +101, +103, +104, +107, +123, +27, +105, +109, +126, +128, +135, +156, +166, +195, +197, +204, +206, +210, +216, +217, +218, +222, +260, +265, and/or +274 according to the numbering of *Bacillus amyloliquefaciens* subtilisin, as described in WO 95/10615 published Apr. 20, 1995 by Genencor International (A. Baeck et al. entitled "Protease-Containing Cleaning Compositions" having U.S. Ser. No. 08/322,676, filed Oct. 13, 1994).

Useful proteases are also described in PCT publications: WO 95/30010 published Nov. 9, 1995 by The Procter & Gamble Company; WO 95/30011 published Nov. 9, 1995 by The Procter & Gamble Company; WO 95/29979 published Nov. 9, 1995 by The Procter & Gamble Company.

Other particularly useful proteases are multiply-substituted protease variants comprising a substitution of an amino acid residue with another naturally occurring amino acid residue at an amino acid residue position corresponding to position 103 of *Bacillus amyloliquefaciens* subtilisin in combination with a substitution of an amino acid residue with another naturally occurring amino acid residue at one or more amino acid residue positions corresponding to positions 1, 3, 4, 8, 9, 10, 12, 13, 16, 17, 18, 19, 20, 21, 22, 24, 27, 33, 37, 38, 42, 43, 48, 55, 57, 58, 61, 62, 68, 72, 75, 76, 77, 78, 79, 86, 87, 89, 97, 98, 99, 101, 102, 104, 106, 107, 109, 111, 114, 116, 117, 119, 121, 123, 126, 128, 130, 131, 133, 134, 137, 140, 141, 142, 146, 147, 158, 159, 160, 166, 167, 170, 173, 174, 177, 181, 182, 183, 184, 185, 188, 192, 194, 198, 203, 204, 205, 206, 209, 210, 211, 212, 213, 214, 215, 216, 217, 218, 222, 224, 227, 228, 230, 232, 236, 237, 238, 240, 242, 243, 244, 245, 246, 247, 248, 249, 251, 252, 253, 254, 255, 256, 257, 258, 259, 260, 261, 262, 263, 265, 268, 269, 270, 271, 272, 274 and 275 of *Bacillus amyloliquefaciens* subtilisin; wherein when said protease variant includes a substitution of amino acid residues at positions corresponding to positions 103 and 76, there is also a substitution of an amino acid residue at one or more amino acid residue positions other than amino acid residue positions corresponding to positions 27, 99, 101, 104, 107, 109, 123, 128, 166, 204, 206, 210, 216, 217, 218, 222, 260, 265 or 274 of *Bacillus amyloliquefaciens* subtilisin and/or multiply-substituted protease variants comprising a substitution of an amino acid residue with another naturally occurring amino acid residue at one or more amino acid residue positions corresponding to positions 62, 212, 230, 232, 252 and 257 of *Bacillus amyloliquefaciens* subtilisin as described in PCT Published Application Nos. WO 99/20727, WO 99/20726, and WO 99/20723 all owned by The Procter & Gamble Company.

Also suitable for the present invention are proteases described in patent applications EP 251 446 and WO 91/06637, protease BLAP® described in WO91/02792 and their variants described in WO 95/23221.

See also a high pH protease from Bacillus sp. NCIMB 40338 described in WO 93/18140 A to Novo. Enzymatic detergents comprising protease, one or more other enzymes, and a reversible protease inhibitor are described in WO 92/03529 A to Novo. When desired, a protease having decreased adsorption and increased hydrolysis is available as described in WO 95/07791 to Procter & Gamble. A recombinant trypsin-like protease for detergents suitable herein is described in WO 94/25583 to Novo. Other suitable proteases are described in EP 516 200 by Unilever.

Commercially available proteases useful in the present invention are known as ESPERASE®, ALCALASE®, DURAZYM®, SAVINASE®, EVERLASE® and KANNASE® all from Novo Nordisk A/S of Denmark, and as MAXATASE®, MAXACAL®, PROPERASE® and MAXAPEM® all from Genencor International (formerly Gist-Brocades of The Netherlands).

Protease enzymes may be incorporated into the compositions in accordance with the present invention at a level of from about 0.0001% to about 2% active enzyme by weight of the composition.

Bleach/amylase/protease combinations (EP 755,999 A; EP 756,001 A; EP 756,000 A) are also useful.

Also in relation to enzymes herein, enzymes and their directly linked inhibitors, e.g., protease and its inhibitor linked by a peptide chain as described in WO 98/13483 A, are useful in conjunction with the present hybrid builders. Enzymes and their non-linked inhibitors used in selected combinations herein include protease with protease inhibitors selected from proteins, peptides and peptide derivatives as described in WO 98/13461 A, WO 98/13460 A, WO 98/13458 A, WO 98/13387 A.

Amylases can be used with amylase antibodies as taught in WO 98/07818 A and WO 98/07822 A, lipases can be used in conjunction with lipase antibodies as taught in WO 98/07817 A and WO 98/06810 A, proteases can be used in conjunction with protease antibodies as taught in WO 98/07819 A and WO 98/06811 A, Cellulase can be combined with cellulase antibodies as taught in WO 98/07823 A and WO 98/07821 A. More generally, enzymes can be combined with similar or dissimilar enzyme directed antibodies, for example as taught in WO 98/07820 A or WO 98/06812 A.

The preferred enzymes herein can be of any suitable origin, such as vegetable, animal, bacterial, fungal and yeast origin.

Preferred selections are influenced by factors such as pH-activity and/or stability optima, thermostability, and stability to active detergents, builders and the like. In this respect bacterial or fungal enzymes are preferred, such as bacterial amylases and proteases, and fungal cellulases.

Amylases (α and/or β) can be included for removal of carbohydrate-based stains. WO94/02597 describes laundry compositions which incorporate mutant amylases. See also WO95/10603. Other amylases known for use in laundry compositions include both α- and β-amylases. α-Amylases are known in the art and include those disclosed in U.S. Pat. No. 5,003,257; EP 252,666; WO/91/00353; FR 2,676,456; EP 285,123; EP 525,610; EP 368,341; and British Patent specification no. 1,296,839 (Novo). Other suitable amylases are stability-enhanced amylases described in WO94/18314 and WO96/05295, Genencor, and amylase variants having additional modification in the immediate parent available from Novo Nordisk A/S, disclosed in WO 95/10603. Also suitable are amylases described in EP 277 216.

Examples of commercial α-amylases products are Purafect Ox Am® from Genencor and Termamyl®, Ban®, Fungamyl® and Duramyl®, all available from Novo Nordisk A/S Denmark. WO95/26397 describes other suitable amylases: α-amylases characterised by having a specific activity at least 25% higher than the specific activity of Termamyl® at a temperature range of 25° C. to 55° C. and at a pH value in the range of 8 to 10, measured by the Phadebas® α-amylase activity assay. Suitable are variants of the above enzymes, described in WO96/23873 (Novo Nordisk). Other amylolytic enzymes with improved properties with respect to the activity level and the combination of thermostability and a higher activity level are described in WO95/35382.

The compositions of the present invention may also comprise a mannanase enzyme. Preferably, the mannanase is selected from the group consisting of: three mannans-degrading enzymes: EC 3.2.1.25:β-mannosidase, EC 3.2.1.78: Endo-1,4-β-mannosidase, referred therein after as "mannanase" and EC 3.2.1.100: 1,4β-manrobiosidase and mixtures thereof. (IUPAC Classification-Enzyme nomenclature, 1992 ISBN 0-12-227165-3 Academic Press).

More preferably, the compositions of the present invention, when a mannanase is present, comprise a β-1,4-Mannosidase (E.C. 3.2.1.78) referred to as Mannanase. The term "mannanase" or "galactomannanase" denotes a mannanase enzyme defined according to the art as officially being named mannan endo-1,4-beta-mannosidase and having the alternative names beta-mannanase and endo-1,4-mannanase and catalysing the reaction: random hydrolysis of 1,4-beta-D-mannosidic linkages in mannans, galactomannans, glucomannans, and galactoglucomannans.

In particular, Mannanases (EC 3.2.1.78) constitute a group of polysaccharases which degrade mannans and denote enzymes which are capable of cleaving polyose chains containing mannose units, i.e. are capable of cleaving glycosidic bonds in mannans, glucomannans, galactomannans and galactogluco-mannans. Mannans are polysaccharides having a backbone composed of β-1,4-linked mannose; glucomannans are polysaccharides having a backbone or more or less regularly alternating β-1,4 linked mannose and glucose; galactomannans and galactoglucomannans are mannans and glucomannans with α-1,6 linked galactose sidebranches. These compounds may be acetylated.

The degradation of galactomannans and galactogluco-mannans is facilitated by full or partial removal of the galactose sidebranches. Further the degradation of the acetylated mannans, glucomannans, galactomannans and galactogluco-mannans is facilitated by full or partial deacetylation. Acetyl groups can be removed by alkali or by mannan acetylesterases. The oligomers which are released from the mannanases or by a combination of mannanases and α-galactosidase and/or mannan acetyl esterases can be further degraded to release free maltose by β-mannosidase and/or β-glucosidase.

Mannanases have been identified in several Bacillus organisms. For example, Talbot et al., Appl. Environ. Microbiol., Vol.56, No. 11, pp. 3505–3510 (1990) describes a beta-mannanase derived from *Bacillus stearothermophilus* in dimer form having molecular weight of 162 kDa and an optimum pH of 5.5–7.5. Mendoza et al., World J. Microbiol. Biotech., Vol. 10, No. 5, pp. 551–555 (1994) describes a beta-mannanase derived from *Bacillus subtilis* having a molecular weight of 38 kDa, an optimum activity at pH 5.0 and 55C and a pI of 4.8. JP-03047076 discloses a beta-mannanase derived from Bacillus sp., having a molecular weight of 373 kDa measured by gel filtration, an optimum pH of 8–10 and a pI of 5.3–5.4. JP-63056289 describes the production of an alkaline, thermostable beta-mannanase which hydrolyses beta-1,4-D-mannopyranoside bonds of e.g. mannans and produces manno-oligosaccharides. JP-63036774 relates to the Bacillus microorganism FERM P-8856 which produces beta-mannanase and beta-mannosidase at an alkaline pH. JP-08051975 discloses alkaline beta-mannanases from alkalophilic Bacillus sp. AM-001. A purified mannanase from *Bacillus amyloliquefaciens* useful in the bleaching of pulp and paper and a method of preparation thereof is disclosed in WO 97/11164. WO 91/18974 describes a hemicellulase such as a glucanase, xylanase or mannanase active at an extreme pH and temperature. WO 94/25576 discloses an enzyme from *Aspergillus aculeatus*, CBS 101.43, exhibiting mannanase activity which may be useful for degradation or modification of plant or algae cell wall material. WO 93/24622 discloses a mannanase isolated from *Trichoderma reseei* useful for bleaching lignocellulosic pulps. An hemicellulase capable of degrading mannan-containing hemicellulose is described in WO91/18974 and a purified mannanase from *Bacillus amyloliquefaciens* is described in WO97/11164.

Preferably, the mannanase enzyme will be an alkaline mannanase as defined below, more preferably, a mannanase originating from a bacterial source. Especially, the laundry detergent composition of the present invention will comprise an alkaline mannanase selected from the mannanase from the strain *Bacillus agaradhaerens* NICMB 40482; the mannanase from *Bacillus subtilis* strain 168, gene yght; the mannanase from Bacillus sp. I633 and/or the mannanase from Bacillus sp. AAI12. Most preferred mannanase for the inclusion in the detergent compositions of the present invention is the mannanase enzyme originating from Bacillus sp. I633 as described in the co-pending Danish patent application No. PA 1998 01340.

The terms "alkaline mannnanase enzyme" is meant to encompass an enzyme having an enzymatic activity of at least 10%, preferably at least 25%, more preferably at least 40% of its maximum activity at a given pH ranging from 7 to 12, preferably 7.5 to 10.5.

The alkaline mannanase from *Bacillus agaradhaerens* NICMB 40482 is described in the co-pending U.S. patent application Ser. No. 09/111,256. More specifically, this mannanase is:

i) a polypeptide produced by *Bacillus agaradhaerens*, NCIMB 40482; or ii) a polypeptide comprising an amino acid sequence as shown in positions 32–343 of SEQ ID NO:2 as shown in U.S. patent application Ser. No. 09/111,256; or iii) an analogue of the polypeptide defined in i) or ii) which is at least 70% homologous with said polypeptide, or is derived from said polypeptide by substitution, deletion or addition of one or several amino acids, or is immunologically reactive with a polyclonal antibody raised against said polypeptide in purified form.

Also encompassed is the corresponding isolated polypeptide having mannanase activity selected from the group consisting of:

(a) polynucleotide molecules encoding a polypeptide having mannanase activity and comprising a sequence of nucleotides as shown in SEQ ID NO: 1 from nucleotide 97 to nucleotide 1029 as shown in U.S. patent application Ser. No. 09/111,256;

(b) species homologs of (a);

(c) polynucleotide molecules that encode a polypeptide having mannanase activity that is at least 70% identical to the amino acid sequence of SEQ ID NO: 2 from amino acid residue 32 to amino acid residue 343 as shown in U.S. patent application Ser. No. 09/111,256;

(d) molecules complementary to (a), (b) or (c); and (e) degenerate nucleotide sequences of (a), (b), (c) or (d).

The plasmid pSJ1678 comprising the polynucleotide molecule (the DNA sequence) encoding said mannanase has been transformed into a strain of the *Escherichia coli* which was deposited by the inventors according to the Budapest Treaty on the International Recognition of the Deposit of Microorganisms for the Purposes of Patent Procedure at the Deutsche Sammlung von Mikroorganismen und Zellkulturen GmbH, Mascheroder Weg 1b, D-38124 Braunschweig, Federal Republic of Germany, on May 18, 1998 under the deposition number DSM 12180.

A second more preferred enzyme is the mannanase from the *Bacillus subtilis* strain 168, which is described in the co-pending U.S. patent application Ser. No. 09/095,163. More specifically, this mannanase is:

i) is encoded by the coding part of the DNA sequence shown in SED ID No. 5 shown in the U.S. patent application Ser. No. 09/095,163 or an analogue of said sequence; and/or ii) a polypeptide comprising an amino acid sequence as shown SEQ ID NO:6 shown in the U.S. patent application Ser. No. 09/095,163; or iii) an analogue of the polypeptide defined in ii) which is at least 70% homologous with said polypeptide, or is derived from said polypeptide by substitution, deletion or addition of one or several amino acids, or is immunologically reactive with a polyclonal antibody raised against said polypeptide in purified form.

Also encompassed in the corresponding isolated polypeptide having mannanase activity selected from the group consisting of:

(a) polynucleotide molecules encoding a polypeptide having mannanase activity and comprising a sequence of nucleotides as shown in SEQ ID NO:5 as shown in the U.S. patent application Ser. No. 09/095,163

(b) species homologs of (a);

(c) polynucleotide molecules that encode a polypeptide having mannanase activity that is at least 70% identical to the amino acid sequence of SEQ ID NO: 6 as shown in the U.S. patent application Ser. No. 09/095,163;

(d) molecules complementary to (a), (b) or (c); and (e) degenerate nucleotide sequences of (a), (b), (c) or (d).

A third more preferred mannanase is described in the co-pending Danish patent application No. PA 1998 01340. More specifically, this mannanase is:

i) a polypeptide produced by Bacillus sp. 1633;

ii) a polypeptide comprising an amino acid sequence as shown in positions 33–340 of SEQ ID NO:2 as shown in the Danish application No. PA 1998 01340; or iii) an analogue of the polypeptide defined in i) or ii) which is at least 65% homologous with said polypeptide, is derived from said polypeptide by substitution, deletion or addition of one or several amino acids, or is immunologically reactive with a polyclonal antibody raised against said polypeptide in purified form.

Also encompassed is the corresponding isolated polynucleotide molecule selected from the group consisting of:

(a) polynucleotide molecules encoding a polypeptide having mannanase activity and comprising a sequence of nucleotides as shown in SEQ ID NO: 1 from nucleotide 317 to nucleotide 1243 the Danish application No. PA 1998 01340;

(b) species homologs of (a);

(c) polynucleotide molecules that encode a polypeptide having mannanase activity that is at least 65% identical to the amino acid sequence of SEQ ID NO: 2 from amino acid residue 33 to amino acid residue 340 the Danish application No. PA 1998 01340;

(d) molecules complementary to (a), (b) or (c); and (e) degenerate nucleotide sequences of (a), (b), (c) or (d).

The plasmid pBXM3 comprising the polynucleotide molecule (the DNA sequence) encoding a mannanase of the present invention has been transformed into a strain of the *Escherichia coli* which was deposited by the inventors according to the Budapest Treaty on the International Recognition of the Deposit of Microorganisms for the Purposes of Patent Procedure at the Deutsche Sammlung von Mikroorganismen und Zellkulturen GmbH, Mascheroder Weg 1b, D-38124 Braunschweig, Federal Republic of Germany, on May 29, 1998 under the deposition number DSM 12197.

A fourth more preferred mannanase is described in the Danish co-pending patent application No. PA 1998 01341. More specifically, this mannanase is:

i) a polypeptide produced by Bacillus sp. AAI 12;

ii) a polypeptide comprising an amino acid sequence as shown in positions 25–362 of SEQ ID NO:2 as shown in the Danish application No. PA 1998 01341; or iii) an analogue of the polypeptide defined in i) or ii) which is at least 65% homologous with said polypeptide, is derived from said polypeptide by substitution, deletion or addition of one or several amino acids, or is immunologically reactive with a polyclonal antibody raised against said polypeptide in purified form.

Also encompassed is the corresponding isolated polynucleotide molecule selected from the group consisting of (a) polynucleotide molecules encoding a polypeptide having mannanase activity and comprising a sequence of nucleotides as shown in SEQ ID NO: 1 from nucleotide 225 to nucleotide 1236 as shown in the Danish application No. PA 1998 01341;

(b) species homologs of (a);

(c) polynucleotide molecules that encode a polypeptide having mannanase activity that is at least 65% identical to the amino acid sequence of SEQ ID NO: 2 from amino acid residue 25 to amino acid residue 362 as shown in the Danish application No. PA 1998 01341;

(d) molecules complementary to (a), (b) or (c); and (e) degenerate nucleotide sequences of (a), (b), (c), or (d).

The plasmid pBXM1 comprising the polynucleotide molecule (the DNA sequence) encoding a mannanase of the present invention has been transformed into a strain of the *Escherichia coli* which was deposited by the inventors according to the Budapest Treaty on the International Recognition of the Deposit of Microorganismis for the Purposes of Patent Procedure at the Deutsche Sammlung von Mikroorganismen und Zellkulturen GmbH, Mascheroder Weg 1b, D-38124 Braunschweig, Federal Republic of Germany, on Oct. 7, 1998 under the deposition number DSM 12433.

The mannanase, when present, is incorporated into the compositions of the present invention preferably at a level of from 0.0001% to 2%, more preferably from 0.0005% to 0.1%, most preferred from 0.001% to 0.02% pure enzyme by weight of the composition.

The compositions of the present invention may also comprise a xyloglucanase enzyme. Suitable xyloglucanases for the purpose of the present invention are enzymes exhibiting endoglucanase activity specific for xyloglucan, preferably at a level of from about 0.001% to about 1%, more preferably from about 0.01% to about 0.5%, by weight of the composition. As used herein, the term "endoglucanase activity" means the capability of the enzyme to hydrolyze 1,4-β-glycosidic linkages present in any cellulosic material, such as cellulose, cellulose derivatives, lichenin, β-D-glucan, or xyloglucan. The endoglucanase activity may be determined in accordance with methods known in the art, examples of which are described in WO 94/14953 and hereinafter. One unit of endoglucanase activity (e.g. CMCU, AVIU, XGU or BGU) is defined as the production of 1 $\mu$mol reducing sugar/min from a glucan substrate, the glucan substrate being, e.g., CMC (CMCU), acid swollen Avicell (AVIU), xyloglucan. (XGU) or cereal β-glucan (BGU). The reducing sugars are determined as described in WO 94/14953 and hereinafter. The specific activity of an endoglucanase towards a substrate is defined as units/mg of protein.

Suitable are enzymes exhibiting as its highest activity XGU endoglucanase activity (hereinafter "specific for xyloglucan"), which enzyme:

i) is encoded by a DNA sequence comprising or included in at least one of the following partial sequences (a) ATTCATTTGT GGACAGTGGA C (SEQ BD No: 1)
(b) GTTGATCGCA CATTGAACCA (SEQ ID NO: 2)
(c) ACCCCAGCCG ACCGATTGTC (SEQ ID NO: 3)
(d) CTTCCTTACC TCACCATCAT (SEQ ID NO: 4)
(e) TTAACATCTT TTCACCATGA (SEQ ID NO: 5)
(f) AGCTTTCCCT TCTCTCCCTF (SEQ ED NO: 6)
(g) GCCACCCTGG CTTCCGCTGC CAGCCTCC (SEQ ID NO: 7)
(h) GACAGTAGCA ATCCAGCATT (SEQ ID NO: 8)
(i) AGCATCAGCC GCTTTGTACA (SEQ ID NO: 9)

(j) CCATGAAGTT CACCGTATTG (SEQ ID NO: 10)
(k) GCACTGCTTC TCTCCCAGGT (SEQ ID NO: 11)
(l) GTGGGCGGCC CCTCAGGCAA (SEQ ID NO: 12)
(m) ACGCTCCTCC AATTTTCTCT (SEQ ID NO: 13)
(n) GGCTGGTAG TAATGAGTCT (SEQ ID NO: 14)
(o) GGCGCAGAGT TTGGCCAGGC (SEQ ID NO: 15)
(p) CAACATCCCC GGTGTTCTGG G (SEQ ID NO: 16)

(q) AAAGATTCAT TTGTGGACAG TGGACGTTGA TCGCACATTG AACCAACCCC AGCCGACCGA
TTGTCCTTCC TTACCTCACC ATCATTTAAC ATCTTTTCAC CATGAAGCTT TCCCTTCTCT
CCCTTGCCAC CCTGGCTTCC GCTGCCAGCC TCCAGCGCCG CACACTTCTG CGGTCAGTGG
GATACCGCCA CCGCCGGTGA CTTCACCCTG TACAACGACC TTTGGGGCGA GACGGCCGGC
ACCGGCTCCC AGTGCACTGG AGTCGACTCC TACAGCGGCG ACACCATCGC TTGTCACACC
AGCAGGTCCT GGTCGGAGTA GCAGCAGCGT CAAGAGCTAT GCCAACG (SEQ ID NO:17) or
(r) CAGCATCTCC ATTGAGTAAT CACGTTGGTG TTCGGTGGCC CGCCGTGTTG CGTGGCGGAG
GCTGCCGGGA GACGGGTGGG GATGGTGGTG GGAGAGAATG TAGGGCGCCG TGTTTCAGTC
CCTAGGCAGG ATACCGGAAA ACCGTGTGGT AGGAGGTTTA TAGGTTTCCA GGAGACGCTG
TATAGGGGAT AAATGAGATT GAATGGTGGC CACACTCAAA CCAACCAGGT CCTGTACATA
CAATGCATAT ACCAATTATA CCTACCAAAA AAAAAAAAAA AAAAAAAAAA AAAA (SEQ ID NO:18)

or a sequence homologous thereto encoding a polypeptide specific for xyloglucan with endoglucanase activity, ii) is immunologically reactive with an antibody raised against a highly purified endoglucanase encoded by the DNA sequence defined in i) and derived from *Aspergillus aculeatus*, CBS 101.43, and is specific for xyloglucan.

More specifically, as used herein the term "specific for xyloglucan" means that the endoglucanse enzyme exhibits its highest endoglucanase activity on a xyloglucan substrate, and preferably less than 75% activity, more preferably less than 50% activity, most preferably less than about 25% activity, on other cellulose-containing substrates such as carboxymethyl cellulose, cellulose, or other glucans.

Preferably, the specificity of an endoglucanase towards xyloglucan is further defined as a relative activity determined as the release of reducing sugars at optimal conditions obtained by incubation of the enzyme with xyloglucan and the other substrate to be tested, respectively. For instance, the specificity may be defined as the xyloglucan to β-glucan activity (XGU/BGU), xyloglucan to carboxy methyl cellulose activity (XGU/CMCU), or xyloglucan to acid swollen Avicell activity (XGU/AVIU), which is preferably greater than about 50, such as 75, 90 or 100.

The term "derived from" as used herein refers not only to an endoglucanase produced by strain CBS 101.43, but also an endoglucanase encoded by a DNA sequence isolated from strain CBS 101.43 and produced in a host organism transformed with said DNA sequence. The term "homologue" as used herein indicates a polypeptide encoded by DNA which hybridizes to the same probe as the DNA coding for an endoglucanase enzyme specific for xyloglucan under certain specified conditions (such as presoaking in 5×SSC and prehybridizing for 1 h at −40° C. in a solution of 5×SSC, 5×Denhardt's solution, and 50 μg of denatured sonicated calf thymus DNA, followed by hybridization in the same solution supplemented with 50 μCi 32-P-dCTP labelled probe for 18 h at −40° C. and washing three times in 2'SSC, 0.2% SDS at 40° C. for 30 minutes). More specifically, the term is intended to refer to a DNA sequence which is at least 70% homologous to any of the sequences shown above encoding an endoglucanase specific for xyloglucan, including at least 75%, at least 80%, at least 85%, at least 90% or even at least 95% with any of the sequences shown above. The term is intended to include modifications of any of the DNA sequences shown above, such as nucleotide substitutions which do not give rise to another amino acid sequence of the polypeptide encoded by the sequence, but which correspond to the codon usage of the host organism into which a DNA construct comprising any of the DNA sequences is introduced or nucleotide substitutions which do give rise to a different amino acid sequence and therefore, possibly, a different amino acid sequence and therefore, possibly, a different protein structure which might give rise to an endoglucanase mutant with different properties than the native enzyme. Other examples of possible modifications are insertion of one or more nucleotides into the sequence, addition of one or more nucleotides at either end of the sequence, or deletion of one or more nucleotides at either end or within the sequence.

Endoglucanase specific for xyloglucan useful in the present invention preferably is one which has a XGU/BGU, XGU/CMU and/or XGU/AVIU ratio (as defined above) of more than 50, such as 75, 90 or 100.

Furthermore, the endoglucanase specific for xyloglucan is preferably substantially devoid of activity towards β-glucan and/or exhibits at the most 25% such as at the most 10% or about 5%, activity towards carboxymethyl cellulose and/or Avicell when the activity towards xyloglucan is 100%. In addition, endoglucanase specific for xyloglucan of the invention is preferably substantially devoid of transferase activity, an activity which has been observed for most endoglucanases specific for xyloglucan of plant origin.

Endoglucanase specific for xyloglucan may be obtained from the fungal species A. *aculeatus*, as described in WO 94/14953. Microbial endoglucanases specific for xyloglucan has also been described in WO 94/14953. Endoglucanases specific for xyloglucan from plants have been described, but these enzymes have transferase activity and therefore must be considered inferior to microbial endoglucanses specific for xyloglucan whenever extensive degradation of xyloglucan is desirable. An additional advantage of a microbial enzyme is that it, in general, may be produced in higher amounts in a microbial host, than enzymes of other origins.

The xyloglucanase, when present, is incorporated into the compositions of the invention preferably at a level of from 0.0001% to 2%, more preferably from 0.0005% to 0.1%, most preferred from 0.001% to 0.02% pure enzyme by weight of the composition.

The above-mentioned enzymes may be of any suitable origin, such as vegetable, animal, bacterial, ftmgal and yeast origin. Origin can further be mesophilic or extremophilic (psychrophilic, psychrotrophic, thermophilic, barophilic, alkalophilic, acidophilic, halophilic, etc.). Purified or non-purified forms of these enzymes may be used. Nowadays, it is common practice to modify wild-type enzymes via protein/genetic engineering techniques in order to optimize their performance efficiency in the laundry detergent and/or fabric care compositions of the invention. For example, the variants may be designed such that the compatibility of the enzyme to commonly encountered ingredients of such compositions is increased. Alternatively, the variant may be designed such that the optimal pH, bleach or chelant stability, catalytic activity and the like, of the enzyme variant is tailored to suit the particular laundry application.

In particular, attention should be focused on amino acids sensitive to oxidation in the case of bleach stability and on surface charges for the surfactant compatibility. The isoelectric point of such enzymes may be modified by the substitution of some charged amino acids, e.g. an increase in isoelectric point may help to improve compatibility with anionic surfactants. The stability of the enzymes may be further enhanced by the creation of e.g. additional salt bridges and enforcing calcium binding sites to increase chelant stability.

Other suitable cleaning adjunct materials that can be added are enzyme oxidation scavengers. Examples of such enzyme oxidation scavengers are ethoxylated tetraethylene polyamines.

A range of enzyme materials are also disclosed in WO 9307263 and WO 9307260 to Genencor International, WO 8908694, and U.S. Pat. No. 3,553,139, Jan. 5, 1971 to McCarty et al. Enzymes are further disclosed in U.S. Pat. No. 4,101,457, and in U.S. Pat. No. 4,507,219. Enzyme materials particularly useful for liquid detergent formulations, and their incorporation into such formulations, are disclosed in U.S. Pat. No. 4,261,868.

Various carbohydrase enzymes which impart antimicrobial activity may also be included in the present invention. Such enzymes include endoglycosidase, Type II endoglycosidase and glucosidase as disclosed in U.S. Pat. Nos. 5,041,236, 5,395,541, 5,238,843 and 5,356,803 the disclosures of which are herein incorporated by reference. Of course, other enzymes having antimicrobial activity may be employed as well including peroxidases, oxidases and various other enzymes.

It is also possible to include an enzyme stabilization system into the compositions of the present invention when any enzyme is present in the composition.

Enzyme Stabilizers

Enzymes for use in detergents can be stabilized by various techniques. Enzyme stabilization techniques are disclosed and exemplified in U.S. Pat. No. 3,600,319, EP 199,405 and EP 200,586. Enzyme stabilization systems are also described, for example, in U.S. Pat. No. 3,519,570. A useful Bacillus, sp. AC13 giving proteases, xylanases and cellulases, is described in WO 9401532. The enzymes employed herein can be stabilized by the presence of water-soluble sources of calcium and/or magnesium ions in the finished compositions which provide such ions to the enzymes. Suitable enzyme stabilizers and levels of use are described in U.S. Pat. Nos. 5,705,464, 5,710,115 and 5,576,282.

Builders

The detergent and laundry compositions described herein preferably comprise one or more detergent builders or builder systems. When present, the compositions will typically comprise at least about 1% builder, preferably from about 5%, more preferably from about 10% to about 80%, preferably to about 50%, more preferably to about 30% by weight, of detergent builder. Lower or higher levels of builder, however, are not meant to be excluded.

Preferred builders for use in the detergent and laundry compositions, particularly dishwashing compositions, described herein include, but are not limited to, water-soluble builder compounds, (for example polycarboxylates) as described in U.S. Pat. Nos. 5,695,679, 5,705,464 and 5,710,115. Other suitable polycarboxylates are disclosed in U.S. Pat. Nos. 4,144,226, 3,308,067 and 3,723,322. Preferred polycarboxylates are hydroxycarboxylates containing up to three carboxy groups per molecule, more particularly titrates.

Inorganic or P-containing detergent builders include, but are not limited to, the alkali metal, ammonium and alkanolammonium salts of polyphosphates (exemplified by the tripolyphosphates, pyrophosphates, and glassy polymeric meta-phosphates), phosphonates (see, for example, U.S. Pat. Nos. 3,159,581; 3,213,030; 3,422,021; 3,400,148 and 3,422,137), phytic acid, silicates, carbonates (including bicarbonates and sesquicarbonates), sulphates, and aluminosilicates.

However, non-phosphate builders are required in some locales. Importantly, the compositions herein function surprisingly well even in the presence of the so-called "weak" builders (as compared with phosphates) such as citrate, or in the so-called "underbuilt" situation that may occur with zeolite or layered silicate builders.

Suitable silicates include the water-soluble sodium silicates with an $SiO_2$:$Na_2O$ ratio of from about 1.0 to 2.8, with ratios of from about 1.6 to 2.4 being preferred, and about 2.0 ratio being most preferred. The silicates may be in the form of either the anhydrous salt or a hydrated salt. Sodium silicate with an $SiO_2$:$Na_2O$ ratio of 2.0 is the most preferred. Silicates, when present, are preferably present in the detergent and laundry compositions described herein at a level of from about 5% to about 50% by weight of the composition, more preferably from about 10% to about 40% by weight.

Partially soluble or insoluble builder compounds, which are suitable for use in the detergent and laundry compositions, particularly granular detergent compositions, include, but are not limited to, crystalline layered silicates, preferably crystalline layered sodium silicates (partially water-soluble) as described in U.S. Pat. No. 4,664,839, and sodium aluminosilicates (water-insoluble). When present in detergent and laundry compositions, these builders are typically present at a level of from about 1% to 80% by weight, preferably from about 10% to 70% by weight, most preferably from about 20% to 60% by weight of the composition.

Crystalline layered sodium silicates having the general formula $NaMSi_xO_{2x+1}.yH_2O$ wherein M is sodium or hydrogen, x is a number from about 1.9 to about 4, preferably from about 2 to about 4, most preferably 2, and y is a number from about 0 to about 20, preferably 0 can be used in the compositions described herein. Crystalline layered sodium silicates of this type are disclosed in EP-A-0164514 and methods for their preparation are disclosed in DR-A-3417649 and DE-A-3742043. The most preferred material is delta-$Na_2SiO_5$, available from Hoechst AG as NaSKS-6 (commonly abbreviated herein as "SKS-6"). Unlike zeolite builders, the Na SKS-6 silicate builder does not contain aluminum. NaSKS-6 has the delta-$Na_2SiO_5$ morphology form of layered silicate. SKS-6 is a highly preferred layered silicate for use in the compositions described herein herein, but other such layered silicates, such as those having the general formula $NaMSi_xO_{2x+1}.yH_2O$ wherein M is sodium or hydrogen, x is a number from 1.9 to 4, preferably 2, and y is a number from 0 to 20, preferably 0 can be used in the compositions described herein. Various other layered silicates from Hoechst include NaSKS-5, NaSKS-7 and NaSKS-11, as the alpha, beta and gamma forms. As noted above, the delta-$Na_2SiO_5$ (NaSKS-6 form) is most preferred for use herein. Other silicates may also be useful such as for example magnesium silicate, which can serve as a crispening agent in granular formulations, as a stabilizing agent for oxygen bleaches, and as a component of suds control systems.

The crystalline layered sodium silicate material is preferably present in granular detergent compositions as a particulate in intimate admixture with a solid, water-soluble ionizable material. The solid, water-soluble ionizable material is preferably selected from organic acids, organic and inorganic acid salts and mixtures thereof.

Aluminosilicate builders are of great importance in most currently marketed heavy duty granular detergent compositions, and can also be a significant builder ingredient in liquid detergent formulations. Alumiunosilicate builders have the empirical formula:

$$[M_z(AlO_2)_y].xH_2O$$

wherein z and y are integers of at least 6, the molar ratio of z to y is in the range from 1.0 to about 0.5, and x is an integer from about 15 to about 264. Preferably, the aluminosilicate builder is an aluminosilicate zeolite having the unit cell formula:

$$Na_z[(AlO_2)_z(SiO_2)_y].xH_2O$$

wherein z and y are at least 6; the molar ratio of z to y is from 1.0 to 0.5 and x is at least 5, preferably 7.5 to 276, more preferably from 10 to 264. The aluminosilicate builders are preferably in hydrated form and are preferably crystalline, containing from about 10% to about 28%, more preferably from about 18% to about 22% water in bound form.

These aluminosilicate ion exchange materials can be crystalline or amorphous in structure and can be naturally occurring aluminosilicates or synthetically derived. A method for producing alumninosilicate ion exchange materials is disclosed in U.S. Pat. No. 3,985,669. Preferred synthetic crystalline aluminosilicate ion exchange materials useful herein are available under the designations Zeolite A, Zeolite B, Zeolite P, Zeolite X, Zeolite MAP and Zeolite HS and mixtures thereof. In an especially preferred embodiment, the crystalline aluminosilicate ion exchange material has the formula:

$$Na_{12}[(AlO_2)_{12}(SiO_2)_{12}].xH_2O$$

wherein x is from about 20 to about 30, especially about 27. This material is known as Zeolite A. Dehydrated zeolites (x=0–10) may also be used herein. Preferably, the aluminosilicate has a particle size of about 0.1–10 microns in diameter. Zeolite X has the formula:

$$Na_{86}[(AlO_2)_{86}(SiO_2)_{106}].276H_2O$$

Citrate builders, e.g., citric acid and soluble salts thereof (particularly sodium salt), are polycarboxylate builders of particular importance for heavy duty liquid detergent formulations due to their availability from renewable resources and their biodegradability. Citrates can also be used in granular compositions, especially in combination with zeolite and/or layered silicate builders. Oxydisuccinates are also especially useful in such compositions and combinations.

Also suitable in the detergent compositions described herein are the 3,3-dicarboxy-4-oxa-1,6-hexanedioates and the related compounds disclosed in U.S. Pat. No. 4,566,984. Useful succinic acid builders include the $C_5$–$C_{20}$ alkyl and alkenyl succmic acids and salts thereof. A particularly preferred compound of this type is dodecenylsuccinic acid. Specific examples of succinate builders include: laurylsuccinate, myristylsuccinate, palmitylsuccinate, 2-dodecenylsuccinate (preferred), 2-pentadecenylsuccinate, and the like. Laurylsuccinates are the preferred builders of this group, and are described in European Patent Application 86200690.5/0,200,263, published Nov. 5, 1986.

Fatty acids, e.g., $C_{12}$–$C_{18}$ monocarboxylic acids, can also be incorporated into the compositions alone, or in combination with the aforesaid builders, especially citrate and/or the succinate builders, to provide additional builder activity. Such use of fatty acids will generally result in a diminution of sudsing, which should be taken into account by the formulator.

Dispersants

One or more suitable polyalkyleneimine dispersants may be incorporated into the laundry compositions of the present invention. Examples of such suitable dispersants can be found in European Patent Application Nos. 111,965, 111,984, and 112,592; U.S. Pat. Nos. 4,597,898, 4,548,744, and 5,565,145. However, any suitable clay/soil dispersent or anti-redepostion agent can be used in the laundry compositions of the present invention.

In addition, polymeric dispersing agents which include polymeric polycarboxylates and polyethylene glycols, are suitable for use in the present invention. Unsaturated monomeric acids that can be polymerized to form suitable polymeric polycarboxylates include acrylic acid, maleic acid (or maleic anhydride), fumaric acid, itaconic acid, aconitic acid, mesaconic acid, citraconic acid and metbylenemalonic acid. Particularly suitable polymeric polycarboxylates can be derived from acrylic acid. Such acrylic acid-based polymers which are useful herein are the water-soluble salts of polymerized acrylic acid. The average molecular weight of such polymers in the acid form preferably ranges from about 2,000 to 10,000, more preferably from about 4,000 to 7,000 and most preferably from about 4,000 to 5,000. Water-soluble salts of such acrylic acid polymers can include, for example, the alkali metal, ammonium and substituted ammonium salts. Soluble polymers of this type are known materials. Use of polyacrylates of this type in detergent compositions has been disclosed, for example, in U.S. Pat. No. 3,308,067.

Acrylic/maleic-based copolymers may also be used as a preferred component of the dispersing/anti-redeposition agent. Such materials include the water-soluble salts of copolymers of acrylic acid and maleic acid. The average molecular weight of such copolymers in the acid form preferably ranges from about 2,000 to 100,000, more preferably from about 5,000 to 75,000, most preferably from about 7,000 to 65,000. The ratio of acrylate to maleate segments in such copolymers will generally range from about 30:1 to about 1:1, more preferably from about 10:1 to 2:1. Water-soluble salts of such acrylic acid/maleic acid copolymers can include, for example, the alkali metal, ammonium and substituted ammonium salts. Soluble acrylate/maleate copolymers of this type are known materials which are described in European Patent Application No. 66915, published Dec. 15, 1982, as well as in EP 193,360, published Sep. 3, 1986, which also describes such polymers comprising hydroxypropylacrylate. Still other useful dispersing agents include the maleic/acrylic/vinyl alcohol terpolymers. Such materials are also disclosed in EP 193,360, including, for example, the 45/45/10 terpolymer of acrylic/maleic/vinyl alcohol.

Another polymeric material which can be included is polyethylene glycol (PEG). PEG can exhibit dispersing agent performance as well as act as a clay soil removal-antiredeposition agent. Typical molecular weight ranges for these purposes range from about 500 to about 100,000, preferably from about 1,000 to about 50,000, more preferably from about 1,500 to about 10,000.

Polyaspartate and polyglutamate dispersing agents may also be used, especially in conjunction with zeolite builders. Dispersing agents such as polyaspartate preferably have a molecular weight (avg.) of about 10,000.

Soil Release Agents

The compositions according to the present invention may optionally comprise one or more soil release agents including anti-redeposition agents. If utilized, soil release agents will generally comprise from about 0.01%, preferably from about 0.1%, more preferably from about 0.2% to about 10%, preferably to about 5%, more preferably to about 3% by weight, of the composition.

Any soil suspending polyamine polymer known to those skilled in the art may be used herein. Particularly suitable polyamine polymers for use herein are polyalkoxylated polyamines. Such materials can conveniently be represented as molecules of the empirical structures with repeating units:

[I]

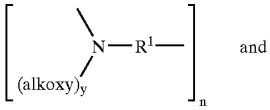

and

[II]

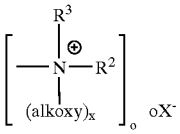

wherein $R^1$ and $R^2$ are independently a hydrocarbyl group, usually of 2–6 carbon atoms; $R^3$ may be a $C_1$–$C_{20}$ hydrocarbon; the alkoxy groups are ethoxy, propoxy, and the like, and x and y are independently 2–30, most preferably from 10–20; n and o are independently an integer of at least 2, preferably from 2–20, most preferably 3–5; and $X^-$ is an anion such as halide or methylsulfate, resulting from the quaternization reaction of [I] above.

The most highly preferred polyamines for use herein are the so-called ethoxylated polyethylene amines, i.e., the polymerized reaction product of ethylene oxide with ethyleneimine, having the general formula:

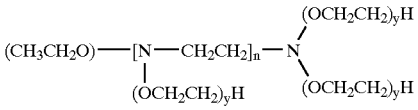

when y=2–30. Particularly preferred for use herein is an ethoxylated polyethylene amine, in particular ethoxylated tetraethylenepentamine, and quaternized ethoxylated hexamethylene diamine.

Soil suspending polyamine polymers contribute to the benefits of the present invention, i.e., that when added on top of said diacyl peroxide, further improve the stain removal performance of a composition comprising them, especially under laundry pretreatment conditions, as described herein. Indeed, they allow to improve the stain removal performance on a variety of stains including greasy stains, enzymatic stains, clay/mud stains as well as on bleachable stains.

Typically, the compositions comprise up to 10% by weight of the total composition of such a soil suspending polyamine polymer or mixtures thereof, preferably from 0.1% to 5% and more preferably from 0.3% to 2%.

The compositions herein may also comprise other polymeric soil release agents known to those skilled in the art. Such polymeric soil release agents are characterised by having both hydrophilic segments, to hydrophilize the surface of hydrophobic fibres, such as polyester and nylon, and hydrophobic segments, to deposit upon hydrophobic fibres and remain adhered thereto through completion of washing and rinsing cycles and, thus, serve as an anchor for the hydrophilic segments. This can enable stains occurring subsequent to treatment with the soil release agent to be more easily cleaned in later washing procedures.

The polymeric soil release agents useful herein especially include those soil release agents having: (a) one or more nonionic hydrophile components consisting essentially of (i) polyoxyethylene segments with a degree of polymerization of at least 2, or (ii) oxypropylene or polyoxypropylene segments with a degree of polymerization of from 2 to 10, wherein said hydrophile segment does not encompass any oxypropylene unit unless it is bonded to adjacent moieties at each end by ether linkages, or (iii) a mixture of oxyalkylene units comprising oxyethylene and from 1 to about 30 oxypropylene units wherein said mixture contains a sufficient amount of oxyethylene units such that the hydrophile component has hydrophilicity great enough to increase the hydrophilicity of conventional polyester synthetic fiber surfaces upon deposit of the soil release agent on such surface, said hydrophile segments preferably comprising at least about 25% oxyethylene units and more preferably, especially for such components having about 20 to 30 oxypropylene units, at least about 50% oxyethylene units; or (b) one or more hydrophobe components comprising (i) $C_3$ oxyalkylene terephthalate segments, wherein, if said hydrophobe components also comprise oxyethylene terephthalate, the ratio of oxyethylene terephthalate:$C_3$ oxyalkylene terephthalate units is about 2:1 or lower, (ii) $C_4$–$C_6$ alkylene or oxy $C_4$–$C_6$ alkylene segments, or mixtures therein, (iii) poly (vinyl ester) segments, preferably polyvinyl acetate), having a degree of polymerization of at least 2, or (iv) $C_1$–$C_4$ alkyl ether or $C_4$ hydroxyalkyl ether substituents, or mixtures therein, wherein said substituents are present in the form of $C_1$–$C_4$ alkyl ether or $C_4$ hydroxyalkyl ether cellulose derivatives, or mixtures therein, and such cellulose derivatives are amphiphilic, whereby they have a sufficient level of $C_1$–$C_4$ alkyl ether and/or $C_4$ hydroxyalkyl ether units to deposit upon conventional polyester synthetic fiber surfaces and retain a sufficient level of hydroxyls, once adhered to such conventional synthetic fiber surface, to increase fiber surface hydrophilicity, or a combination of (a) and (b).

Typically, the polyoxyethylene segments of (a)(i) will have a degree of polymerization of from about 1 to about 200, although higher levels can be used, preferably from 3 to about 150, more preferably from 6 to about 100. Suitable oxy $C_4$–$C_6$ alkylene hydrophobe segments include, but are not limited to, end-caps of polymeric soil release agents such as $MO_3S(CH_2)_nOCH_2CH_2O$—, where M is sodium and n is an integer from 4–6, as disclosed in U.S. Pat. No. 4,721,580, issued Jan. 26, 1988 to Gosselink.

Polymeric soil release agents useful in the present invention also include cellulosic derivatives such as hydroxyether cellulosic polymers, co-polymeric blocks of ethylene terephthalate or propylene terephthalate with polyethylene oxide or polypropylene oxide terephthalate, and the like. Such agents are commercially available and include hydroxyethers of cellulose such as METHOCEL (Dow). Cellulosic soil release agents for use herein also include those selected from the group consisting of $C_1$–$C_4$ alkyl and $C_4$ hydroxyalkyl cellulose; see U.S. Pat. No. 4,000,093, issued Dec. 28, 1976 to Nicol, et al.

Soil release agents characterised by poly(vinyl ester) hydrophobe segments include graft co-polymers of poly (vinyl ester), e.g., $C_1$–$C_6$ vinyl esters, preferably poly(vinyl acetate) grafted onto polyalkylene oxide backbones, such as polyethylene oxide backbones. See European Patent Application 0 219 048, published Apr. 22, 1987 by Kud, et al. Commercially available soil release agents of this kind include the SOKALAN type of material, e.g., SOKALAN HP-22, available from BASF (West Germany).

One type of preferred soil release agent is a co-polymer having random blocks of ethylene terephthalate and polyethylene oxide (PEO) terephthalate. The molecular weight of this polymeric soil release agent is in the range of from about 25,000 to about 55,000. See U.S. Pat. No. 3,959,230 to Hays, issued May 25, 1976 and U.S. Pat. No. 3,893,929 to Basadur issued Jul. 8, 1975.

Another preferred polymeric soil release agent is a polyester with repeat units of ethylene terephthalate units which contains 10–15% by weight of ethylene terephthalate units together with 90–80% by weight of polyoxyethylene terephthalate units, derived from a polyoxyethylene glycol of average molecular weight 300–5,000. Examples of this polymer include the commercially available material ZELCON 5126 (from Dupont) and MILEASE T (from ICI). See also U.S. Pat. No. 4,702,857, issued Oct. 27, 1987 to Gosselink.

Another preferred polymeric soil release agent is a sulfonated product of a substantially linear ester oligomer comprised of an oligomeric ester backbone of terephthaloyl and oxyalkyleneoxy repeat units and terminal moieties covalently attached to the backbone. These soil release agents are fully described in U.S. Pat. No. 4,968,451, issued Nov. 6, 1990 to J. J. Scheibel and E. P. Gosselink. Other suitable polymeric soil release agents include the terephthalate polyesters of U.S. Pat. No. 4,711,730, issued Dec. 8, 1987 to Gosselink et al, the anionic end-capped oligomeric esters of U.S. Pat. No. 4,721,580, issued Jan. 26, 1988 to Gosselink, and the block polyester oligomeric compounds of U.S. Pat. No. 4,702,857, issued Oct. 27, 1987 to Gosselink.

Preferred polymeric soil release agents also include the soil release agents of U.S. Pat. No. 4,877,896, issued Oct. 31, 1989 to Maldonado et al, which discloses anionic, especially sulfoaroyl, end-capped terephthalate esters.

Still another preferred soil release agent is an oligomer with repeat units of terephthaloyl units, sulfoisoterephthaloyl units, oxyethyleneoxy and oxy-1,2-propylene units. The repeat units form the backbone of the oligomer and are preferably terminated with modified isethionate end-caps. A particularly preferred soil release agent of this type comprises about one sulfoisophthaloyl unit, 5 terephthaloyl units, oxyethyleneoxy and oxy-1,2-propyleneoxy units in a ratio of from about 1.7 to about 1.8, and two end-cap units of sodium 2-(2-hydroxyethoxy)-ethanesulfonate. Said soil release agent also comprises from about 0.5% to about 20%, by weight of the oligomer, of a crystalline-reducing stabilizer, preferably selected from the group consisting of xylene sulfonate, cumene sulfonate, toluene sulfonate, and mixtures thereof. See U.S. Pat. No. 5,415,807, issued May 16, 1995, to Gosselink et al.

Nonlimiting examples of suitable soil release polymers are disclosed in: U.S. Pat. Nos. 5,728,671; 5,691,298; 5,599,782; 5,415,807; 5,182,043; 4,956,447; 4,976,879; 4,968,451; 4,925,577; 4,861,512; 4,877,896; 4,771,730; 4,711,730; 4,721,580; 4,000,093; 3,959,230; and 3,893,929; and European Patent Application 0 219 048.

Further suitable soil release agents are described in U.S. Pat. Nos. 4,201,824; 4,240,918; 4,525,524; 4,579,681; 4,220,918; and 4,787,989; EP 279,134 A; EP 457,205 A; and DE 2,335,044.

If utilised, soil release agents will generally comprise from 0.01% to 10.0%, by weight, of the detergent compositions herein, typically from 0.1% to 5%, preferably from 0.2% to 3.0%;

Chelating Agents

The compositions of the present invention herein may also optionally contain a chelating agent which serves to chelate metal ions and metal impurities which would otherwise tend to deactivate the bleaching agent(s). Useful chelating agents can include any of those known to those skilled in the art such as amino carboxylates, phosphonates, amino phosphonates, polyfunctionally-substituted aromatic chelating agents and mixtures thereof. Further examples of suitable chelating agents and levels of use are described in U.S. Pat. Nos. 5,705,464, 5,710,115, 5,728,671 and 5,576,282.

The presence of chelating agents contribute to further enhance the chemical stability of the compositions. A chelating agent may be also desired in the compositions of the present invention as it allows to increase the ionic strength of the compositions herein and thus their stain removal and bleaching performance on various surfaces.

Suitable phosphonate chelating agents for use herein may include alkali metal ethane 1-hydroxy diphosphonates (HEDP), alkylene poly (alkylene phosphonate), as well as amino phosphonate compounds, including amino aminotri (methylene phosphonic acid) (ATMP), nitrilo trimethylene phosphonates (NTP), ethylene diamine tetra methylene phosphonates, and diethylene triamine penta methylene phosphonates (DTPMP). The phosphonate compounds may be present either in their acid form or as salts of different cations on some or all of their acid functionalities. Preferred phosphonate chelating agents to be used herein are diethylene triamine penta methylene phosphonate (DTPMP) and ethane 1-hydroxy diphosphonate (HEDP). Such phosphonate chelating agents are commercially available from Monsanto under the trade name DEQUEST®.

Polyfunctionally-substituted aromatic chelating agents may also be useful in the compositions herein. See U.S. Pat. No. 3,812,044, issued May 21, 1974, to Connor et al. Preferred compounds of this type in acid form are dihydroxydisulfobenzenes such as 1,2-dihydroxy -3,5-disulfobenzene.

A preferred biodegradable chelating agent for use herein is ethylene diamine N,N'-disuccinic acid, or alkali metal, or alkaline earth, ammonium or substitutes ammonium salts thereof or mixtures thereof. Ethylenediamine N,N' disuccinic acids, especially the (S,S) isomer have been extensively described in U.S. Pat. No. 4,704,233, Nov. 3, 1987, to Hartman and Perkins. Ethylenediamine N,N'-disuccinic acids is, for instance, commercially available under the tradename ssEDDS® from Palmer Research Laboratories.

Suitable amino carboxylates to be used herein include ethylene diamine tetra acetates, diethylene triamine pentaacetates, diethylene triamine pentaacetate (DTPA),N-hydroxyethylethylenediamine triacetates, nitrilotri-acetates, ethylenediamine tetrapropionates, triethylenetetraaminehexa-acetates, ethanol-diglycines, propylene diamine tetracetic acid (PDTA) and methyl glycine di-acetic acid (MGDA), both in their acid form, or in their alkali metal, ammonium, and substituted ammonium salt forms. Particularly suitable amino carboxylates to be used herein are diethylene triamine penta acetic acid, propylene diamine tetracetic acid (PDTA) which is, for instance, commercially available from BASF under the trade name Trilon FS® and methyl glycine di-acetic acid (MGDA).

Further carboxylate chelating agents to be used here in include salicylic acid, aspartic acid, glutamic acid, glyclne, malonic acid or mixtures thereof Another chelating agent for use herein is of the formula:

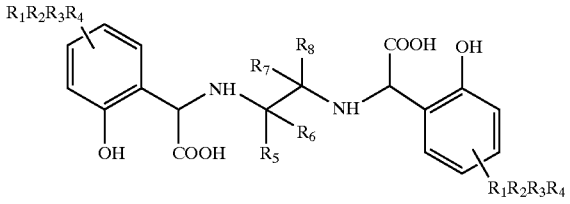

wherein $R_1$, $R_2$, $R_3$, and $R_4$ are independently selected from the group consisting of —H, alkyl, alkoxy, aryl, aryloxy, —Cl, —Br, —$NO_2$, —C(O)R', and —$SO_2$R"; wherein R' is selected from the group consisting of —H, —OH, alkyl, alkoxy, aryl, and aryloxy; R" is selected from the group consisting of alkyl, alkoxy, aryl, and aryloxy; and $R_5$, $R_6$, $R_7$, and $R_8$ are independently selected from the group consisting of —H and alkyl.

Particularly preferred chelating agents to be used herein are amino aminotri(methylene phosphonic acid), di-ethylene-triamino-pentaacetic acid, diethylene triamine penta methylene phosphonate, 1-hydroxy ethane diphosphonate, ethylenediamine N, N'-disuccinic acid, and mixtures thereof.

Typically, the compositions according to the present invention comprise up to about 15%, more preferably up to about 5% by weight of the total composition of a chelating agent, or mixtures thereof, preferably from 0.01% to 1.5% by weight and more preferably from 0.01% to 0.5%.

Radical Scavengers

The compositions of the present invention may comprise a radical scavenger or a mixture thereof.

Suitable radical scavengers for use herein include the well-known substituted mono and dihydroxy benzenes and their analogs, alkyl and aryl carboxylates and mixtures thereof. Preferred such radical scavengers for use herein include di-tert-butyl hydroxy toluene (BHT), hydroquinone, di-tert-butyl hydroquinone, mono-tert-butyl hydroquinone, tert-butyl-hydroxy anysole, benzoic acid, toluic acid, catechol, t-butyl catechol, benzylanine, 1,1,3-tris(2-methyl-4-hydroxy-5-t-butylphenyl)butane, n-propyl-gallate or mixtures thereof and highly preferred is di-tert-butyl hydroxy toluene. Such radical scavengers like N-propyl-gallate may be commercially available from Nipa Laboratories under the trade name Nipanox Sl®.

Radical scavengers when used, are typically present herein in amounts up to about 10% by weight of the total composition and preferably from about 0.001% to about 0.5% by weight.

The presence of radical scavengers may contribute to the chemical stability of the bleaching compositions of the present invention as well as to the safety profile of the compositions of the present invention.

Suds Suppressor

Another optional ingredient is a suds suppressor, exemplified by silicones, and silica-silicone mixtures. Examples of suitable suds suppressors are disclosed in U.S. Pat. Nos. 5,707,950 and 5,728,671. These suds suppressors are normally employed at levels of from about 0.001% to about 2% by weight of the composition, preferably from about 0.01% to about 1% by weight.

Suds Boosting Agents

If high sudsing is desired, suds boosting agents such as $C_{10}$–$C_{16}$ alkanolamides can be incorporated into the compositions, typically at about 1%–10% levels. The $C_{10}$–$C_{14}$ monoethanol and diethanol amides illustrate a typical class of such suds boosters. Use of such suds boosters with high sudsing adjunct surfactants such as the amine oxides, betaines and sultaines noted above is also advantageous. If desired, soluble magnesium salts such as $MgCl_2$, $MgSO_4$, and the like, can be added at levels of, for example, 0.1%–2%, to provide additional suds and to enhance grease removal performance.

Other suitable examples of suds boosting agents are described in WO 99/27058 and WO 99/27057 both to The Procter & Gamble Company, both published on Jun. 3, 1999.

Brighteners

Any optical brighteners, fluorescent whitening agents or other brightening or whitening agents known in the art can be incorporated in the instant compositions when they are designed for fabric treatment or laundering, at levels typically from about 0.05% to about 1.2%, by weight, of the detergent compositions herein. Commercial optical brighteners which may be useful in the present invention can be classified into subgroups, which include, but are not necessarily limited to, derivatives of stilbene, pyrazoline, coumarin, carboxylic acids, methinecyanines, dibenzothiophene-5,5-dioxide, azoles, 5- and 6-membered-ring heterocyclic brighteners, this list being illustrative and non-limiting. Examples of such brighteners are disclosed in "The Production and Application of Fluorescent Brightening Agents", M. Zahradnik, Published by John Wiley & Sons, New York (1982).

Specific examples of optical brighteners which are useful in the present compositions are those identified in U.S. Pat. No. 4,790,856, issued to Wixon on Dec. 13, 1988. These brighteners include the PHORWHITE series of brighteners from Verona. Other brighteners disclosed in this reference include: Tinopal UNPA, Tinopal CBS and Tinopal 5BM Tinpal PLC; available from Ciba-Geigy; Artic White CC and Artic White CWD, available from Hilton-Davis, located in Italy; the 2-(4-styryl-phenyl)-2H-napbthol[1,2-d]triazoles; 4,4'-bis-(1,2,3-triazol-2-yl)-stil-benes; 4,4'-bis(styryl) bisphenyls; and the aminocoumarins. Specific examples of these brighteners include 4-methyl-7-diethyl-amino coumarin; 1,2-bis(-benzimidazol-2-yl)ethylene; 2,5-bis (benzoxazol-2-yl)thiophene; 2-styryl-napth-[1,2]oxazole; and 2-(stilbene-4-yl)-2H-naphtho-[1,2-d]triazole. See also U.S. Pat. No. 3,646,015, issued Feb. 29, 1972, to Hamilton. Anionic brighteners are typically preferred herein.

Softening Agents

Fabric softening agents can also be incorporated into laundry detergent compositions in accordance with the present invention. Inorganic softening agents are exemplified by the smectite clays disclosed in GB-A-1 400 898 and in U.S. Pat. No. 5,019,292. Organic softening agents include the water insoluble tertiary amines as disclosed in GB-A-1 514 276 and EP-B-011 340 and their combination with mono C12–C14 quaternary ammonium salts are disclosed in EP-B-026 527 and EP-B-026 528 and di-long-chain amides as disclosed in EP-B-0 242 919. Other useful organic ingredients of fabric softening systems include high molecular weight polyethylene oxide materials as disclosed in EP-A-0 299 575 and 0 313 146.

Particularly suitable fabric softening agents are disclosed in U.S. Pat. Nos. 5,707,950 and 5,728,673.

Levels of smectite clay are normally in the range from 2% to 20%, more preferably from 5% to 15% by weight, with the material being added as a dry mixed component to the remainder of the formulation. Organic fabric softening agents such as the water-insoluble tertiary amines or dilong chain amide materials are incorporated at levels of from 0.5% to 5% by weight, normally from 1% to 3% by weight whilst the high molecular weight polyethylene oxide materials and the water soluble cationic materials are added at levels of from 0.1% to 2%, normally from 0.15% to 1.5% by weight. These materials are normally added to the spray dried portion of the composition, although in some instances it may be more convenient to add them as a dry mixed particulate, or spray them as molten liquid on to other solid components of the composition.

Biodegradable quaternary ammonium compounds as described in EP-A-040 562 and EP-A-239 910 have been presented as alternatives to the traditionally used di-long alkyl chain ammonium chlorides and methyl sulfates.

Non-limiting examples of softener-compatible anions for the quaternary ammonium compounds and amine precursors include chloride or methyl sulfate.

Dye Transfer Inhibition

The detergent compositions of the present invention can also include compounds for inhibiting dye transfer from one fabric to another of solubilized and suspended dyes encountered during fabric laundering and conditioning operations involving colored fabrics.

i. Polymeric dye transfer inhibiting agents

The detergent compositions according to the present invention can also comprise from 0.001% to 10%, preferably from 0.01% to 2%, more preferably from 0.05% to 1% by weight of polymeric dye transfer inhibiting agents. Said polymeric dye transfer inhibiting agents are normally incorporated into detergent compositions in order to inhibit the transfer of dyes from colored fabrics onto fabrics washed therewith. These polymers have the ability to complex or adsorb the fugitive dyes washed out of dyed fabrics before the dyes have the opportunity to become attached to other articles in the wash.

Especially suitable polymeric dye transfer inhibiting agents are polyamine N-oxide polymers, copolymers of N-vinylpyrrolidone and N-vinylimidazole, polyvinylpyrrolidone polymers, polyvinyloxazolidones and polyvinylimidazoles or mixtures thereof. Examples of such dye transfer inhibiting agents are disclosed in U.S. Pat. Nos. 5,707,950 and 5,707,951.

Additional suitable dye transfer inhibiting agents include, but are not limited to, cross-linked polymers. Cross-linked polymers are polymers whose backbone are interconnected to a certain degree; these links can be of chemical or physical nature, possibly with active groups n the backbone or on branches; cross-linked polymers have been described in the Journal of Polymer Science, volume 22, pages 1035–1039.

In one embodiment, the cross-linked polymers are made in such a way that they form a three-dimensional rigid structure, which can entrap dyes in the pores formed by the three-dimensional structure. In another embodiment, the cross-linked polymers entrap the dyes by swelling. Such cross-linked polymers are described in the co-pending European patent application 94870213.9.

Addition of such polymers also enhances the performance of the enzymes according the invention.

Alkoxylated Benzoic Acid

The compositions according to the present invention may optionally, but preferably comprise an alkoxylated benzoic acid or a salt thereof. Generally, the alkoxylated benzoic acid or the salt thereof has the general formula:

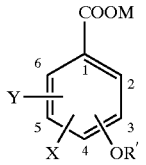

wherein: the substituents of the benzene ring X and Y are independently selected from —H, or —OR'; R' is independently selected from $C_1$ to $C_{20}$ linear or branched alkyl chains, preferably R' is independently selected from $C_1$ to $C_5$ linear or branched alkyl chains, more preferably R' is —$CH_3$, and; M is hydrogen, a cation or a cationic moiety. Preferably, M is selected from the group consisting of hydrogen, alkali metal ions and alkaline earth metal ions. More preferably, M is selected from the group consisting of hydrogen, sodium and potassium. Even more preferably, M is hydrogen.

In a preferred embodiment of the present invention, said alkoxylated benzoic acid or the salt thereof is a monoalkoxy benzoic acid or a salt thereof, wherein in the above general formula: the substituents of the benzene ring X and Y are —H; R' is independently selected from $C_1$ to $C_{20}$ linear or branched alkyl chains, preferably R' is independently selected from $C_1$ to $C_5$ linear or branched alkyl chains, more preferably R' is —$CH_3$, and; M is hydrogen, a cation or a cationic moiety. Preferably, said monoalkoxy benzoic acid or a salt thereof is selected from the group consisting of o-/m-/p-methoxy benzoic acids, salts thereof, and mixtures thereof. More preferably, said monoalkoxy benzoic acid or a salt thereof is m-methoxy benzoic acid (wherein the methoxy group is in position 3 in the above general formula) or a salt thereof.

In another preferred embodiment of the present invention, said alkoxylated benzoic acid or the salt thereof is a dialkoxy benzoic acid or a salt thereof, wherein in the above general formula: the substituent of the benzene ring X is selected from —H; the substituent of the benzene ring Y is —OR'; R' is independently selected from $C_1$ to $C_{20}$ linear or branched alkyl chains, preferably R' is independently selected from $C_1$ to $C_5$ linear or branched alkyl chains, more preferably R' is —$CH_3$, and; M is hydrogen, a cation or a cationic moiety.

In still another preferred embodiment of the present invention, said alkoxylated benzoic acid or the salt thereof is a trialkoxy benzoic acid or a salt thereof, wherein in the above general formula: the substituents of the bennene ring Y and X are —OR'; R' is independently selected from $C_1$ to $C_{20}$ linear or branched alkyl chains, preferably R' is independently selected from $C_1$ to $C_5$ linear or branched alkyl chains, more preferably R' is —$CH_3$, and; M is hydrogen, a cation or a cationic moiety.

Preferably, said alkoxylated benzoic acid or a salt thereof, is selected from the group consisting of: a monoalkoxy benzoic acid, or a salt thereof, a dialkoxy benzoic acid, or a salt thereof; a trialkoxy benzoic acid, or a salt thereof; and a mixture thereof. More preferably, said alkoxylated benzoic acid or a salt thereof, is selected from the group consisting of: a dialkoxy benzoic acid, or a salt thereof; a trialkoxy benzoic acid, or a salt thereof; and a mixture thereof. Even more preferably, said alkoxylated benzoic acid or a salt thereof, is a trimethoxy benzoic acid or a salt thereof.

In a highly preferred embodiment of the present invention, said alkoxylated benzoic acid or the salt thereof is a trimethoxy benzoic acid or a salt thereof (TMBA), wherein in the above general formula: the substituents of the benzene ring Y and X are —OR'; R' is —$CH_3$ and; M is hydrogen, a cation or a cationic moiety.

Preferably, said alkoxylated benzoic acid or the salt thereof is selected from the group consisting of 3,4,5,-trimethoxy benzoic acid, a salt thereof, 2,3,4-trimethoxy benzoic acid, a salt thereof, 2,4,5-trimethoxy benzoic acid, a salt thereof and a mixture thereof. More preferably, said alkoxylated benzoic acid or the salt thereof is 3,4,5,-trimethoxy benzoic acid or a salt thereof. Even more preferably, said alkoxylated benzoic acid or the salt thereof is 3,4,5,-trimethoxy benzoic acid.

Suitable monoalkoxy benzoic acids or salts thereof are commercially available from Aldrich, in particular m-methoxy benzoic acid is commercially available from Aldrich. Suitable trimethoxy benzoic acids or salts thereof are commercially available from Aldrich and Merck.

Typically, the compositions according to the present invention may comprise from 0.001% to 5%, preferably from 0.005% to 2.5% and more preferably from 0.01% to 1.0% by weight of the total composition of said alkoxylated benzoic acid or a salt thereof.

The alkoxylated benzoic acid or a salt thereof, preferably a trialkoxy benzoic acid or a salt thereof, more preferably trimethoxy benzoic acid or a salt thereof (TMBA), can act as a radical scavenger in the compositions according to the present invention. The alkoxylated benzoic acid or salt thereof can stabilize, peroxygen bleaches if present in said compositions of the present invention. Further, the alkoxylated benzoic acids or salts thereof can provide color stability to the compositions of the present invention.

Polymeric Stabilization System

The compositions of the present invention may optionally, but preferably comprise a polymeric stabilization system.

The polymeric stabilization system of the present invention comprises polymeric compounds (including oligomeric compounds). "Polymeric compounds" as used herein includes oligomeric compounds and means polymeric and/or oligomeric compounds that are characterized by having both hydrophilic components and hydrophobic components.

The polymeric compounds for use in the compositions of the present invention can include a variety of charged, e.g., anionic or even cationic (see U.S. Pat. No. 4,956,447), as well as noncharged monomer units and the structures may be linear, branched or even star-shaped. They may also include capping moieties which are especially effective in controlling molecular weight or altering the physical or surface-active properties. Structures and charge distributions may be tailored for specific applications for varied detergent or detergent additive products.

Many of the suitable polymeric compounds are characterized by having nonionic hydrophile segments or hydrophobe segments which are anionic surfactant-interactive.

Examples of suitable polymeric compounds for use in the compositions of the present invention include, but are not limited to, polymeric compounds having:

(a) one or more nonionic hydrophile components consisting essentially of:
  (i) polyoxyethylene segments with a degree of polymerization of at least 2, or
  (ii) oxypropylene or polyoxypropylene segments with a degree of polymerization of from 2 to 10, wherein said hydrophile segment does not encompass any oxypropylene unit unless it is bonded to adjacent moieties at each end by ether linkages, or
  (iii) a mixture of oxyalkylene units comprising oxyethylene and from 1 to about 30 oxypropylene units; or (b) one or more hydrophobe components comprising:
  (i) $C_3$ oxyalkylene terephthalate segments, wherein, if said hydrophobe components also comprise oxyethylene terephthalate, the ratio of oxyethylene terephthalate:$C_3$ oxyalkylene terephthalate units is about 2:1 or lower, and/or
  (ii) $C_4$–$C_6$ alkylene or oxy $C_4$–$C_6$ alkylene segments, or mixtures thereof, and/or
  (iii) poly(vinyl ester) segments, preferably poly(vinyl acetate), having a degree of polymerization of at least 2, and/or
  (iv) $C_1$–$C_4$ alkyl ether or $C_4$ hydroxyalkyl ether substituents, or mixtures thereof, wherein said substituents are present in the form of $C_1$–$C_4$ alkyl ether or $C_4$ hydroxyalkyl ether cellulose derivatives, or mixtures thereof, and such cellulose derivatives are amphiphilic; or (c) a combination of (a) and (b).

Typically, the polyoxyethylene segments of (a)(i) will have a degree of polymerization of from 2 to about 200, although higher levels can be used, preferably from 3 to about 150, more preferably from 6 to about 100. Suitable oxy $C_4$–$C_6$ alkylene hydrophobe segments include, but are not limited to, end-caps of polymeric compounds such as $MO_3S(CH_2)_nOCH_2CH_2O$—, where M is sodium and n is an integer from 4–6, as disclosed in U.S. Pat. No. 4,721,580, issued Jan. 26, 1988 to Gosselink, incorporated herein by reference.

Other polymeric compounds useful in the compositions of the present invention include, but are not limited to, cellulosic derivatives such as hydroxyether cellulosic polymers (commercially available from Dow as METHOCEL®); copolymeric blocks of ethylene terephthalate or propylene terephthalate with polyethylene oxide or polypropylene oxide terephthalate examples of which are described in U.S. Pat. No. 3,959,230 to Hays, U.S. Pat. No. 3,893,929 to Basadur; $C_1$–$C_4$ alkylcelluloses and $C_4$ hydroxyalkyl celluloses such as methylcellulose, ethylcellulose, hydroxypropyl methylcellulose, and hydroxybutyl methylcellulose; and the like. Examples of a variety of cellulosic polymeric compounds are described in U.S. Pat. No. 4,000,093 to Nicol, et al.

Other polymeric compounds are characterized by poly (vinyl ester)hydrophobe segments include graft copolymers of poly(vinyl ester), e.g., $C_1$–$C_6$ vinyl esters, preferably poly(vinyl acetate), grafted onto polyalkylene oxide backbones. See European Patent Application 0 219 048, published Apr. 22, 1987 by Kud, et al. Commercially available examples include SOKALAN compounds such as SOKALAN HP-22, available from BASF, Germany. Other polymeric compounds are polyesters with repeat units containing 10–15% by weight of ethylene terephthalate together with 90–80% by weight of polyoxyethylene terephthalate, derived from a polyoxyethylene glycol of average molecular weight 300–5,000. Commercial examples include ZELCON 5126 from duPont and MILEASE T from ICI.

Other suitable polymeric compounds include the ethyl- or methyl-capped 1,2-propylene terephthalate-polyoxyethylene terephthalate polyesters of U.S. Pat. No. 4,711,730, issued Dec. 8, 1987 to Gosselink et al., the anionic end-capped oligomeric esters of U.S. Pat. No. 4,721,580, issued Jan. 26, 1988 to Gosselink, wherein the anionic end-caps comprise sulfo-polyethoxy groups derived from polyethylene glycol (PEG), the block polyester oligomeric compounds of U.S. Pat. No. 4,702,857, issued Oct. 27, 1987 to Gosselink, having polyethoxy end-caps of the formula $X—(OCH_2CH_2)_n$— wherein n is from 12 to about 43 and X is a $C_1$–$C_4$ alkyl, or preferably methyl, all of these patents being incorporated herein by reference.

Additional polymeric compounds that can be used herein include certain of the polymeric compounds of U.S. Pat. No.

4,877,896, issued Oct. 31, 1989 to Maldonado et al., which discloses anionic, especially sulfoaroyl, end-capped terephthalate esters, said patent being incorporated herein by reference. The terephthalate esters contain unsymmetrically substituted oxy-1,2-alkyleneoxy units. Included among the polymeric compounds of U.S. Pat. No. 4,877,896 are materials with polyoxyethylene hydrophile components or $C_3$ oxyalkylene terephthalate (propylene terephthalate) repeat units within the scope of the hydrophobe components of (b)(i) above.

Additional classes of polymeric compounds include (I) nonionic terephthalates using diisocyanate coupling agents to link up polymeric ester structures, see U.S. Pat. No. 4,201,824, Violland et al. and U.S. Pat. No. 4,240,918 Lagasse et al; (II) polymeric compounds with carboxylate terminal groups made by adding trimellitic anhydride to known polymeric compounds to convert terminal hydroxyl groups to trimellitate esters. With a proper selection of catalyst, the trimellitic anhydride forms linkages to the terminals of the polymer through an ester of the isolated carboxylic acid of trimellitic anhydride rather than by opening of the anhydride linkage. Either nonionic or anionic polymeric compounds may be used as starting materials as long as they have hydroxyl terminal groups which may be esterified. See U.S. Pat. No. 4,525,524 Tung et al.; (III) anionic terephthalate-based polymeric compounds of the urethane-linked variety, see U.S. Pat. No. 4,201,824, Violland et al; (IV) poly(vinyl caprolactam) and related co-polymers with monomers such as vinyl pyrrolidone and/or dimethylaminoethyl methacrylate, including both nonionic and cationic polymers, see U.S. Pat. No. 4,579,68 1, Ruppert et al.; (V) graft copolymers, in addition to the SOKALAN types from BASF made, by grafting acrylic monomers on to sulfonated polyesters; see EP 279,134 A, 1988, to Rhone-Poulenc Chemie; (VI) grafts of vinyl monomers such as acrylic acid and vinyl acetate on to proteins such as caseins, see EP 457,205 A to BASF (1991); (VII) polyester-polyamide polymeric compounds prepared by condensing adipic acid, caprolactam, and polyethylene glycol, especially for treating polyamide fabrics, see Bevan et al, DE 2,335,044 to Unilever N. V., 1974. Other useful polymeric compounds are described in U.S. Pat. Nos. 4,240,918, 4,787,989, 4,525,524 and 4,877,896.

Still additional classes of polymeric compounds for use in the compositions of the present invention include polyvinyl pyrrolidone polymers, polyamine N-oxide polymers, copolymers of N-vinylpyrrolidone and N-vinylimidazole, manganese phthalocyanine, peroxidases, polyvinyl acetate polymers and mixtures thereof, examples of which are described in U.S. Pat. No. 5,817,614 to Miracle et al. If used, these polymeric compounds typically comprise from about 0.01% to about 10% by weight of the composition, preferably from about 0.01% to about 5%, and more preferably from about 0.05% to about 2%.

Polymeric polycarboxylate materials can also be used as polymeric compounds in accordance with the present invention. Such polycarboxylate materials can be prepared by polymerizing or copolymerizing suitable unsaturated monomers, preferably in their acid form. Unsaturated monomeric acids that can be polymerized to form suitable polymeric polycarboxylates include acrylic acid, maleic acid (or maleic anhydride), fumaric acid, itaconic acid, aconitic acid, mesaconic acid, citraconic acid and methylenemalonic acid. The presence in the polymeric polycarboxylates herein or monomeric segments, containing no carboxylate radicals such as vinylmethyl ether, styrene, ethylene, etc. is suitable provided that such segments do not constitute more than about 40% by weight.

Particularly suitable polymeric polycarboxylates can be derived from acrylic acid. Such acrylic acid-based polymers which are useful herein are the water-soluble salts of polymerized acrylic acid. The average molecular weight of such polymers in the acid form preferably ranges from about 2,000 to 10,000, more preferably from about 4,000 to 7,000 and most preferably from about 4,000 to 5,000. Water-soluble salts of such acrylic acid polymers can include, for example, the alkali metal, ammonium and substituted ammonium salts. Soluble polymers of this type are known materials. Use of polyacrylates of this type in detergent compositions has been disclosed, for example, in Diehl, U.S. Pat. No. 3,308,067, issued Mar. 7, 1967.

Acrylic/maleic-based copolymers may also be used as a preferred polymeric compound from the class of polycarboxylates. Such materials include the water-soluble salts of copolymers of acrylic acid and maleic acid. The average molecular weight of such copolymers in the acid form preferably ranges from about 2,000 to 100,000, more preferably from about 5,000 to 75,000, most preferably from about 7,000 to 65,000. The ratio of acrylate to maleate segments in such copolymers will generally range from about 30:1 to about 1:1, more preferably from about 10:1 to 2:1. Water-soluble salts of such acrylic acid/maleic acid copolymers can include, for example, the alkali metal, ammonium and substituted ammonium salts. Soluble acrylate/maleate copolymers of this type are known materials which are described in European Patent Application No. 66915, published Dec. 15, 1982, as well as in EP 193,360, published Sep. 3, 1986, which also describes such polymers comprising hydroxypropylacrylate. Still other useful polymeric compounds from this class include the maleic/acrylic/vinyl alcohol terpolymers. Such materials are also disclosed in EP 193,360, including, for example, the 45/45/10 terpolymer of acrylic/maleic/vinyl alcohol. Another polymeric compound which can be included is polyethylene glycol (PEG).

Still yet another class of polymeric compounds for use in the compositions of the present invention include nonionic surfactants having a high degree of ethoxylation, preferably from about 9 to 30 moles of ethyleneoxy units. If nonionic surfactants are used as the polymeric compounds in accordance with the present invention, then preferably the nonionic surfactants are present in the compositions of the present invention at a level of less than 1% by weight of the composition.

One class of preferred polymeric compounds includes, but are not limited to, oligomeric terephthalate esters, typically prepared by processes involving at least one transesterification/oligomerization, often with a metal catalyst such as a titanium(IV) alkoxide. Such esters may be made using additional monomers capable of being incorporated into the ester structure through one, two, three, four or more positions, without of course forming a densely crosslinked overall structure.

Another type of preferred polymeric compound is a copolymer having random blocks of ethylene terephthalate and polyethylene oxide (PEO) terephthalate. More specifically, these polymers are comprised of repeating units of ethylene terephthalate and PEO terephthalate in a preferred mole ratio of ethylene terephthalate units to PEO terephthalate units of from about 25:75 to about 35:65, said PEO terephthalate units containing polyethylene oxide having molecular weights of from about 300 to about 2,000. The molecular weight of this polymeric compound is preferably in the range of from about 25,000 to about 55,000. See U.S. Pat. No. 3,959,230 to Hays, U.S. Pat. No. 3,893,929 to Basadur for examples of such polymeric compounds.

Still another preferred polymeric compound is a polyester with repeating units of- ethylene terephthalate units containing from about 10–15% by weight of ethylene terephthalate units together with about 90–80% by weight of polyoxyethylene terephthalate units, derived from a polyoxyethylene glycol of average molecular weight of about 300 to about 5,000, and the mole ratio of ethylene terephthalate units to polyoxyethylene terephthalate units in the polymeric compound is preferably between about 2:1 to about 6:1. Examples of this type of polymeric compound include the commercially available material ZELCON® from DuPont and MILEASE® T from ICI. These polymeric compounds and methods of their preparation are more fully described in U.S. Pat. No. 4,702,857 to Gosselink.

Another class of preferred polymeric compounds includes, but is not limited to, sulfonated products of substantially linear ester oligomers comprised of an oligomeric ester backbone of terephthaloyl and oxyalkyleneoxy repeat units and allyl-derived sulfonated terminal moieties covalently attached to the backbone, for example as described in U.S. Pat. No. 4,968,451, Nov. 6, 1990 to J. J. Scheibel and E. P. Gosselink: such ester oligomers can be prepared by (a) ethoxylating allyl alcohol, (b) reacting the product of (a) with dimethyl terephthalate ("DMT") and 1,2-propylene glycol ("PG") in a two-stage transesterification/oligomerization procedure and (c) reacting the product of (b) with sodium metabisulfite in water; the nonionic end-capped 1,2-propylene/polyoxyethylene terephthalate polyesters of U.S. Pat. No. 4,711,730, Dec. 8, 1987 to Gosselink et al, for example those produced by transesterification/oligomerization of poly(ethyleneglycol) methyl ether, DMT, PG and poly(ethyleneglycol) ("PEG"); the partly- and fully-anionic-end-capped oligomeric esters of U.S. Pat. No. 4,721,580, Jan. 26, 1988 to Gosselink, such as oligomers from ethylene glycol ("EG"), PG, DMT and Na-3,6-dioxa-8-hydroxyoctanesulfonate; the nonionic-capped block polyester oligomeric compounds of U.S. Pat. No. 4,702,857, Oct. 27, 1987 to Gosselink, for example produced from DMT, Me-capped PEG and EG and/or PG, or a combination of DMT, EG and/or PG, Me-capped PEG and Na-dimethyl-5-sulfoisophthalate; and the anionic, especially sulfoaroyl, end-capped terephthalate esters of U.S. Pat. No. 4,877,896, Oct. 31, 1989 to Maldonado, Gosselink et al, the latter being typical of polymeric compounds useful in both laundry and fabric conditioning products, an example being an ester composition made from m-sulfobenzoic acid monosodium salt, PG and DMT optionally but preferably further comprising added PEG, e.g., PEG 3400.

Another preferred polymeric compound is an oligomer having empirical formula $(CAP)_2(EG/PG)_5(T)_5(SIP)_1$ which comprises terephthaloyl (T), sulfoisophthaloyl (SIP), oxyethyleneoxy and oxy-1,2-propylene (EG/PG) units and which is preferably terminated with end-caps (CAP), preferably modified isethionates, as in an oligomer comprising one sulfoisophthaloyl unit, 5 terephthaloyl units, oxyethyleneoxy and oxy-1,2-propyleneoxy units in a defined ratio, preferably about 0.5:1 to about 10:1, and two end-cap units derived from sodium 2-(2-hydroxyethoxy)-ethanesulfonate. Said polymeric compound preferably further comprises from 0.5% to 20%, by weight of the oligomer, of a crystallinity-reducing stabilizer, for example an anionic surfactant such as linear sodium dodecylbenzenesulfonate or a member selected from xylene-, cumene-, and toluenesulfonates or mixtures thereof, these stabilizers or modifiers being introduced into the synthesis pot, all as taught in U.S. Pat. No. 5,415,807, Gosselink, Pan, Kellett and Hall, issued May 16, 1995. Suitable monomers for the above polymeric compound include Na 2-(2-hydroxyethoxy)-ethanesulfonate, DMT, Na-dimethyl 5-sulfoisophthalate, EG and PG.

Yet another group of preferred polymeric compounds are oligomeric esters comprising: (1) a backbone comprising (a) at least one unit selected from the group consisting of dihydroxysulfonates, polyhydroxy sulfonates, a unit which is at least trifunctional whereby ester linkages are formed resulting in a branched oligomer backbone, and combinations thereof; (b) at least one unit which is a terephthaloyl moiety; and (c) at least one unsulfonated unit which is a 1,2-oxyalkyleneoxy moiety; and (2) one or more capping units selected from nonionic capping units, anionic capping units such as alkoxylated, preferably ethoxylated, isethionates, alkoxylated propanesulfonates, alkoxylated propanedisulfonates, alkoxylated phenolsulfonates, sulfoaroyl derivatives and mixtures thereof. Preferred of such esters are those of empirical formula:

$$\{(CAP)x(EG/PG)y'(DEG)y''(PEG)y'''(T)z(SIP)z'(SEG)q(B)m\}$$

wherein CAP, EG/PG, PEG, T and SIP are as defined hereinabove, (DEG) represents di(oxyethylene)oxy units; (SEG) represents units derived from the sulfoethyl ether of glycerin and related moiety units; (B) represents branching units which are at least trifunctional whereby ester linkages are formed resulting in a branched oligomer backbone; x is from about 1 to about 12; y' is from about 0.5 to about 25; y" is from 0 to about 12; y"' is from 0 to about 10; y'+y"+y"' totals from about 0.5 to about 25; z is from about 1.5 to about 25; z' is from 0 to about 12; z+z' totals from about 1.5 to about 25; q is from about 0.05 to about 12; m is from about 0.01 to about 10; and x, y', y", y"', z, z', q and m represent the average number of moles of the corresponding units per mole of said ester and said ester has a molecular weight ranging from about 500 to about 5,000.

Preferred SEG and CAP monomers for the above esters include Na-2-(2-,3-dihydroxypropoxy)ethanesulfonate ("SEG"), Na-2-{2-(2-hydroxyethoxy) ethoxy}ethanesulfonate ("SE3") and its homologues and mixtures thereof and the products of ethoxylating and sulfonating allyl alcohol. Preferred polymeric compound esters in this class include the product of transesterifying and oligomerizing sodium 2-{2-(2-hydroxyethoxy) ethoxy}ethanesulfonate and/or sodium 2-[2-{2-(2-hydroxyethoxy)-ethoxy}ethoxy]ethanesulfonate, DMT, sodium 2-(2,3-dihydropxypropoxy)ethane sulfonate, EG, and PG using an appropriate Ti(IV) catalyst and can be designated as (CAP)2(T)5(EG/PG)1.4(SEG)2.5(B)0.13 wherein CAP is $(Na^+—O_3S[CH_2CH_2O]3.5)$- and B is a unit from glycerin and the mole ratio EG/PG is about 1.7:1 as measured by conventional gas chromatography after complete hydrolysis.

Still yet another preferred class of polymeric compounds for use in the vompositions of the present invention include oligomeric, substantially linear, sulfonated poly-ethoxy/propoxy end-capped esters, examples of which and methods of preparation are described in U.S. Pat. No. 5,415,807 to Gosselink et al. The esters comprise oxyethyleneoxy units and terephthaloyl units. Preferred esters additionally comprise units of oxy-1,2-propyleneoxy, sulfoisophthalate and, optionally, poly(oxyethylene)oxy units (with degree of polymerization from 2 to 4). The esters are of relatively low molecular weight, typically ranging from about 500 to about 8,000. Taken in their broadest aspect, the polymeric compounds of this class encompass an oligomeric ester "backbone" which is end-capped on one, or preferably both, ends of the backbone by the essential end-capping units.

The essential end-capping units are anionic hydrophiles derived from sulfonated poly-ethoxy/propoxy groups and connected to the esters by an ester linkage. The preferred end-capping units are of the formula $(MO_3S)(CH_2)_m(CH_2CH_2O)(RO)_n$—wherein N is a salt-forming cation such as sodium or tetraalkylammonium, m is 0 or 1, R is ethylene, propylene, or a mixture thereof, and n is from 0 to 2; and mixtures thereof.

Certain noncharged, hydrophobic aryldicarbonyl units are essential in the backbone unit of the oligoesters herein. Preferably, these are exclusively terephthaloyl units.

Preferred esters of this class comprise, per mole of said ester:

i) from about 1 to about 2 moles of sulfonated poly-ethoxy/propoxy end-capping units of the formula $(MO_3S)(CH_2)_m(CH_2CH_2O)(RO)_n$—wherein H is a salt-forming cation such as sodium or tetraalkylammonium, m is 0 or 1, R is ethylene, propylene or a mixture thereof, and n is from 0 to 2; and mixtures thereof;

ii) from about 0.5 to about 66 moles of units selected from the group consisting of:

a) oxyethyleneoxy units;

b) a mixture of oxyethyleneoxy and oxy-1,2-propyleneoxy units wherein said oxyethyleneoxy units are present in an oxyethyleneoxy to oxy-1,2-propyleneoxy mole ratio ranging from 0.5:1 to about 10:1; and c) a mixture of a) or b) with poly(oxyethylene)oxy units wherein said poly(oxyethylene)oxy units have a degree of polymerization of from 2 to 4; provided that when said poly(oxyethylene)oxy units have a degree of polymerization of 2, the mole ratio of poly(oxyethylene)oxy units to total group ii) units ranges from 0:1 to about 0.33:1; and when said poly(oxyethylene)oxy units have a degree of polymerization of 3, the mole ratio of poly(oxyethylene) oxy units to total group ii) units ranges from 0:1 to about 0.22:1; and when said poly(oxyethylene)oxy units have a degree of polymerization of 4, the mole ratio of poly(oxyetbylene)oxy units to total group ii) units ranges from 0:1 to about 0.14:1;

iii) from about 1.5 to about 40 moles of terephthaloyl units; and iv) from 0 to about 26 moles of 5-sulfoisophthaloyl units of the formula $—(O)C(C_6H_3)(SO_3M)C(O)—$ wherein M is a salt forming cation such as an alkali metal or tetraalkylammonium ion.

More preferably, the polymeric compounds for use in the compositions of the present invention are selected from the group of polymeric compounds described in U.S. Pat. No. 4,702,857 to Gosselink, U.S. Pat. No. 4,968,451 to Scheibel et al., U.S. Pat. No. 5,415,807 to Gosselink et al. and mixtures thereof.

Most preferably, the polymeric compounds for use in the compositions of the present invention are the polymeric compounds described in U.S. Pat. No. 4,968,451 to Scheibel et al.

In addition to providing stabilization of the compositions of the present invention, as described herein, the polymeric stabilization system also provides the compositions with acceptable eye irritation profiles. In other words, the presence of the polymeric stabilization system within the compositions of the present invention results in lower eye irritation properties as compared to compositions lacking the polymeric stabilization system as measured using the Chicken Ex Vivo Eye Test, which can be conducted by the TNO Nutrition and Food Research Institute in The Netherlands. The preferred polymeric stabilization system for this purpose comprises the polymeric compounds described in U.S. Pat. No. 4,968,451 to Scheibel et al.

Generally, the compositions of the present invention will comprise from about 0.01% to about 10%, by weight, of the polymeric compounds, when present, typically from about 0.1% to about 5%, preferably from about 0.02% to about 3.0%.

pH and Buffering Variation

Many of the detergent and laundry compositions described herein will be buffered, i.e., they are relatively resistant to pH drop in the presence of acidic soils. However, other compositions herein may have exceptionally low buffering capacity, or may be substantially unbuffered. Techniques for controlling or varying pH at recommended usage levels more generally include the use of not only buffers, but also additional alkalis, acids, pH-jump systems, dual compartment containers, etc., and are well known to those skilled in the art.

Other Materials

Detersive ingredients or adjuncts optionally included in the instant compositions can include one or more materials for assisting or enhancing laundry performance, treatment of the substrate to be cleaned, or designed to improve the aesthetics of the compositions. Adjuncts which can also be included in compositions of the present invention, at their conventional art-established levels for use (generally, adjunct materials comprise, in total, from about 30% to about 99.9%, preferably from about 70% to about 95%, by weight of the compositions), include other active ingredients such as non-phosphate builders, color speckles, silvercare, anti-tarnish and/or anti-corrosion agents, dyes, fillers, germicides, alkalinity sources, hydrotropes, anti-oxidants, perfumes, solubilizing agents, carriers, processing aids, pigments, and pH control agents as described in U.S. Pat. Nos. 5,705,464, 5,710,115, 5,698,504, 5,695,679, 5,686,014 and 5,646,101.

Methods of Laundry

In addition to the methods for laundry fabrics described herein, the invention herein also encompasses a laundering pretreatment process for fabrics which have been soiled or stained comprising directly contacting said stains and/or soils with a highly concentrated form of the laundry composition set forth above prior to washing such fabrics using conventional aqueous washing solutions. Preferably, the laundry composition remains in contact with the soil/stain for a period of from about 30 seconds to 24 hours prior to washing the pretreated soiled/stained substrate in conventional manner. More preferably, pretreatment times will range from about 1 to 180 minutes.

Product with Instructions for Use

The present invention also encompasses the inclusion of instructions on the use of the aqueous liquid detergent compositions of the present invention with the packages containing the compositions herein or with other forms of advertising associated with the sale or use of the compositions. The instructions may be included in any manner typically used by consumer product manufacturing or supply companies. Examples include providing instructions on a label attached to the container holding the composition; on a sheet either attached to the container or accompanying it when purchased; or in advertisements, demonstrations, and/or other written or oral instructions which may be connected to the purchase or use of the compositions.

Specifically the instructions will include a description of the use of the composition, for instance, the recommended amount of composition to use in a washing machine to clean the fabric; the recommended amount of composition to apply to the fabric; if soaking or rubbing is appropriate.

The compositions of the present invention are preferably included in a product. The product preferably comprises an aqueous liquid detergent composition comprising an effervescent system, and optionally one or more cleaning adjunct materials, and further comprises instructions for using the product to launder fabrics by contacting a fabric in need of cleaning with an effective amount of the composition such that the composition cleans the fabric.

While particular embodiments of the subject invention have been described, it will be obvious to those skilled in the art that various changes and modifications of the subject invention can be made without departing from the spirit and scope of the invention. It is intended to cover, in the appended claims, all such modifications that are within the scope of the invention.

Examples

Cleaning Composition Examples

1. Hard Surface Cleaning Compositions

As used herein "hard surface cleaning composition" refers to liquid and granular detergent compositions for cleaning hard surfaces such as floors, walls, bathroom tile, and the like. Hard surface cleaning compositions of the present invention comprise an effervescent system, a surfactant system, and preferably an effective amount of one or more protease enzymes, preferably from about 0.0001% to about 10%, more preferably from about 0.001% to about 5%, more preferably still from about 0.001% to about 1% by weight of active protease enzyme of the composition. In addition to comprising the effervescent system and preferably one or more protease enzymes, such hard surface cleaning compositions typically comprise a surfactant and a water-soluble sequestering builder. In certain specialized products such as spray window cleaners, however, the surfactants are sometimes not used since they may produce a filmy/streaky residue on the glass surface. (See U.S. Pat. No. 5,679,630 Examples).

The surfactant component, when present, may comprise as little as 0.1% of the compositions herein, but typically the compositions will contain from about 0.25% to about 10%, more preferably from about 1% to about 5% of surfactant.

Typically the compositions will contain from about 0.5% to about 50% of a detergency builder, preferably from about 1% to about 10%. Preferably the pH should be in the range of about 8 to 12. Conventional pH adjustment agents such as sodium hydroxide, sodium carbonate or hydrochloric acid can be used if adjustment is necessary.

Solvents may be included in the compositions. Useful solvents include, but are not limited to, glycol ethers such as diethyleneglycol monohexyl ether, diethylerieglycol monobutyl ether, ethyleneglycol monobutyl ether, ethyleneglycol monohexyl ether, propyleneglycol monobutyl ether, dipropyleneglycol monobutyl ether, and diols such as 2,2,4-trimethyl-1,3-pentanediol and 2-ethyl-1,3-hexanediol. When used, such solvents are typically present at levels of from about 0.5% to about 15%, preferably from about 3% to about 11%.

Additionally, highly volatile solvents such as isopropanol or ethanol can be used in the present compositions to facilitate faster evaporation of the composition from surfaces when the surface is not rinsed after "full strength" application of the composition to the surface. When used, volatile solvents are typically present at levels of from about 2% to about 12% in the compositions.

The hard surface cleaning composition embodiment of the present invention is illustrated by the following nonlimiting examples.

Examples 1–7

Liquid Hard Surface Cleaning Compositions

| | Example No. | | | | | | |
|---|---|---|---|---|---|---|---|
| Component | 1 | 2 | 3 | 4 | 5 | 6 | 7 |
| Protease | 0.05 | 0.05 | 0.20 | 0.02 | 0.03 | 0.10 | 0.03 |
| Chelant** | — | — | — | 2.90 | 2.90 | — | — |
| Citrate | — | — | — | — | — | 2.90 | 2.90 |
| LAS | — | 1.95 | — | 1.95 | — | 1.95 | — |
| AS | 2.00 | — | 2.20 | — | 2.20 | — | 2.20 |
| AES | 2.00 | — | 2.20 | — | 2.20 | — | 2.20 |
| Amine Oxide | 0.40 | — | 0.50 | — | 0.50 | — | 0.50 |
| Hydrotrope | — | 1.30 | — | 1.30 | — | 1.30 | — |
| Solvent*** | — | 6.30 | 6.30 | 6.30 | 6.30 | 6.30 | 6.30 |
| Sodium Bicarbonate | 1 | 1.5 | — | 2 | 3.5 | — | 1.5 |
| Citric Acid | 3 | 5 | — | 3 | 10 | — | 4 |
| Catalase Enzyme | — | — | 0.2 | — | — | 1 | — |
| $H_2O_2$ | — | — | 3 | — | — | 6 | — |
| Water and Minors | balance to 100% | | | | | | |

**$Na_4$ ethylenediamine diacetic acid
***Diethyleneglycol monohexyl ether

The sodium bicarbonate (effervescent agent) and the citric acid (acid agent) are preferably physically and/or chemically separated until the composition is used by a consumer.

The catalase enzyme (effervescent agent) and the $H_2O_2$ (source of peroxide) are preferably physically and/or chemically separated until the composition is used by a consumer.

End use product (after the effervescent agent and acid agent and/or source of peroxide have mixed) has a pH of about 7.

Examples 8–13

Spray Compositions for Cleaning Hard Surfaces and Removing Household Mildew

| | Example No. | | | | | |
|---|---|---|---|---|---|---|
| Component | 8 | 9 | 10 | 11 | 12 | 13 |
| Protease | 0.20 | 0.05 | 0.10 | 0.30 | 0.20 | 0.30 |
| C8AS | 2.00 | 2.00 | 2.00 | 2.00 | 2.00 | 2.00 |
| C12AS | 4.00 | 4.00 | 4.00 | 4.00 | 4.00 | 4.00 |
| Base | 0.80 | 0.80 | 0.80 | 0.80 | 0.80 | 0.80 |
| Silicate | 0.04 | 0.04 | 0.04 | 0.04 | 0.04 | 0.04 |
| Perfume | 0.35 | 0.35 | 0.35 | 0.35 | 0.35 | 0.35 |
| Sodium Bicarbonate | 2 | — | 0.5 | — | 3.5 | 5 |
| Citric Acid | 4 | — | 1.5 | — | 7.5 | 12 |
| Catalase Enzyme | — | 0.2 | — | 1 | — | — |
| $H_2O_2$ | — | 3 | — | 6 | — | — |
| Water and Minors | balance to 100% | | | | | |

The sodium bicarbonate (effervescent agent) and the citric acid (acid agent) are preferably physically and/or chemically separated until the composition is used by a consumer.

The catalase enzyme (effervescent agent) and the $H_2O_2$ (source of peroxide) are preferably physically and/or chemically separated until the composition is used by a consumer.

End use product (after the effervescent agent and acid agent and/or source of peroxide have mixed) has a pH of about 7.

2. Liquid Dishwashing Compositions

Example 14

| Dishwashing Compositions | | |
|---|---|---|
| Component | | |
| NaAE0.6S | 24.70 | 24.70 |
| Glucose amide | 3.09 | 3.09 |
| C10E8 | 4.11 | 4.11 |
| Betaine | 2.06 | 2.06 |
| Amine oxide | 2.06 | 2.06 |
| Magnesium as oxide | 0.49 | 0.49 |
| Hydrotrope | 4.47 | 4.47 |
| Sodium Bicarbonate | 4.0 | — |
| Citric Acid | 11.5 | — |
| Catalase Enzyme | — | 0.3 |
| $H_2O_2$ | — | 5 |
| Protease | 0.05 | 0.05 |
| Water | Balance to 100% | |

The sodium bicarbonate (effervescent agent) and the citric acid (acid agent) are preferably physically and/or chemically separated until the composition is used by a consumer.

The catalase enzyme (effervescent agent) and the $H_2O_2$ (source of peroxide) are preferably physically and/or chemically separated until the composition is used by a consumer.

Example 15

| Liquid Dishwashing Compositions (especially suitable under Japanese conditions) | | | |
|---|---|---|---|
| Component | A | B | C |
| AE1.4S | 24.69 | 24.69 | 24.69 |
| N-cocoyl N-methyl glucamine | 3.09 | 3.09 | 3.09 |
| Amine oxide | 2.06 | 2.06 | 2.06 |
| Betaine | 2.06 | 2.06 | 2.06 |
| Nonionic surfactant | 4.11 | 4.11 | 4.11 |
| Hydrotrope | 4.47 | 4.47 | 4.47 |
| Magnesium oxide | 0.49 | 0.49 | 0.49 |
| Ethanol | 7.2 | 7.2 | 7.2 |
| Perfume | 0.45 | 0.45 | 0.45 |
| Geraniol/BHT | — | 0.60/0.02 | 0.60/0.02 |
| Sodium Bicarbonate | 2.5 | — | 3.5 |
| Citric Acid | 7 | — | 7.5 |
| Catalase Enzyme | — | 0.2 | |
| $H_2O_2$ | — | 7 | |
| Amylase | 0.03 | 0.005 | 0.005 |
| Protease | 0.01 | 0.43 | 0.43 |
| Water | Balance to 100% | | |

The sodium bicarbonate (effervescent agent) and the citric acid (acid agent) are preferably physically and/or chemically separated until the composition is used by a consumer.

The catalase enzyme (effervescent agent) and the $H_2O_2$ (source of peroxide) are preferably physically and/or chemically separated until the composition is used by a consumer.

3 . Liquid Fabric Cleaning Compositions

Liquid fabric cleaning compositions of the present invention preferably comprise an effective amount of one or more protease enzymes, preferably from about 0.0001% to about 10%, more preferably from about 0.001% to about 1%, and most preferably from about 0.001 to about 0.1% by weight of active protease enzyme of the composition. (See U.S. Pat. No. 5,679,630 Examples).

Example 16

| Liquid Fabric Cleaning Compositions | | |
|---|---|---|
| | Example No. | |
| Component | A | B |
| MEA | 0.48 | 9.0 |
| NaOH | 4.40 | 1.0 |
| Pdiol | 4.00 | 10.0 |
| Citric acid | 2.50 | — |
| Sodium bicarbonate | 1.0 | — |
| Catalase Enzyme | — | 0.5 |
| Hydrogen Peroxide | — | 3 |
| Sodium sulfate | 1.75 | — |
| DTPA | 0.50 | 1.0 |
| FWA 15 | 0.15 | 0.15 |
| Na C25AE1.80S | 23.50 | — |
| AE3S (H) | — | 4.0 |
| C11.8HLAS | 3.00 | 14.0 |
| Neodol | 2.00 | 6.0 |
| EtOH | 0.50 | 2.0 |
| Ca*Formate | 0.10 | 0.1 |
| Borax | 2.50 | — |
| Boric acid | — | 1.0 |
| C10 APA | 1.50 | — |
| TEPA 105 | 1.20 | — |
| FA C12–18 | 5.00 | — |
| Neptune LC | 0.50 | — |
| Dye | 0.0040 | 0.0015 |
| Cellulase | 0.053 | 0.2 |
| Amylase | 0.15 | 0.2 |
| Protease | 0.1 | 0.1 |
| DC 2-3597 | 0.12 | 0.2 |
| Rapeseed FA | 6.50 | 4.0 |
| Waters and minors | up to 100% | |

The sodium bicarbonate (effervescent agent) and the citric acid (acid agent) are preferably physically and/or chemically separated until the composition is used by a consumer.

The catalase enzyme (effervescent agent) and the $H_2O_2$ (source of peroxide) are preferably physically and/or chemically separated until the composition is used by a consumer.

Example 17

A heavy duty aqueous liquid detergent composition in accordance with the present invention is prepared in a dual-compartment container as follows (the dual compartment container is designed to deliver preferably a 4:1 weight ratio of the first compartment product vs the second compartment product):

| | % wt. A | % wt. B |
|---|---|---|
| First Compartment | | |
| MEA | 1.10 | 1.10 |
| C10 APA | 0.50 | 0.50 |
| Na C25AE1.80S | 19.35 | 19.35 |
| Propylene Glycol or Glycerol | 7.50 | 7.50 |
| Neodol 23-9 | 0.63 | 0.63 |
| FWA-15 | 0.15 | 0.15 |
| Na Toluene Sulfonate | 2.25 | 2.25 |

-continued

| | % wt. A | % wt. B |
|---|---|---|
| NaOH | 2.79 | 2.79 |
| N-Cocoyl N-Methyl Glucamine | 2.50 | 2.50 |
| Citric Acid | 3.00 | 3.00 |
| C12–16 Real Soap | 2.00 | 2.00 |
| Borax | 2.50 | 2.50 |
| EtOH | 3.25 | 3.25 |
| Ca Formate | 0.09 | 0.09 |
| Polyethyleneimine (MW 600) ethoxylated and average of 20 times per nitrogen | 1.30 | 1.30 |
| Ethoxylated Tetraethylene-Pentaimine | 0.60 | 0.60 |
| Na Formate | 0.115 | 0.115 |
| Fumed Silica | 0.0015 | 0.0015 |
| Soil Release Polymer | 0.08 | 0.08 |
| Water | 46.08 | 46.08 |
| Blue Liquitint 65 | 0.016 | 0.016 |
| Protease | 1.24 | 1.24 |
| Cellulase | 0.043 | 0.043 |
| Amylase | 0.15 | 0.15 |
| Silicone | 0.119 | 0.119 |
| Neptune LC | 0.35 | 0.35 |
| DTPA | 0.30 | 0.30 |
| Sodium Bicarbonate (Effervescent agent) | 2.00 | — |
| Catalase Enzyme (Effervescent agent) | — | 0.15 |
| Second Compartment | | |
| NaOH | 3.46 | 3.46 |
| Citric Acid (Acid agent) | 20.90 | — |
| Hydrogen Peroxide (Source of Peroxide) | — | 4 |
| Water | 72.69 | 72.69 |
| Titanium Dioxide | 2.50 | 2.50 |
| Xanthan Gum | 0.45 | 0.45 |

The sodium bicarbonate (effervescent agent) in the first compartment and the citric acid (acid agent) in the second compartment are preferably physically and/or chemically separated until the composition is used by a consumer.

The catalase enzyme (effervescent agent) in the first compartment and the hydrogen peroxide (source of peroxide) in the second compartment are preferably physically and/or chemically separated until the composition is used by a consumer.

Example 18

A heavy duty aqueous liquid detergent composition in accordance with the present invention is prepared in a dual-compartment container as follows (the dual compartment container is designed to deliver preferably a 4:1 weight ratio of the first compartment product vs the second compartment product):

| | % wt. A | % wt. B |
|---|---|---|
| First Compartment | | |
| MEA | 1.10 | 1.10 |
| C10 APA | 0.50 | 0.50 |
| Na C25AE1.80S | 19.35 | 19.35 |
| Propylene Glycol or Glycerol | 7.50 | 7.50 |
| Neodol 23-9 | 0.63 | 0.63 |
| FWA-15 | 0.15 | 0.15 |
| Na Toluene Sulfonate | 2.25 | 2.25 |
| NaOH | 2.79 | 2.79 |
| N-Cocoyl N-Methyl Glucamine | 2.50 | 2.50 |

-continued

| | % wt. A | % wt. B |
|---|---|---|
| Citric Acid | 3.00 | 3.00 |
| C12–16 Real Soap | 2.00 | 2.00 |
| Borax | 2.50 | 2.50 |
| EtOH | 3.25 | 3.25 |
| Ca Formate | 0.09 | 0.09 |
| Polyethyleneimine (MW 600) ethoxylated and average of 20 times per nitrogen | 1.30 | 1.30 |
| Ethoxylated Tetraethylene-Pentaimine | 0.60 | 0.60 |
| Na Formate | 0.115 | 0.115 |
| Fumed Silica | 0.0015 | 0.0015 |
| Soil Release Polymer | 0.08 | 0.08 |
| Water | 45.08 | 45.08 |
| Blue Liquitint 65 | 0.016 | 0.016 |
| Protease | 1.24 | 1.24 |
| Cellulase | 0.043 | 0.043 |
| Amylase | 0.15 | 0.15 |
| Silicone | 0.119 | 0.119 |
| Neptune LC | 0.35 | 0.35 |
| DTPA | 0.30 | 0.30 |
| Sodium Bicarbonate (Effervescent agent) | 3.00 | — |
| Second Compartment | — | 0.3 |
| Phthaloylamino peroxycaproic acid (PAP) | 22.5 | 22.5 |
| Citric Acid (Acid agent) | 5.0 | — |
| Hydrogen Peroxide (Source of Peroxide) | — | 4 |
| Water | 72.1 | 72.1 |
| Xanthan Gum | 0.4 | 0.4 |

The sodium bicarbonate (effervescent agent) in the first compartment and the citric acid (acid agent) in the second compartment are preferably physically and/or chemically separated until the composition is used by a consumer.

The catalase enzyme (effervescent agent) in the first compartment and the hydrogen peroxide (source of peroxide) in the second compartment are preferably physically and/or chemically separated until the composition is used by a consumer.

Example 19

A heavy duty aqueous liquid detergent composition in accordance with the present invention is prepared in a dual-compartment container as follows (the dual compartment container is designed to deliver preferably a 4:1 weight ratio of the first compartment product vs the second compartment product):

| Finished Product Material Chemical Name | % Wt. Active A | % Wt. Active B |
|---|---|---|
| FIRST COMPARTMENT | | |
| Citric Acid | 2.80 | 2.80 |
| FA C12–18 TPK | 3.20 | 3.20 |
| MEA | 2.70 | 2.70 |
| Propylene Glycol (Pdiol) or Glycerol | 7.40 | 7.40 |
| Ca Formate | 0.05 | 0.05 |
| Borax | 2.50 | 2.50 |
| PEI 189E15–18 | 0.60 | 0.60 |
| Polyethyleneimine | 1.20 | 1.20 |
| DTPA Na5 | 0.15 | 0.15 |
| Protease | 1.20 | 1.20 |
| Amylase | 0.18 | 0.18 |

-continued

| Finished Product Material Chemical Name | % Wt. Active A | % Wt. Active B |
|---|---|---|
| Mannanase | 0.2000 | 0.2000 |
| FWA 15 | 0.125 | 0.125 |
| C11.8 HLAS | 2.40 | 2.40 |
| Processing Aid | — | 0.05 |
| Suds Suppressor | 0.01 | 0.01 |
| C12–13 AE9 (Neodol 23.9) | 2.40 | 2.40 |
| AES paste (Stepan) | 18.00 | 18.00 |
| C10 APA | 0.60 | 0.60 |
| Amine Oxide | 0.60 | 0.60 |
| Dye | 0.016 | 0.016 |
| Perfume | 1.14 | 0.75 |
| Catalase Enzyme | 0.10 | 0.10 |
| Water | Balance | Balance |
| SECOND COMPARTMENT | | |
| PAP (wetcake) | 23.41 | 23.41 |
| H2O2 | 5.71 | 5.71 |
| Water | 61.77 | 61.77 |
| Polymeric Stabilization System | 2.00 | 2.00 |
| Xanthan Gum | 0.51 | 0.51 |
| NaOH | 1.50 | 1.50 |
| Succinic Acid | 5.00 | 5.00 |
| TMBA | 0.10 | 0.10 |

The catalase enzyme (effervescent agent) in the first compartment and the hydrogen peroxide (source of peroxide) in the second compartment are preferably physically and/or chemically separated until the composition is used by a consumer.

Example 20

A heavy duty aqueous liquid detergent composition in accordance with the present invention is prepared in a dual-compartment container as follows (the dual compartment container is designed to deliver preferably a 4:1 weight ratio of the first compartment product vs the second compartment product), such compositions are suitable for forming foam upon mixing.

| | % wt. A | % wt. B |
|---|---|---|
| First Compartment | | |
| C12–15 Alkyl alcohol 5 ethoxylated | 20 | 20 |
| C12 Alkyl Dimethylamine amine oxide | 5 | 5 |
| Sodium bicarbonate | 3 | 3 |
| Propylene glycol | 5 | 5 |
| Cumene sulfonic acid | 5 | 5 |
| Monoethanolamine | 2.9 (to pH 8.5) | 2.9 (to pH 8.5) |
| Boosters, enzymes, perfume | 5 | 5 |
| Second Compartment | | |
| PAP | — | 17 |
| Citric acid | 30 | 30 |
| Sodium hydroxide | 7.3 (to pH 3.0) | 7.3 (to pH 3.0) |

A foam especially formed from A is particularly suited for cleaning and color care of delicate fabrics/items.

The compositions of the present invention can be suitably prepared by any process chosen by the formulator, nonlimiting examples of which are described in U.S. Pat. No. 5,879,584 Bianchetti et al., issued Mar. 9, 1999; U.S. Pat. No. 5,691,297 Nassano et al., issued Nov. 11, 1997; U.S. Pat. No. 5,574,005 Welch et al., issued Nov. 12, 1996; U.S. Pat. No. 5,569,645 Dinniwell et al., issued Oct. 29, 1996; U.S. Pat. No. 5,565,422 Del Greco et al., issued Oct. 15, 1996; U.S. Pat. No. 5,516,448 Capeci et al., issued May 14, 1996; U.S. Pat. No. 5,489,392 Capeci et al., issued Feb. 6, 1996; U.S. Pat. No. 5,486,303 Capeci et al., issued Jan. 23, 1996 all of which are incorporated herein by reference.

In addition to the above examples, the compositions of the present invention can be formulated into any suitable laundry detergent composition, non-limiting examples of which are described in U.S. Pat. No. 5,679,630 Baeck et al., issued Oct. 21, 1997; U.S. Pat. No. 5,565,145 Watson et al., issued Oct. 15, 1996; U.S. Pat. No. 5,478,489 Fredj et al., issued Dec. 26, 1995; U.S. Pat. No. 5,470,507 Fredj et al., issued Nov. 28, 1995; U.S. Pat. No. 5,466,802 Panandiker et al., issued Nov. 14, 1995; U.S. Pat. No. 5,460,752 Fredj et al., issued Oct. 24, 1995; U.S. Pat. No. 5,458,810 Fredj et al., issued Oct. 17, 1995; U.S. Pat. No. 5,458,809 Fredj et al., issued Oct. 17, 1995; U.S. Pat. No. 5,288,431 Huber et al., issued Feb. 22, 1994 all of which are incorporated herein by reference.

Having described the invention in detail with reference to preferred embodiments and the examples, it will be clear to those skilled in the art that various changes and modifications may be made without departing from the scope of the invention and the invention is not to be considered limited to what is described in the specification.

What is claimed is:

1. An aqueous liquid detergent composition comprising an effervescent system, wherein the aqueous liquid detergent composition comprises a peracid and wherein the effervescent system comprises:

a) a first effervescent agent-containing component; and b) an second acid agent-containing component, and wherein said effervescent agent-containing component and said agent-containing component are chemically and/or physically separated from one another until effervescence is desired.

2. The composition according to claim 1 wherein the effervescent system further comprises a source of peroxide.

3. The composition according to claim 2 wherein said effervescent agent-containing component and said acid agent-containing component are physically separated from one another until effervescence is desired.

4. The composition according to claim 1 wherein said effervescent agent-containing components and acid agent-containing components are in liquid form.

5. The composition according to claim 1 wherein said effervescent agent-containing compound is in liquid form and said acid agent containing component is in solid form.

6. The composition according to claim 5 wherein said solid form is a tablet or granule.

7. The composition according to claim 1 wherein said effervescent agent-containing component comprises a base, present at a level of from about 1% to about 10% by weight of said composition.

8. The composition according to claim 7 wherein said base is selected from the group consisting of carbonates, bicarbonates, sesquicarbonates and mixtures thereof.

9. The composition according to claim 8 wherein said effervescent agent-containing component has a pH of 7 or greater.

10. The composition according to claim 1 wherein said acid agent containing component comprises an acid agent selected from the group consisting of: inorganic acids, organic acids and combinations thereof; wherein said acid agent is present in said composition at a level of from about 1% to about 20% by weight of said composition.

11. The composition according to claim 10 wherein said acid agent comprises a pKa of about 7 or less.

12. The composition according to claim 1 wherein said acid agent-containing component comprises one or more adjunct ingredients selected from the group consisting of: peroxide bleaches, hydrogen peroxide, polycarboxylic acid polymers, chelants, builders, electrolytes and combinations thereof.

13. The composition according to claim 1 wherein said effervescent agent-containing component is contained within a first compartment of a multi-compartment container and said acid agent-containing component is contained within a second compartment of said multi-compartment container such that said effervescent agent-containing component and said acid agent-containing component only effervesce after being mixed.

14. The composition according to claim 1 wherein said composition further comprises a surfactant and one or more cleaning adjunct materials selected from the group consisting of: builders, bleaches, bleach activators, bleach catalysts, enzymes, enzyme stabilizing systems, chelants, optical brighteners, soil release polymers, dye transfer agents, dispersants, suds suppressors, dyes, perfumes, colorants, filler salts, hydrotropes, photoactivators, fluorescers, fabric conditioners, fabric softening agents, hydrolysable surfactants, preservatives, anti-oxidants, anti shrinkage agents, anti-wrinkle agents, germicides, fungicides, color speckles, silvercare, anti-tarnish and/or anti-corrosion agents, alkalinity sources, solubilizing agents, carriers, processing aids, pigments and pH control agents.

15. The composition according to claim 1 wherein said effervescent agent-containing component further comprises a surfactant selected from the group consisting of: anionic, nonionic, cationic, amphoteric, zwitterionic and mixtures thereof.

16. The composition according to claim 1 wherein said effervescent agent-containing component comprises a peroxide reducing enzyme selected from the group consisting of: peroxidase, laccase, dioxygenase, catalase and mixtures thereof; wherein said peroxide reducing enzyme is present in said composition at a level of from about 0.001% to about 10% by weight of said composition.

17. The composition according to claim 2 herein said source of peroxide comprises hydrogen peroxide, present at a level of from about 0.001% to about 15% by weight of said composition.

18. The composition according to claim 1 wherein the composition further comprises a bleach activator.

19. The composition according to claim 1 wherein the composition is a heavy duty liquid detergent.

20. The composition according to claim 13 wherein the multi-compartment container is designed to deliver a 4:1 weight ratio of the effervescent agent-containing component to the acid-agent containing component.

21. A method for laundering fabrics in need of laundering comprising the step of contacting said fabrics with the aqueous liquid detergent composition of claim 1.

* * * * *